US011812781B1

(12) United States Patent
Siann et al.

(10) Patent No.: US 11,812,781 B1
(45) Date of Patent: Nov. 14, 2023

(54) INTRA-CONTAINER CONTROLLED ENVIRONMENT SYSTEMS AND METHODS

(71) Applicant: PENDRAM, INC., San Diego, CA (US)

(72) Inventors: Jonathan Siann, San Diego, CA (US); Wilson C. Ng, San Diego, CA (US)

(73) Assignee: PENDRAM, INC, San Diego, CA (US)

( * ) Notice: Subject to any disclaimer, the term of this patent is extended or adjusted under 35 U.S.C. 154(b) by 373 days.

(21) Appl. No.: 16/827,258

(22) Filed: Mar. 23, 2020

Related U.S. Application Data

(60) Provisional application No. 62/824,822, filed on Mar. 27, 2019.

(51) Int. Cl.

| | |
|---|---|
| ***A24F 25/02*** | (2006.01) |
| ***B65D 81/22*** | (2006.01) |
| ***F24F 3/14*** | (2006.01) |
| ***B65D 81/18*** | (2006.01) |
| ***B65D 85/12*** | (2006.01) |
| *A24F 15/12* | (2006.01) |
| *F24F 11/00* | (2018.01) |
| *F24F 110/20* | (2018.01) |

(Continued)

(52) U.S. Cl.
CPC ..... *A24F 25/02* (2013.01); *B65D 81/18* (2013.01); *B65D 85/12* (2013.01); *F24F 3/14* (2013.01); *A24F 15/12* (2013.01); *F24F 11/0008* (2013.01); *F24F 11/56* (2018.01); *F24F 2006/008* (2013.01); *F24F 2110/20* (2018.01); *F25B 2500/18* (2013.01); *F25B 2500/19* (2013.01)

(58) Field of Classification Search
CPC ..... B65D 81/22; B65D 85/12; F24F 11/0008; F24F 2006/008; A24F 25/02; F25B 2600/07; G05B 2219/37008; G05D 22/00; G05D 22/02
See application file for complete search history.

(56) References Cited

U.S. PATENT DOCUMENTS 5,351,855 A * 10/1994 Nelson ..... G05D 22/02 236/44 C
5,444,984 A * 8/1995 Carson ..... A47B 81/00 62/3.4

(Continued)

*Primary Examiner* — Jerry-Daryl Fletcher
*Assistant Examiner* — Daniel C Comings
(74) *Attorney, Agent, or Firm* — Barcelo, Harrison & Walker, LLP

(57) ABSTRACT

Systems and methods including a container assembly configured to maintain a controlled environment for storing a product therein are disclosed. Controlled environmental parameters may include at least one of the following: temperature, humidity, payload moisture content, solar radiation, magnetism, microwave, or light illumination. In certain implementations, the system includes a payload chamber and a self-contained environmental control unit (ECU) that may be coupled to the payload chamber using a substantially airtight seal. In certain embodiments, the ECU may include a condenser, a humidity controller, a liquid tank and a power source. Certain embodiments may include a warmer, temperature and/or humidity sensors, and/or a lock. Various combinations of the foregoing components and features may be incorporated, depending on the requirements of each particular implementation.

24 Claims, 43 Drawing Sheets

(51) Int. Cl.
*F24F 6/00* (2006.01)
*F24F 11/56* (2018.01)

(56) References Cited

U.S. PATENT DOCUMENTS

| | | | | |
|---|---|---|---|---|
| 5,741,444 | A | 4/1998 | Kasuli | |
| 5,934,773 | A * | 8/1999 | Ferrell | A24F 25/02 206/204 |
| 5,970,987 | A * | 10/1999 | Barreiro, Jr. | A24F 25/02 312/31 |
| 6,094,917 | A | 8/2000 | Sundhar et al. | |
| 6,116,029 | A | 9/2000 | Krawec | |
| 6,209,717 | B1 * | 4/2001 | Flynn | G10G 7/005 206/204 |
| 9,981,790 | B1 | 5/2018 | Ost et al. | |
| 2003/0183380 | A1 | 10/2003 | Youn | |
| 2007/0012796 | A1 | 1/2007 | Pohl | |
| 2010/0012739 | A1 * | 1/2010 | Hoeth | G10G 7/00 236/44 C |
| 2010/0312397 | A1 * | 12/2010 | George | G05D 22/02 700/278 |
| 2012/0111044 | A1 * | 5/2012 | Chen | B60H 1/3232 62/207 |
| 2017/0234564 | A1 | 8/2017 | Goel et al. | |
| 2019/0133165 | A1 * | 5/2019 | Schmitz | A23B 4/06 |

* cited by examiner

Controlled Environment System

Controlled Environment System

Environmental Control Unit
(ECU)

Battery Retainer Assembly

Remote Sensor Circuit Board

100: Heat-Pumped Heat Exchanger – Calibration Algorithm

200: Humidifier Evaporation Element – Calibration Algorithm

INTRA-CONTAINER CONTROLLED ENVIRONMENT SYSTEMS AND METHODS

CROSS-REFERENCE TO RELATED APPLICATION

This application claims the benefit of Provisional Application Ser. No. 62/824,822 filed on 27 Mar. 2019, the contents of which are herein incorporated by reference in their entirety for all purposes.

BACKGROUND OF THE DISCLOSURE

1. Field of the Disclosure

The disclosure relates generally to systems and methods for providing a controlled environment for object storage, and more particularly to self-contained controlled environment storage and enhancement systems and methods with improved features and characteristics.

2. General Background

Various containers have been developed to facilitate storage of items. Typical storage containers/vessels include the storage container itself and a removable lid. Various modes of interaction of storage containers and associated lids are known.

In certain applications, there is a need to maintain items in a controlled environment in terms of, for example, temperature, humidity, odor control, and/or safety when they are stored in a container assembly.

It is desirable to address the current limitations in this art.

BRIEF DESCRIPTION OF THE DRAWINGS

By way of example, reference will now be made to the accompanying drawings, which are not to scale unless otherwise indicated.

DETAILED DESCRIPTION

Figure 1:
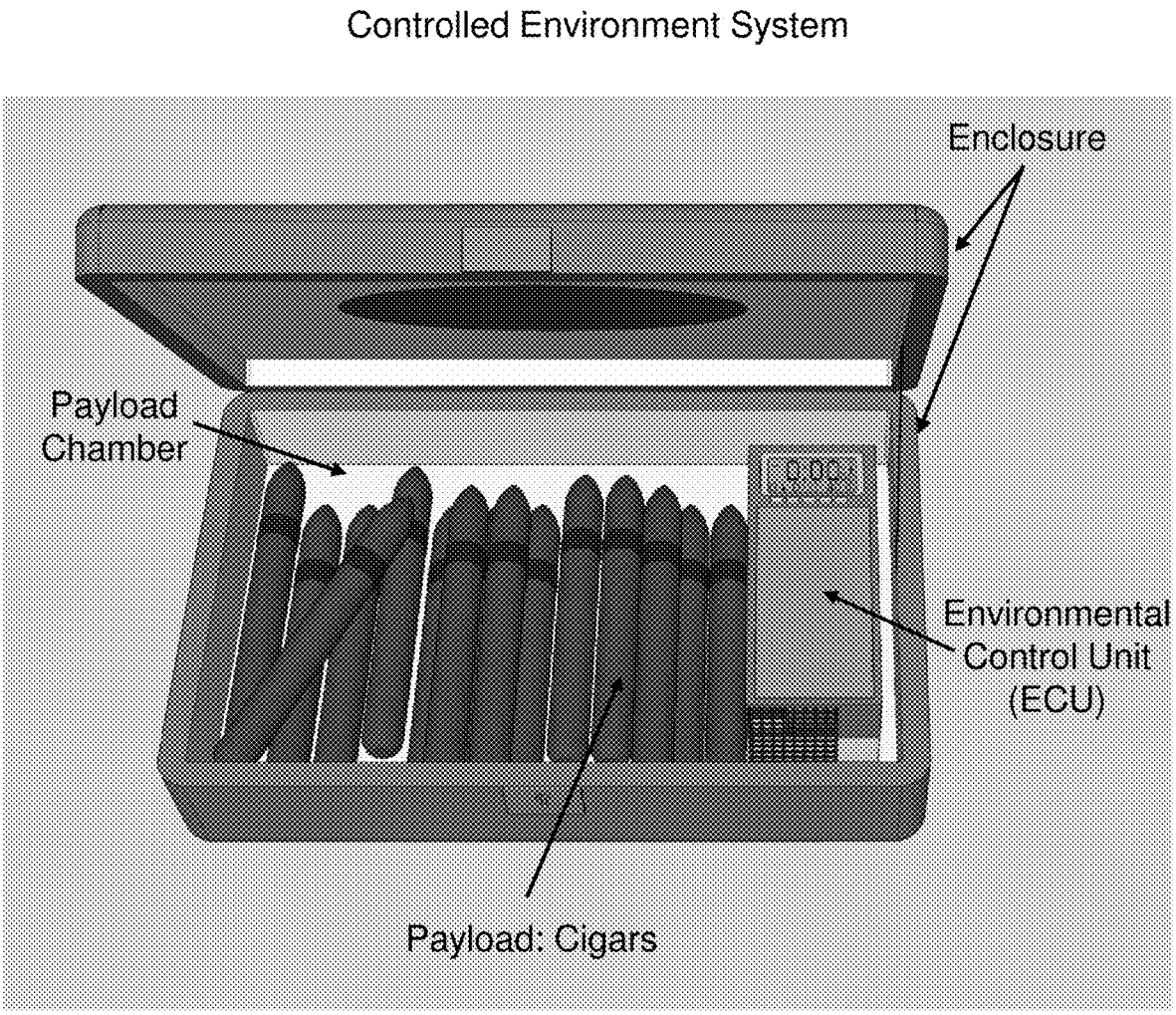
FIG. 1 is an exemplary diagram of a controlled environment system that may be used to implement aspects of certain embodiments of the present invention.

Those of ordinary skill in the art will realize that the following description of the present invention is illustrative only and not in any way limiting. Other embodiments of the invention will readily suggest themselves to such skilled persons, having the benefit of this disclosure, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Reference will now be made in detail to specific implementations of the present invention as illustrated in the accompanying drawings. The same references and reference numbers will be used throughout the drawings and the following description to refer to the same or like parts.

1 Introduction

A controlled environment system according to aspects of the present invention is a self-contained storage and/or enhancement system for organic and/or non-organic objects that may benefit from a controlled environment. Suitable organic objects may include, without limitation, plants, herbal medicines, culinary herbs, food products, dried food, fruits, vegetables, flowers, leaves, tobacco, cannabis, meat, flours, sugar, cheese, cigars, alcohol, milk, and the like. Suitable non-organic objects may include, without limitation, coatings, paints, paintings, chemicals, metals, and the like, that may benefit from a controlled environment to allow for curing or to prevent oxidation. Benefits of the controlled environment system according to aspects of the present invention may include longer storage times based on providing a better environment for storage, drying items, ripening and curing items, optimizing flavor, increasing aroma and potency while eliminating or reducing odor, and preventing mold and bacteria growth during long-term storage of payloads. Other applications for the controlled environment system according to aspects of the present invention may include curing meats, preserving artwork (e.g. paintings), preserving documents, and the care of sensitive seedlings, such as cannabis seedlings, both in a steady environment as well as during transport. In some applications, prior to placing payload into a controlled environment system, according to aspects of the present invention, the enclosure may require "seasoning" which may be performed by the system; for example, saturating the enclosure material to a certain moisture content. The system may perform the "seasoning" as part of a Seasoning Mode, which may or may not be performed with power conservation as a goal. During "seasoning," a significant amount of water may be absorbed by the enclosure; for example, the wood lining of a new humidor.

The system in at least one application is substantially airtight. Airtightness is important in certain embodiments because it prevents contents from oxidizing (e.g., in the case of cannabis this is called decarboxylation) and allows for better control of the internal environment. Airtightness is also important for preventing odors from exiting the controlled environment (e.g. box enclosure, sealed mason jar, etc.) and preserving the internal environment. Eliminating or reducing odor leakage from the controlled environment is important in the cannabis market as well as many other markets, such as paint curing, where the odors may be particularly strong or in some cases toxic.

The controlled environment system according to aspects of the present invention may control at least one of the following conditions: temperature, humidity, payload moisture content, solar radiation, magnetism, microwave, light illumination, and the like. The payload chamber environment may be controlled in an effective and power efficient manner in certain embodiments, but in other embodiments may be controlled in a less efficient manner so as to decrease the time to reach target parameters.

2 Architecture

In certain embodiments, the architecture of a controlled environment system according to aspects of the present invention consists of various subassemblies. These subassemblies work together to create a controlled environment for the item(s) (payload) being stored within. Aside from the controlled environment, one of the main goals of the system in certain embodiments is power efficiency so as to maximize battery life and/or time between battery charges.

As can be seen from FIG. 1, the controlled environment system in certain embodiments consists of two main units: an enclosure containing a payload chamber, and an environmental control unit ("ECU"). The environmental control unit, in the example shown, may fit into the payload chamber and may control atmospheric conditions within the payload chamber. The ECU also provides for a user interface where status may be monitored and configuration entries may be made.

Figure 2:
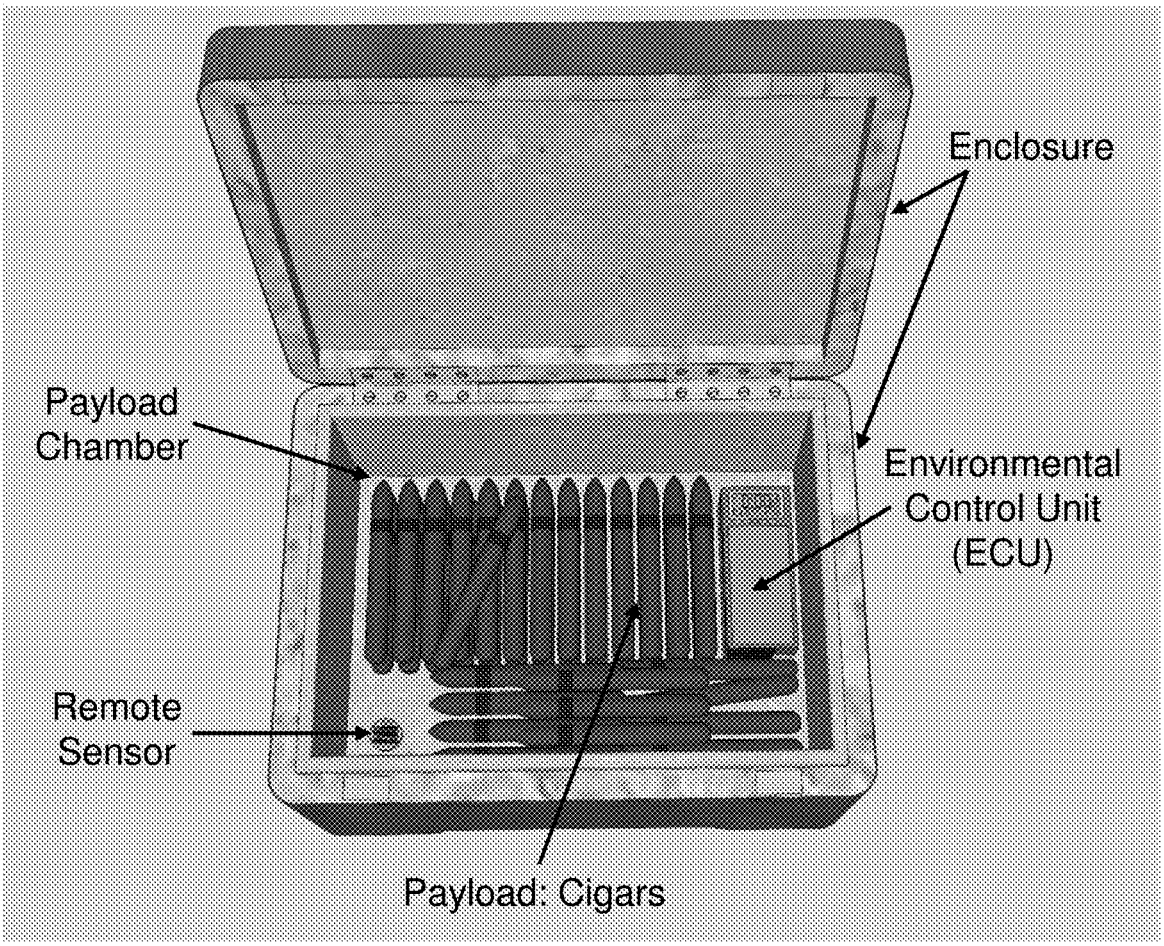
FIG. 2 is an exemplary diagram of a controlled environment system using a remote sensor that may be used to implement aspects of certain embodiments of the present invention.

FIG. 2 provides a second embodiment of a controlled environment system. In this embodiment, there are three main units: an enclosure containing a payload chamber, an environmental control unit ("ECU"), and one or more remote sensors. The remote sensors may communicate with the ECU and provides for the ability to monitor the atmospheric conditions at one or more additional locations, aside from the ECU. One example of where remote sensors may be used is where the payload chamber may be large or the payload is densely packed so as to provide better environmental control.

Figure 3:
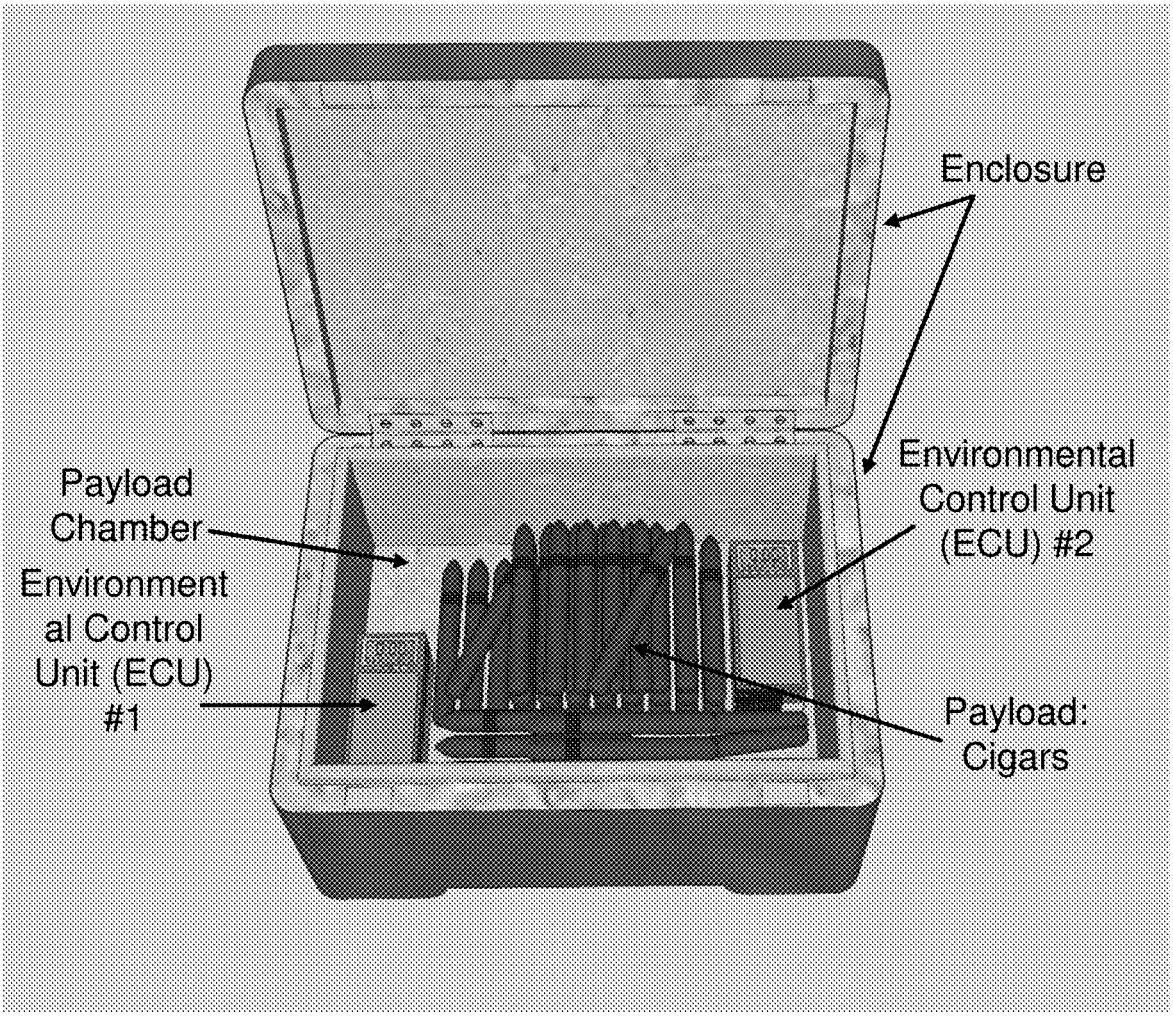
FIG. 3 is an exemplary diagram of a controlled environment system using multiple ECUs that may be used to implement aspects of certain embodiments of the present invention.

FIG. 3 provides a third embodiment of a controlled environment system. In this embodiment, there are three main units: an enclosure containing a payload chamber and two environmental control units ("ECUs"). The ECUs may work together or operate independently to control the environment. One ECU may control one aspect of the environment while the other controls a different aspect of the environment. ECU #1 may communicate with ECU #2 to share sensor readings and, either independently or together, determine how to achieve the desired atmospheric conditions. Multiple ECUs (and sensors) may be required in the case of very large or densely packed payload chambers so as to provide optimal environmental control. There is no limitation on the numbers and quantities of ECUs and remote sensors that may be distributed within a payload chamber.

Controlled environmental parameters may include at least one of the following: temperature, humidity, payload moisture content, solar radiation, magnetism, microwaves, or light illumination. In certain implementations, the system includes an enclosure with payload chamber and a self-contained environmental control unit (ECU) that may be placed within or coupled to the payload chamber. The enclosure may or may not have a substantially airtight seal, though one may be desirable to reduce energy consumption. In certain embodiments, the ECU may include a condenser, a humidity controller, a liquid tank, and a power source. Certain embodiments may include a warmer, and temperature and/or humidity sensors. Various combinations of the foregoing components and features may be incorporated, depending on the requirements of each particular implementation.

Figure 4:
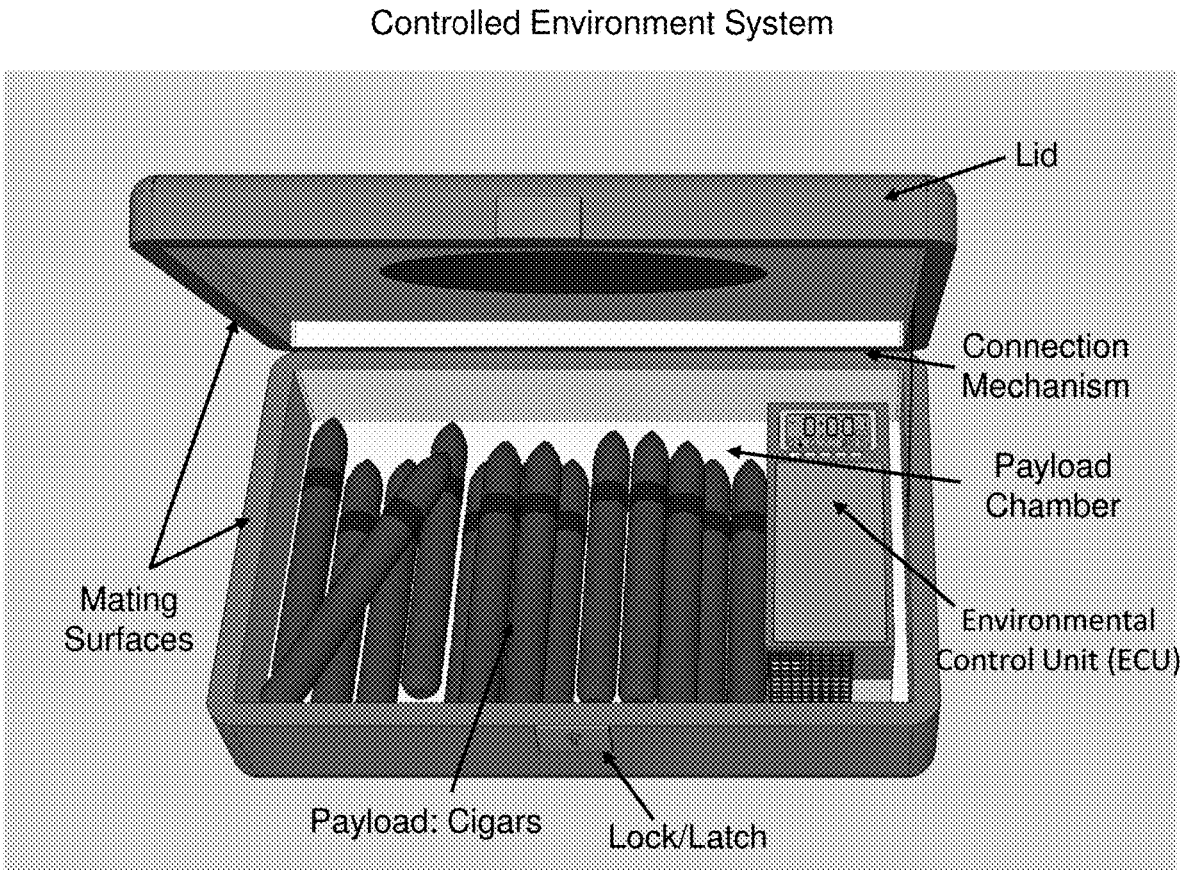
FIG. 4 is an exemplary implementation of a controlled environment system with more details on the enclosure subcomponents.

For example, the specific controlled environment system of FIG. 4 is a primarily wood enclosure with a clamshell type lid whose mating surfaces may substantially separate the payload chamber environment from the external environment. The external surfaces of the enclosure may be lined with leather, painted, stained, etc. The enclosure itself may also fit into yet another, larger enclosure where multiple smaller enclosures may be stacked together. The mating surfaces of the enclosure may be finely fitted wood, or may be lined with felt or some other material to isolate the payload chamber. A lock or latching mechanism may be used to hold the lid closed. Those skilled in the art would find it obvious that other mechanisms and architectures may be used at the mating surfaces to improve isolation.

An environmental control unit ("ECU") may control the addition or subtraction of water vapor to reach a setpoint of a relative humidity level to enable achieving a certain moisture content of the payload/content. This is generally performed automatically using an internal water tank for humidification and an active dehumidification system based on the Peltier effect or other type of heating and cooling element(s). It is important to realize that the relative humidity may be primarily controlled so as to achieve the desired moisture content of the payload. The relative humidity may, at any particular instant, be greater than or lower than the desired moisture content so as to maintain the desired payload moisture content. At steady state, the relative humidity may match the desired payload moisture content. The relative humidity may be set to track the relative humidity level of the external environment, or of a specific location on or within the payload. There may be remote sensors that allow this remote relative humidity tracking.

Aspects of the architecture and the different subassemblies in certain embodiments will be discussed below.

2.1 Subassemblies

2.1.1 Payload Chamber

The payload chamber may be any variety of space that may be separated from the environment external to it. The separation may range from complete isolation (temperature, humidity, gasses, solar radiation, light illumination, EMI, etc.) to only partial isolation (e.g. an uninsulated, clear container that may allow humidity, air, light, or temperature to follow, at least partially, the external environment).

The materials that the enclosure may be composed of include, but are not limited to, glass, ceramic, plastic, wood, stone, rubber, metal, leather, or any other materials or combinations thereof. The type of material may be chosen for its cost properties, insulative properties, thickness, aesthetics, weight, a combination of properties, or other.

The shape of the enclosure may be either dependent, partially dependent, or independent of the item to be stored inside. The dimensions and shape may be any size or geometry, such as a rectangular enclosure, a mason jar, a square enclosure, octagonal enclosure etc.

The enclosure may enclose items that require a controlled environment. These may include organic substances (e.g. tobacco, cigars, wood, plants, leaves, vegetables, fruits, etc.) or non-organic substances (metals, plastics, films, etc.) that require control of one or more aspects of their environment.

In the exemplary implementation depicted in FIG. 4, the payload chamber consists of an off-the-shelf cigar humidor. A humidor may be made from wood (commonly cedar or pine but may be any type of wood) that may be lined with felt, wrapped in leather, may have a window that may be made of glass or plastic, and may be stained or painted any color. Humidors may also be made from any other material or combination of materials to yield the desired humidor properties. Humidors are manufactured by multiple vendors such as Diamond Crown, Thompson Cigar, Davidoff, etc. or may be made custom. A humidor, while used for cigars, may contain a payload which may be any substance (e.g. gas, liquid or solid, alive, dead, etc.) that may need to be temperature and/or humidity controlled and/or any other environmental condition controlled for some time duration.

Humidors may also have custom logos added to them by adhering labels, painting, embossing or by any other attachment process in the manufacturing of the enclosure or after the manufacturing of the enclosure. The humidor even may be manufactured with the logo built into the enclosure material or some combination of materials on the enclosure.

The humidor may be any suitable size, from a few cigars to hundreds of cigars. They may even be any geometric shape such as circular, rectangular, square, triangular, etc.

The payload chamber may be any suitable geometric shape, such as a square or rectangular space, etc. In these other configurations the environmental control unit (ECU) may be at least partially inserted, fully inserted or placed on or within any side of the unit such as the sides, bottom, or top of the payload chamber. There may be multiple ECUs used to control the environment and multiple remote sensors.

2.1.2 Environmental Control Unit

Figure 5:
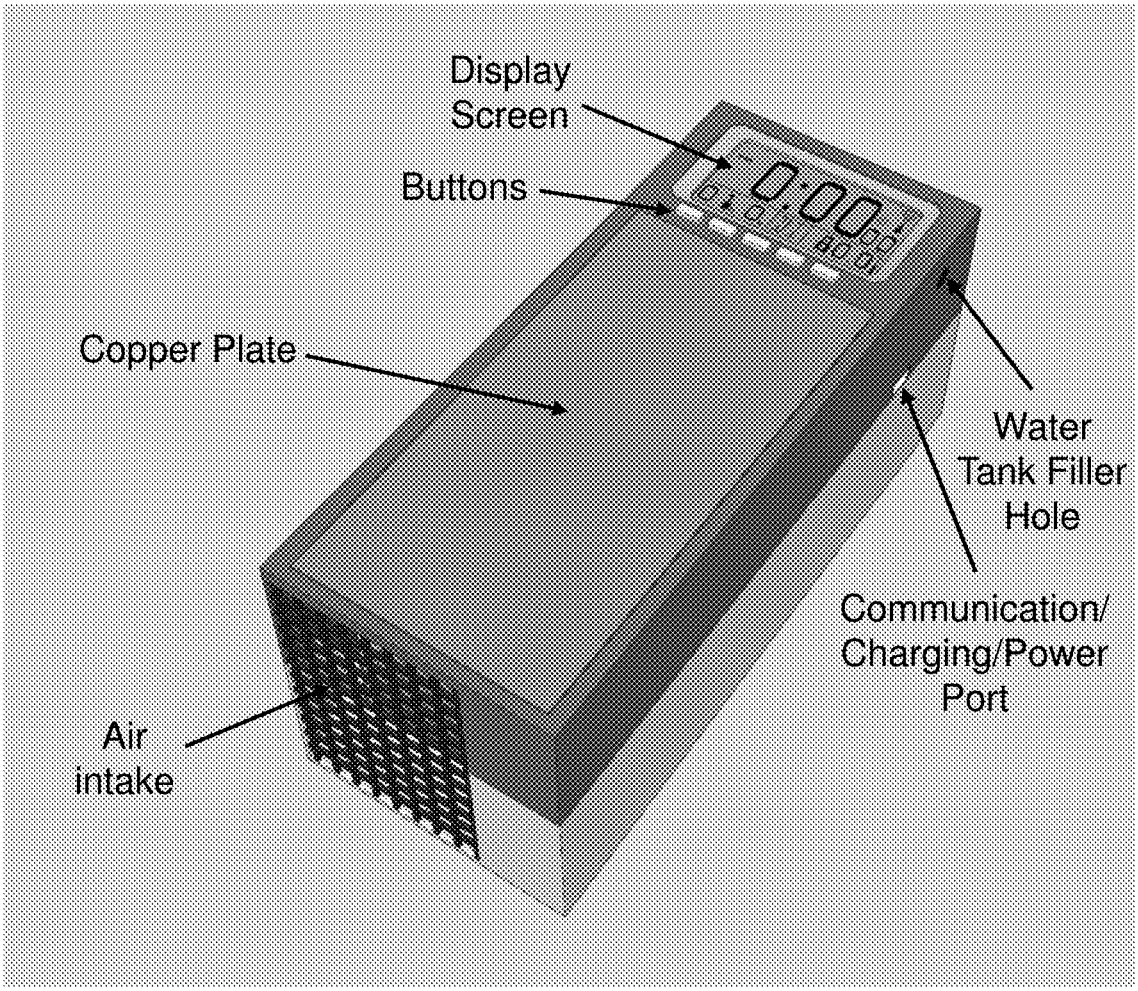
FIG. 5 depicts an exemplary implementation of an environmental control unit (ECU) that may be used to implement aspects of certain embodiments of the present invention.

The exemplary implementation (ECU), FIG. 5, may substantially set apart or isolate the internal environment of the payload chamber from the external environment. The ECU may also present a user interface that may communicate information regarding the conditions within the payload chamber and also present a manner which a consumer may control the status and/or conditions within the payload chamber. The ECU may respond to and warn of unintentional conditions, such as droppage, breakage, tampering, non-level position, excessive vibration or shock etc. by generating an audible and/or visual signal, either on the unit or a wireless alarm sent to an offsite monitoring solution, as well as by closing the water tank lid and ceasing further treatment of the payload chamber environment.

The ECU may be designed to not impact the exterior features of the enclosure such that enclosures may be efficiently stacked upon each other to maximize space utilization.

In addition to isolating the external environment from the payload chamber environment, the ECU is responsible for controlling one or more aspects of the internal environment (e.g. temperature, humidity, light illumination, pressure, etc.). The following subsections will discuss the main components of the ECU.

The ECU may be designed to maximize power efficiency to extend battery life and/or time between charging of the batteries. The ECU may generate a signal to indicate to a user that battery or charge level has decreased to the point requiring change of batteries or recharging.

2.1.2.1 Power Sources

Figure 6:
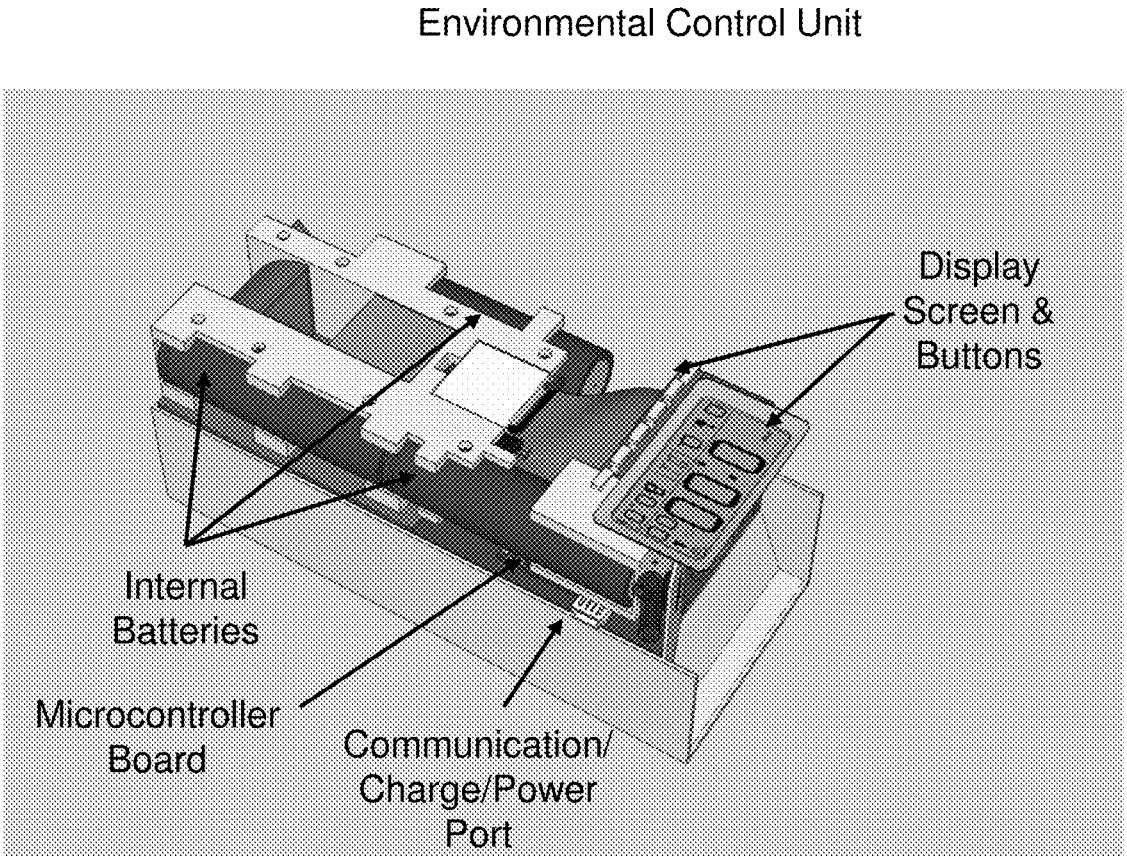
FIG. 6 is an exemplary diagram of battery location within an ECU that may be used to implement aspects of certain embodiments of the present invention.

The ECU may be powered, see FIG. 6, from internal batteries, either rechargeable or primary replaceable, and/or from external power. External power may be brought in via a connector port (power port) as shown in FIG. 6 or other types of DC power connectors. The external power input may offload the internal batteries, as well as recharge them if they are rechargeable, all without impacting the unit's operation. The batteries may be user or factory replaceable and as such, user access may be provided. There may be no batteries installed, a single battery installed, or multiple batteries installed within the controlled environment system.

Figure 7:
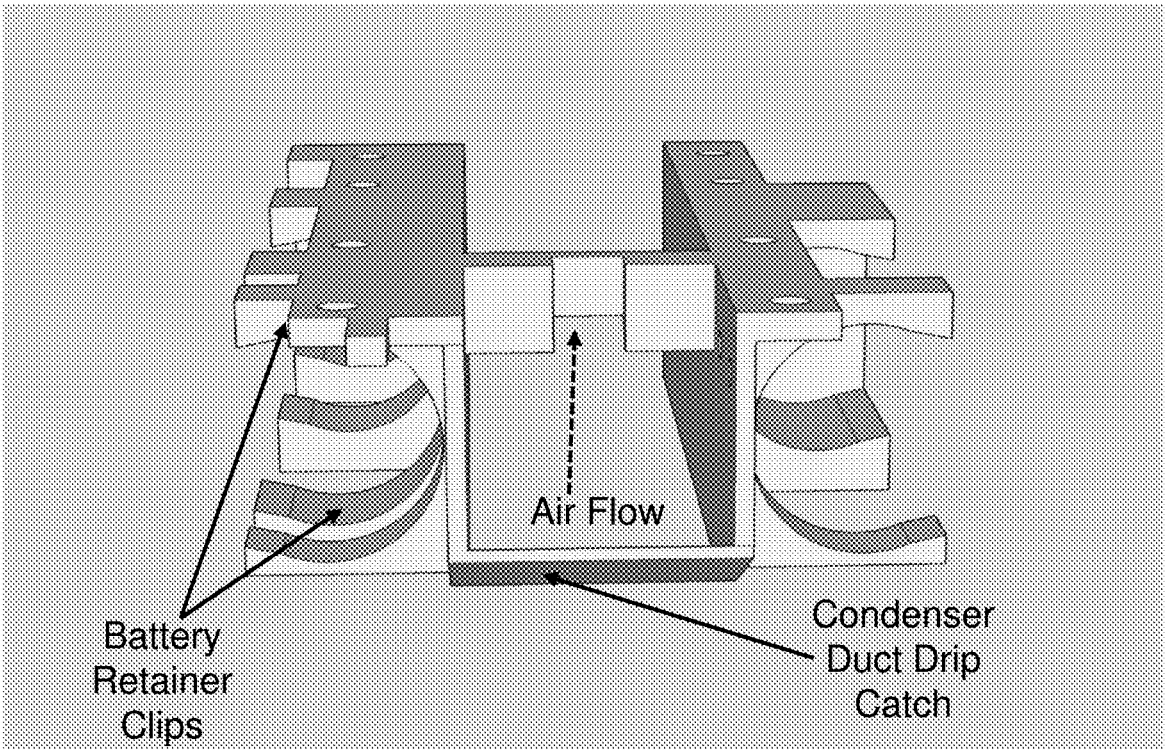
FIG. 7 is an exemplary diagram of the battery retainer assembly within an ECU that may be used to implement aspects of certain embodiments of the present invention.

FIG. 7 shows the battery retainer assembly which secures the batteries in their positions. The assembly may double as part of the air ducting assembly that guides air through the condenser and warmer sections of the ECU.

2.1.2.1.1 Power Management Unit (PMU)

The Power Management Unit (PMU) may be a part of the microcontroller board or the microcontroller, or on a separate board within the Controlled Environment System. The PMU may receive energy from the internal batteries as well as the power connector and selects which power source to use for the ECU. The PMU may be responsive to control from the microcontroller and is also responsible for generating and distributing voltages and current to control the electronics within the ECU.

The PMU may also be responsible for charging any rechargeable batteries and prioritizing which power source to use as well as generating notifications and alarms when energy levels fall below user set thresholds. The PMU may make the current energy state available to the microcontroller for statistics, reporting, and alarm purposes.

2.1.2.2 Microcontroller Board

A generic microcontroller board, also shown in FIG. 6, is utilized for executing the firmware for managing the ECU's operations, controlling charging via the PMU, monitoring sensors, generating alarms, communications with external devices, and providing a user interface among other tasks. The microcontroller board may be similar to the ESP32 from Espressif Systems. The microcontroller board may be comprised of more than one board within the Controlled Environment System.

The microcontroller board contains various hardware and software components, such as, flash, RAM, switches, a microcontroller, wired and wireless interfaces and associated ICs, power devices and other standard devices that may be found on such a board. The microcontroller board may also contain motion and gravity sensors such as gyros, accelerometers, etc. to detect and respond to motion of the Controlled Environment System. Given the presence of wireless communication components on the microcontroller board, antennas may be included on the board or interface to the board.

2.1.2.3 Physical User Interface

As can be seen in FIG. 5 and FIG. 6, the ECU onboard user interface mechanism consists of a display screen (either touch sensitive or not), buttons, and a communication/charge/power port. The LCD display may be capable of displaying multiple different settings and monitored parameters, alarms, and status and may be touch sensitive or not. The LCD display, instead of being an attached part of the ECU may also be a remote display that may be connected to the unit either wirelessly or wired and placed on the outside of the enclosure.

FIG. 5 and FIG. 6 also depict multiple buttons. The ECU may contain more or fewer buttons than are depicted and they may be positioned anywhere on the ECU. The user may input commands and data into the unit by using the buttons or a combination of them and the LCD to program various payload and alarm parameters. The LCD may contain a touch interface that allows information and commands to be input into the touch interface. Any of these mentioned interfaces may be used to request feedback or provide instructions to generate a history of the environment as well as generate data such as past alarm data.

The user may program the unit remotely as well as locally. Locally may be performed by using the LCD and/or the buttons. Remote programming may be accomplished by connecting an electronic device to the unit either through a wired interface via the communication port or through a wireless interface. The wired and wireless interfaces may also be used for downloading applications, control information, and data, uploading of software or data, and performing firmware updates.

The ECU may implement one or more wireless interfaces, such as a WiFi interface or other wireless interface (e.g.

Blutooth, Zigbee, BLE, cellular, etc.) so as to be able to interface to user devices such as computers and cell phones as well as databases that may be stored in the Cloud.

The ECU interface may incorporate biometric security for locking and unlocking configuration access, in addition to an LCD or button type interface where a key sequence is entered. The biometric interface may include a fingerprint reader, eye scanner, facial recognition, or other type of biometric. It may also use a combination of any of the biometric interfaces or the LCD or button interfaces.

A biometric security interface may also be used to obtain access to the Controlled Environment System's data or to be able to control it.

2.1.2.4 ECU to Payload Chamber Interface

The ECU may be simply placed within or coupled to the payload chamber. Coupling may include, but is not limited to, screws, glue, double-sided tape, Velcro, magnetic connection, etc. It may also be attached by any number of other attachment mechanisms which may be used for coupling, such as clipping it on, locking it on, snapping it on, etc.

In some applications the ECU may be attached to the payload chamber at the factory and not allowed to be separated in the field by the user.

The coupler may be made from any type of materials such as wood, metal, ceramic, magnetic, Velcro, etc. The coupler may also have custom logos added to it by painting, embossing or by any other attachment process. The coupler may even be manufactured with the logo or some combination of materials.

Not shown are various containers that may hold the payload that are constructed to be different form factors, such as, a circular jar, or square box along with a lid that is circular or square. It is obvious to one skilled in the art that any form factor or material may be used as the container and the lid. In these other configurations, the ECU, which at least partially houses the electronics, may be positioned at a different location such as on the bottom of the payload chamber, the top, or on the side of or external to the payload chamber, either attached or not. There may even be multiple ECUs used within a single controlled environment system. Each of these can be programmed to function together as a single unit or function separately to control multiple environmental conditions such as temperature, humidity, pressure, etc. One ECU can be used to control temperature while another one may be used to control humidity, or each ECU can control both of these independently or in unison.

2.1.2.5 Airflow and Ducting

A fan may be used to pump air from the payload chamber through the ECU and back to the payload chamber. The fan may be single speed or variable speed and may be on all the time or used only when required. The fan may be designed to be low noise and may be managed by the microcontroller board so as to increase the overall power efficiency of the Controlled Environment System. Depending on the usage, multiple fans may be used instead of one as depicted.

Figure 8:
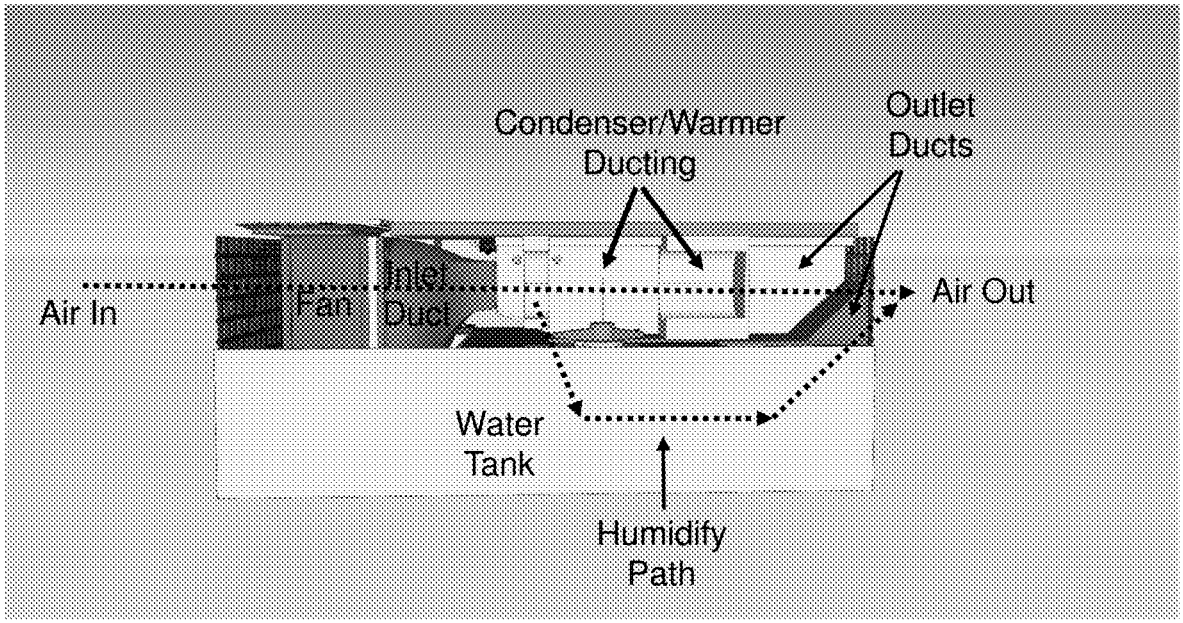
FIG. 8 is an exemplary cutaway side view of an ECU showing air ducting that may be used to implement aspects of certain embodiments of the present invention.

FIG. 8 shows a side view of the ECU that shows the main air paths through the ducting as dotted arrows. Air may be pulled into the ECU by the fan and through the inlet duct which may smoothly direct the air into the condenser. The air travels through the condenser duct past the cooling fins within the condenser which may cool the air down to the dew point. Moisture that may be collected drips into a water tank at the bottom of the condenser while the air may be directed to the warmer. The condenser/warmer ducting may be composed of a thermally resistive material to prevent cooling energy from dissipating through the walls of the duct into the ECU and payload chamber where it is not serving its purpose of causing condensation to occur. If coolness leaks into the surroundings, then the battery life may be impacted due to the wasted energy used to unnecessarily continue cooling to compensate for the leakage. In addition to being comprised of a thermally resistive material, the condenser duct may have various forms of insulation applied to it. Examples of insulation may be, but are not limited to, foam padding, foam spray, or other insulative coatings that may be sprayed on or adhered.

Air travels through the warmer duct section after exiting the condenser duct section and is then directed to the outlet duct to blow back into the payload chamber. As the air flows through the outlet duct, a UV-C LED, which may be attached within the cavity, may sterilize the air prior to flowing back into the payload chamber. Details on the condenser, warmer, Water Tank, and other components of the system will be provided in a later section.

Airflow through the ECU is intended to be as smooth and laminar as possible, reducing any turbulence and dead spots, so as to maximize the efficiency of air treatment and correspondingly, consumed power.

2.1.2.6 Condenser

The purpose of the condenser (shown in FIG. 9) is to condense moisture from the air, thus lowering the humidity within the payload chamber. The condenser may be active only when it is desired to reduce the humidity levels within the payload chamber. In Idle mode, air may blow past the condenser heat exchanger but the condenser is off such that no reduction in humidity may occur. The condenser consists of a specially shaped, finned heat exchanger attached to the cool side of a heat pump. The shape of the lower end of the heat exchanger collects the water into larger drops, reducing their surface tension and directing the condensed water droplets down to the base where they may drip down to the water tank opening. The heat pump may be a Peltier heat pump but is not limited to a Peltier device.

2.1.2.7 Warmer

Figure 9:
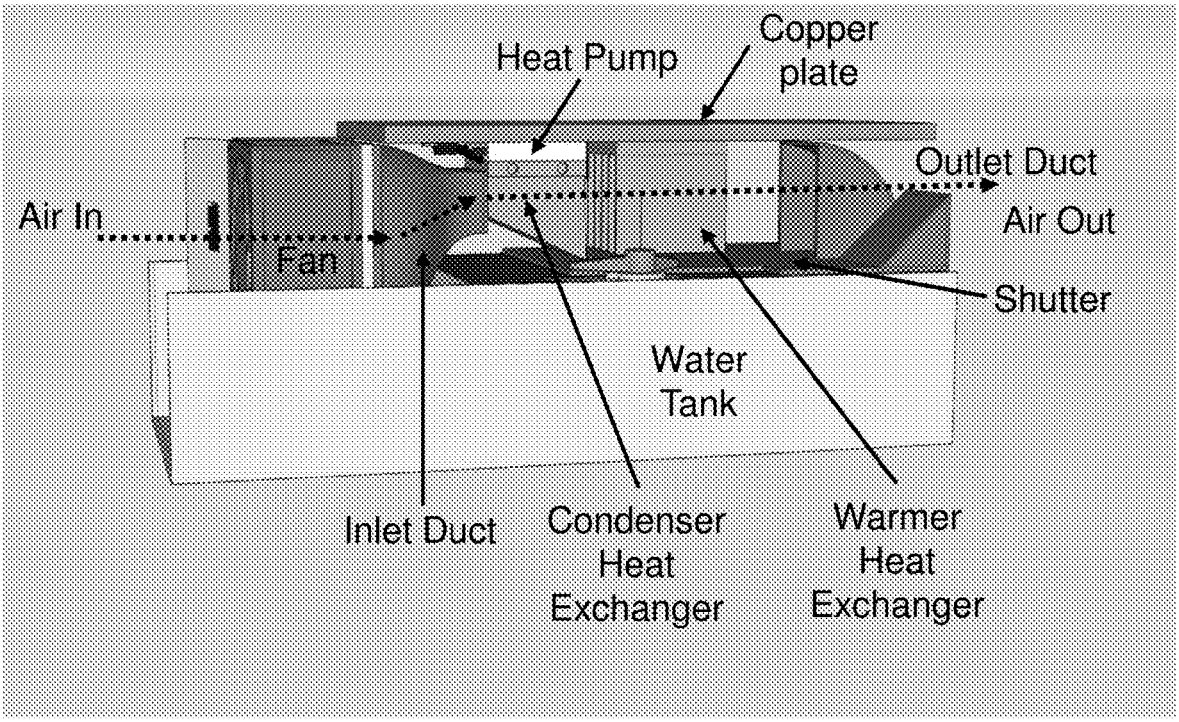
FIG. 9 is an exemplary exploded view of condenser and warmer areas that may be used to implement aspects of certain embodiments of the present invention.

On the opposite side of the condenser and heat pump, shown in FIG. 9, may be a thermally conductive plate serving as a heat spreader. The plate may be made from any low thermal resistance material, such as copper. The plate may take heat from the hot side of the heat pump and may dissipate some back into the payload chamber as well as transferring some to the warmer heat exchanger which it may be coupled to. The purpose of the warmer heat exchanger is to dissipate the heat generated by the condensation process by returning the heat to the air that was dehumidified. In order for the condenser to operate optimally, it is important to maintain the temperature differential across the heat pump to as low a value as needed to ensure proper system operation. By running air across both sides (via coupling) of the heat pump, warming assists in the process of maintaining a low temperature differential.

2.1.2.8 Heat Pump

The heat pump may be a thermoelectric device such as a Peltier heat pump. A Peltier heat pump is a solid-state active heat pump which transfers heat from one side of the device to the other, with consumption of electrical energy, depending on the direction of the current. It uses the Peltier effect to create a heat flux between the junction of two different types of materials.

Figure 10:
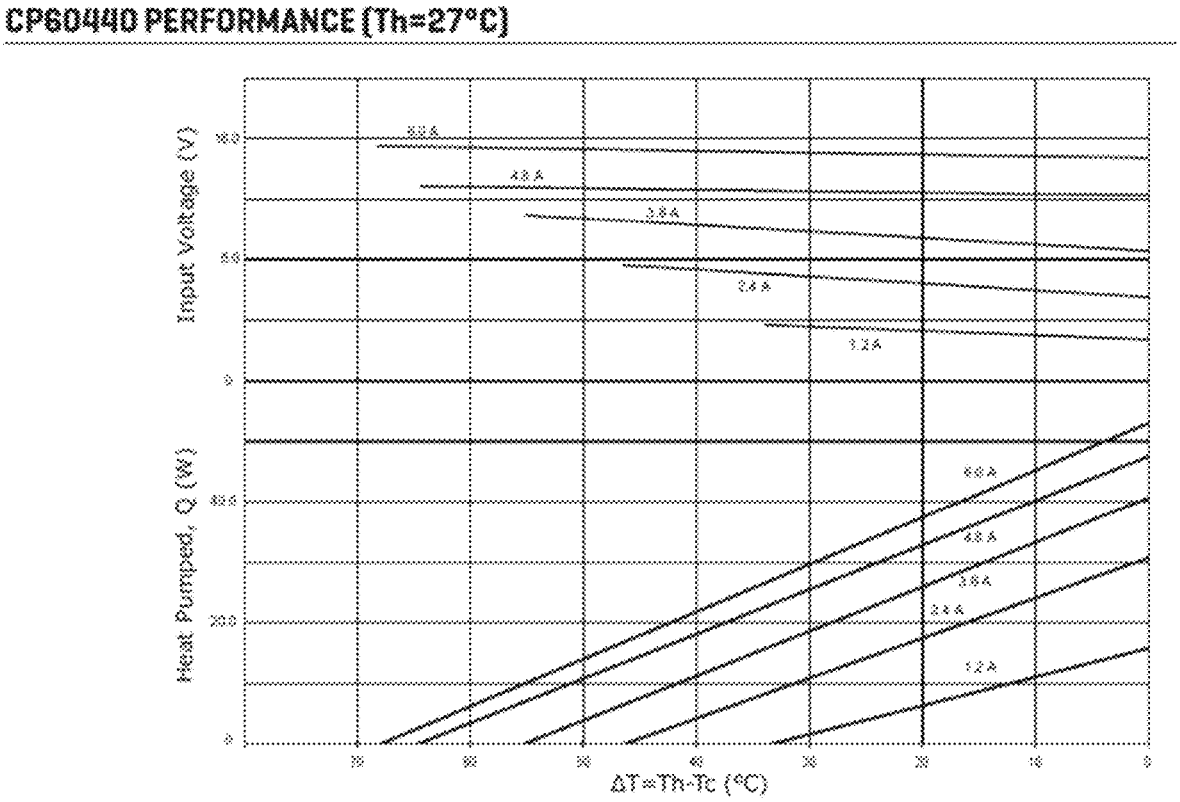
FIG. 10 is an exemplary graph of dT_C vs. HeatPump_W that may be used to implement aspects of certain embodiments of the present invention.

An example heat pump that may be used is the CP60440 from CUI, Inc. The performance for the CP60440 in terms of dT_C (temperature difference between first-side and second-side of a Peltier module) vs. HeatPump_W (Q_W is the amount of heat energy pumped from first-side to second-side of a Peltier module), and DT_C vs. Input Voltage is shown in FIG. 10.

These graphs sufficiently characterize the Peltier modules to determine the heat pumping performance of the heat pump when operating conditions are given.

The following two examples show heat pumping performance is better when dT_C is smaller.

Pin_W=~57.6, dT_C=10, Q_W=40

Pin_W=~57.6, dT_C=15, Q_W=36

When Pin_W (wattage consumed by Peltier based on input voltage and current) is held constant, for example at ~57 W, an increase of 5 C in temperature differential results in a heat transfer flow of 4 W less being pumped by the heat pump. Another way to think about it is at dT_C=10, the amount of input power applied to the heat pump yields better pumping action and may thus save more energy, since for a given amount of desired heat transfer, the pump may be run for a shorter time period and hence less energy would be required. It therefore, may be advantageous to create a configuration where the dT_C is kept as small as practical.

Figure 11:
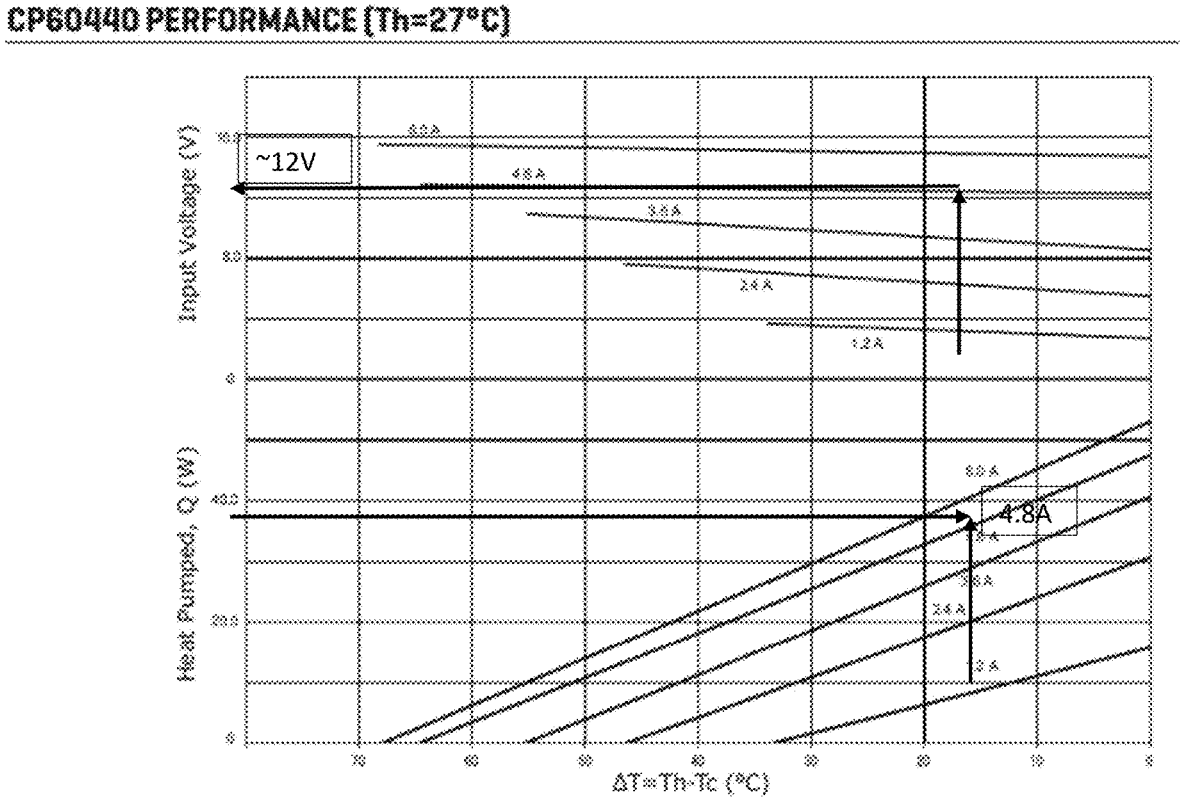
FIG. 11 is an exemplary graph for dT_C=15, W=36 that may be used to implement aspects of certain embodiments of the present invention.

FIG. 11 provides an example of how to use the table/graph provided by a manufacturer. The following steps are followed:

1. Determine Current_A when operating conditions are dT_C=15 and Q_W=36.
   a. Current_A=4.8 A (shown in lower half of graph in green)
2. Determine InputVoltage_V when operating conditions are dT_C=15 and Current_A=4.8 A.
   a. InputVoltage_V=~12V (shown in upper half off graph in orange)
3. Calculate InputPower_W as InputVoltage_V*InputCurrent_A
   a. InputPower_W=~57.6 W
4. Calculate Efficiency_% as HeatPumpedQ_W÷InputPower_W
   a. Efficiency_%=~63%

Following the same approach, one can see that at a dT_C of 10, the Efficiency_% would be ~69%.

2.1.2.9 Sensors

Figure 12:
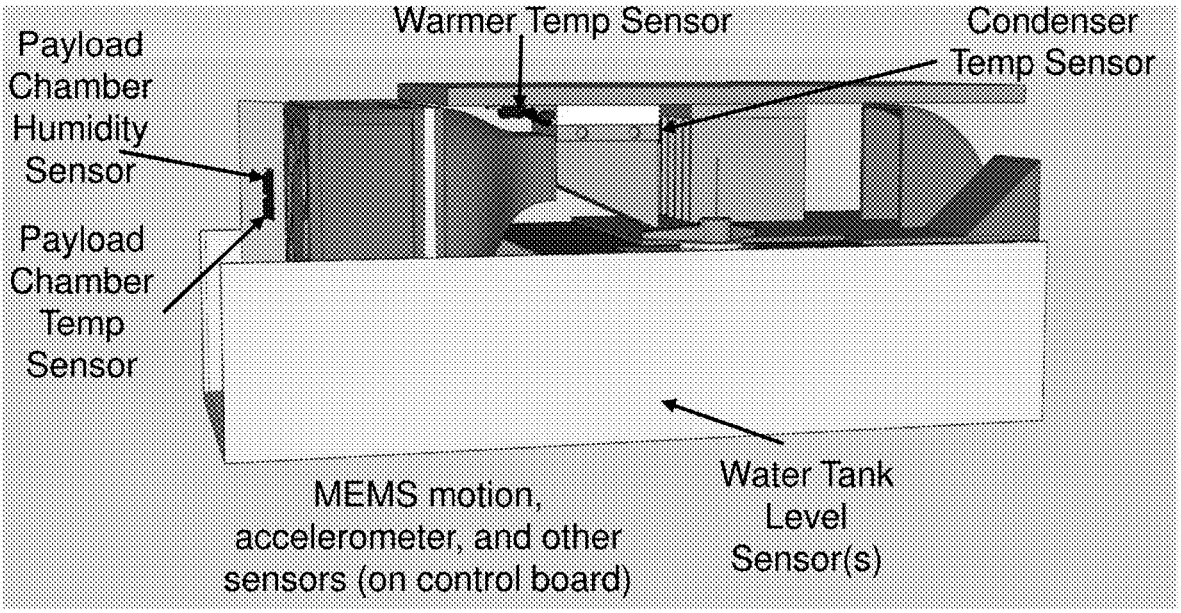
FIG. 12 is an exemplary diagram of ECU sensors that may be used to implement aspects of certain embodiments of the present invention.

Sensors are placed at various locations within the ECU to provide information to the various control loops such that environmental conditions may be set, adjusted, and monitored. The air path within the ECU, shown in FIG. 8 and FIG. 9, has sensors (shown in FIG. 12) to monitor the initial payload chamber conditions as well as to control and monitor the ECU's operation.

Sensors located at the fan inlet measure the payload chamber's current temperature and humidity. Using these sensors, the current conditions can be ascertained as well as the impact of treating the environment with the ECU. At the condenser, a temperature sensor may be mounted on the condenser heat exchanger fins to evaluate the temperature set by the heat pump so as to properly set the dew point temperature. The heat spreader also may have a temperature sensor mounted to it near to the heat pump. The sensor allows the coefficient of performance of the heat pump to be properly controlled and monitored.

The water tank may have one or more sensors within it to detect the level of the water so as to alert the user to too much or too little water within the tank as well as the fill level. Sensors may also be used to detect the state of the water with respect to water quality. Sensors may include, but are not limited to, magnetic floats and hall-effect sensors. The water tank may utilize other types of liquids other than water.

In addition to sensors for monitoring the air path and water level, the microcontroller board may have additional sensors for detecting controlled environment system movement and position, among other information.

Remote sensors, connected either wired or wirelessly to the ECU, may be placed into one or more locations within the payload chamber for more accurate readings of payload conditions when the enclosed space is large enough to warrant it or the density of the payload area is high enough. Placing remote sensors may allow the control loops in the main unit to get a better feedback on how moisture is spreading throughout the payload chamber by using the temperature and relative humidity data that the remote sensor modules may provide.

2.1.2.9.1 Remote Sensors

Figure 13:
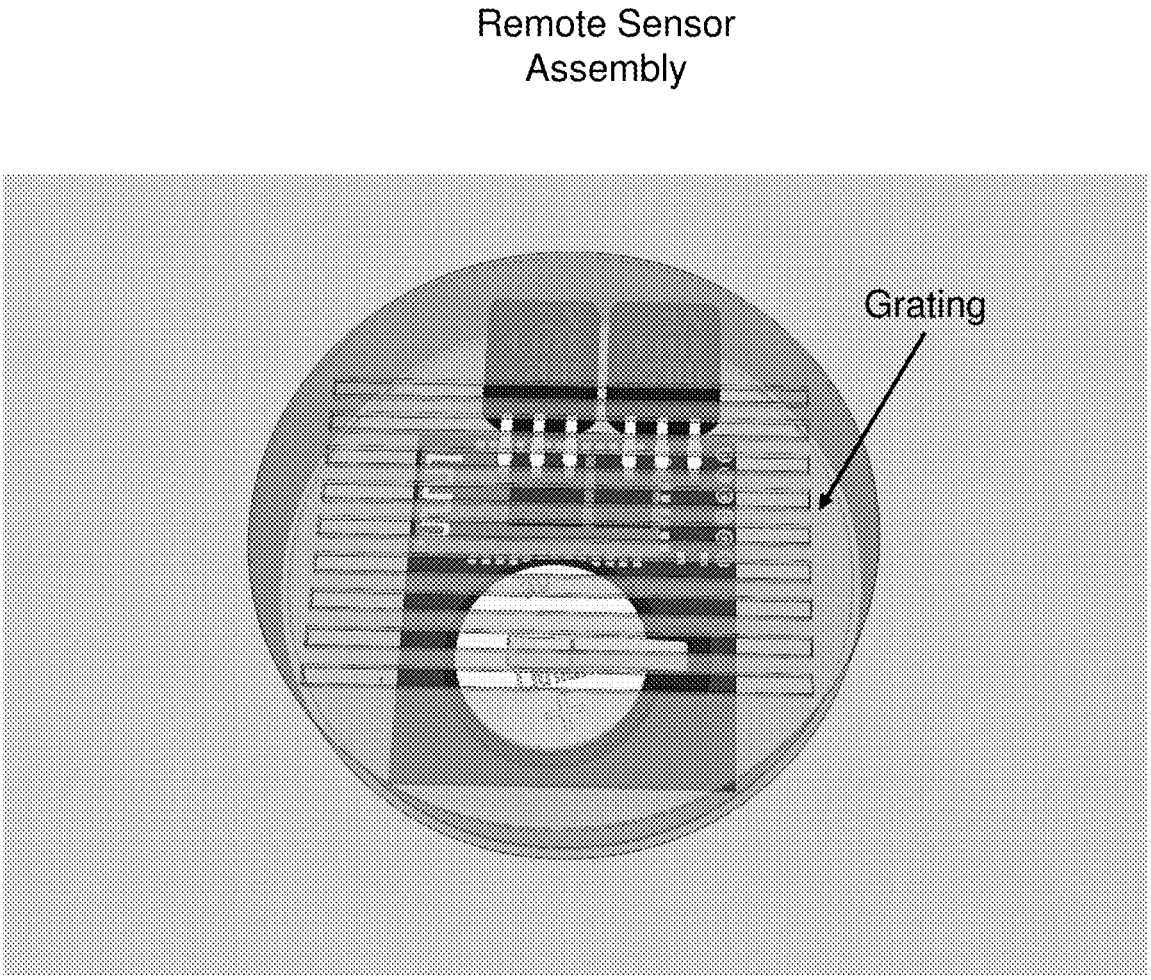
FIG. 13 is an exemplary diagram of a remote sensor assembly that may be used to implement aspects of certain embodiments of the present invention.

A remote sensor assembly is shown in FIG. 13. The remote sensor gathers humidity and temperature information and relays it, either wired or wirelessly, either directly or indirectly through other sensors, to an ECU. The grating cover on the sensor may prevent payload from entering the sensor and causing false readings.

Figure 14:
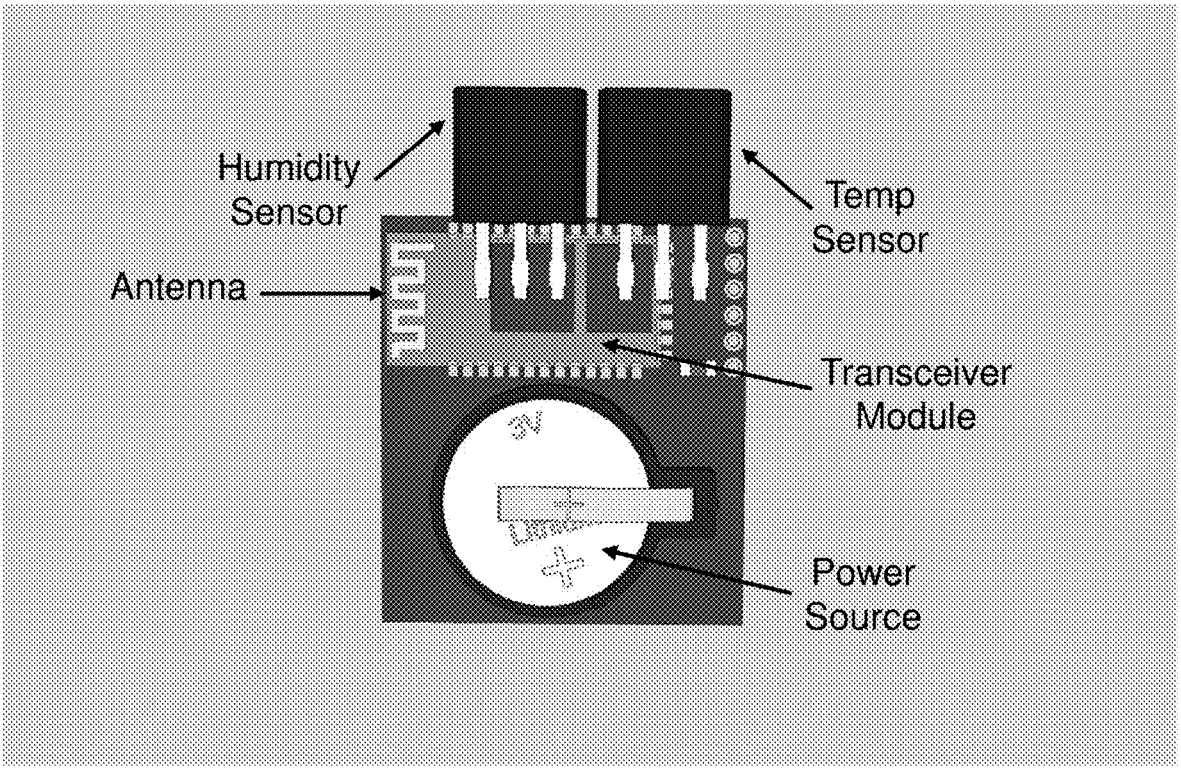
FIG. 14 is an exemplary diagram of a remote sensor circuit board that may be used to implement aspects of certain embodiments of the present invention.

FIG. 14 shows a view of the remote sensor circuit board and its components. The remote sensor is self-powered and may be powered by a coin cell type battery or other type of battery that is either primary or rechargeable. The battery may be user serviceable. The remote sensor may contain a humidity sensor and/or a temperature sensor similar to the ones found in the ECU. The sensors may connect to a small microcontroller located on the transceiver module which reads and sends the information to the ECU. Wireless protocols which may be supported include, but are not limited to, WiFi, Cellular, Bluetooth, BLE, Zigbee, etc. The remote sensor may communicate with the ECU based on user-configured, ECU-configured, or Cloud-configured intervals.

2.1.2.10 Water Tank

Figure 15:
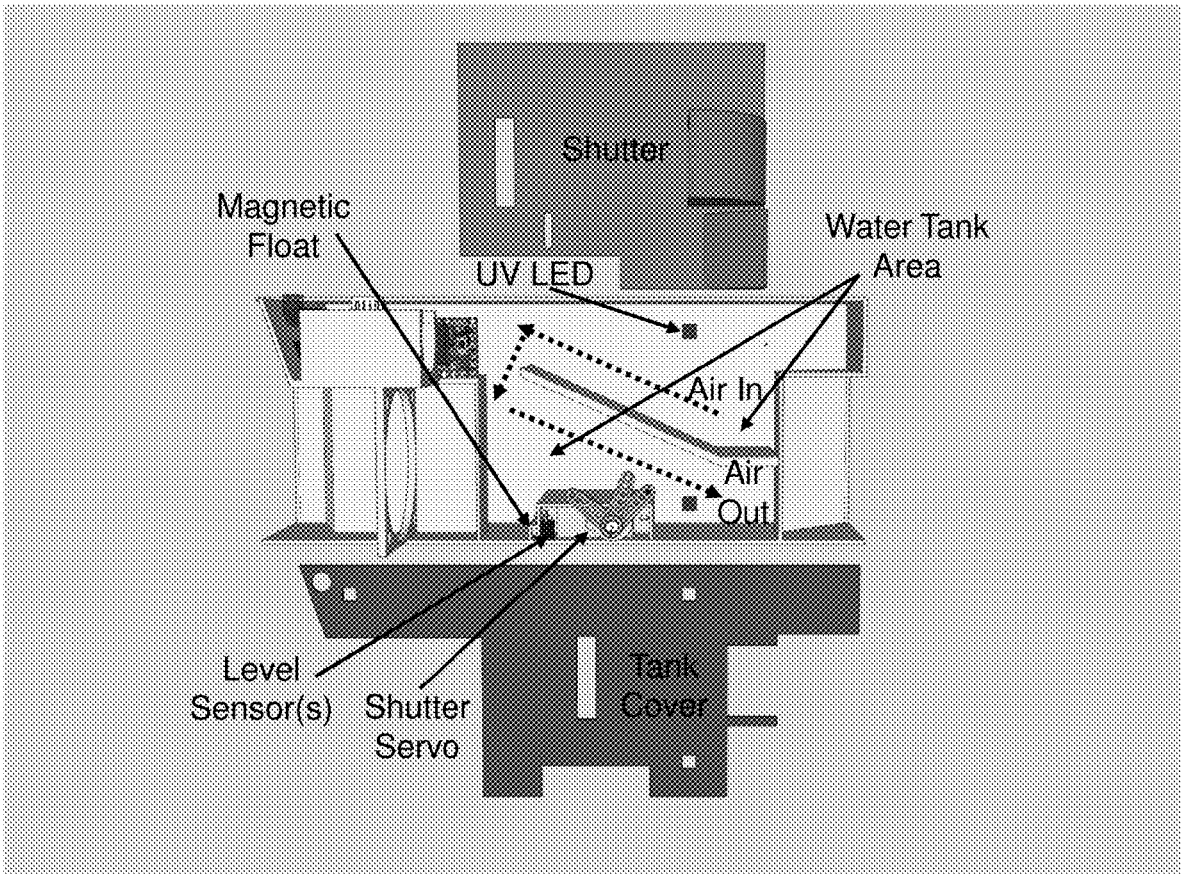
FIG. 15 is an exemplary diagram of an ECU with the condenser and warmer removed to expose the water tank that may be used to implement aspects of certain embodiments of the present invention.

At the base of the condenser and warmer may be a water tank, shown in FIG. 15 with the shutter and tank cover moved aside. The water tank collects humidity that is removed from the payload chamber and also contains water to convert to water vapor in the case that humidity needs to be increased. The water tank typically may contain enough water to last for approximately 30 days, depending on the application.

The water in the water tank may be purified to eliminate the potential for bacterial or other organic growths within the tank. This is accomplished by using one or more UV light (wavelength 265 to 285 nm) sources over the water tank, possibly embedded in the water tank lid. The light may be on continuously or cycle depending on the application. The UV light may also be located in other places (e.g. ducting), to treat the air as it passes instead of, or in addition, to the water. The water tank or other parts of the ECU may be made from one or more materials, including materials enhanced with antimicrobial additives. The water may contain antimicrobial additives to slow or stop the growth of bacterial or other organic growths.

As can be seen from FIG. 15, the water tank has dividers to create a maze-like pattern. The purpose of the pattern is to direct air, during the humidification cycle, over as much water surface area as possible prior to exiting back to the payload chamber. Air In, depicts where the air enters the water tank from the adjacent portion of the ECU and the air follows the path (i.e. maze) to the point depicted as Air Out where the air then exits and travels to the payload chamber. This is done so as to cause the air to absorb as much moisture as possible, thus reducing the energy required by minimizing fan runtime.

The water level in the tank may be monitored. The water level measurement may report continuous levels or may be limited to specific thresholds (e.g. to warn of being almost full or nearly empty, full, and empty). This may be done using a magnetic float and sensors. Other approaches may be used to accomplish the same task.

2.1.2.11 Actuators

In certain embodiments, the ECU contains an actuator as shown in FIG. 15. The actuator may be a servo or other electromotive device.

The servo may control a shutter that directs the flow of air through the ECU. The actuator may be controlled by the Control Board. In addition to its normal activity, the shutter servo may be quickly activated if the ECU detects that the chamber is about to tip over so as to prevent water spillage from the water tank. There may be other servos for other actions such as controlling a lid opening and closing, etc.

2.1.2.12 Air Grating

Figure 16:
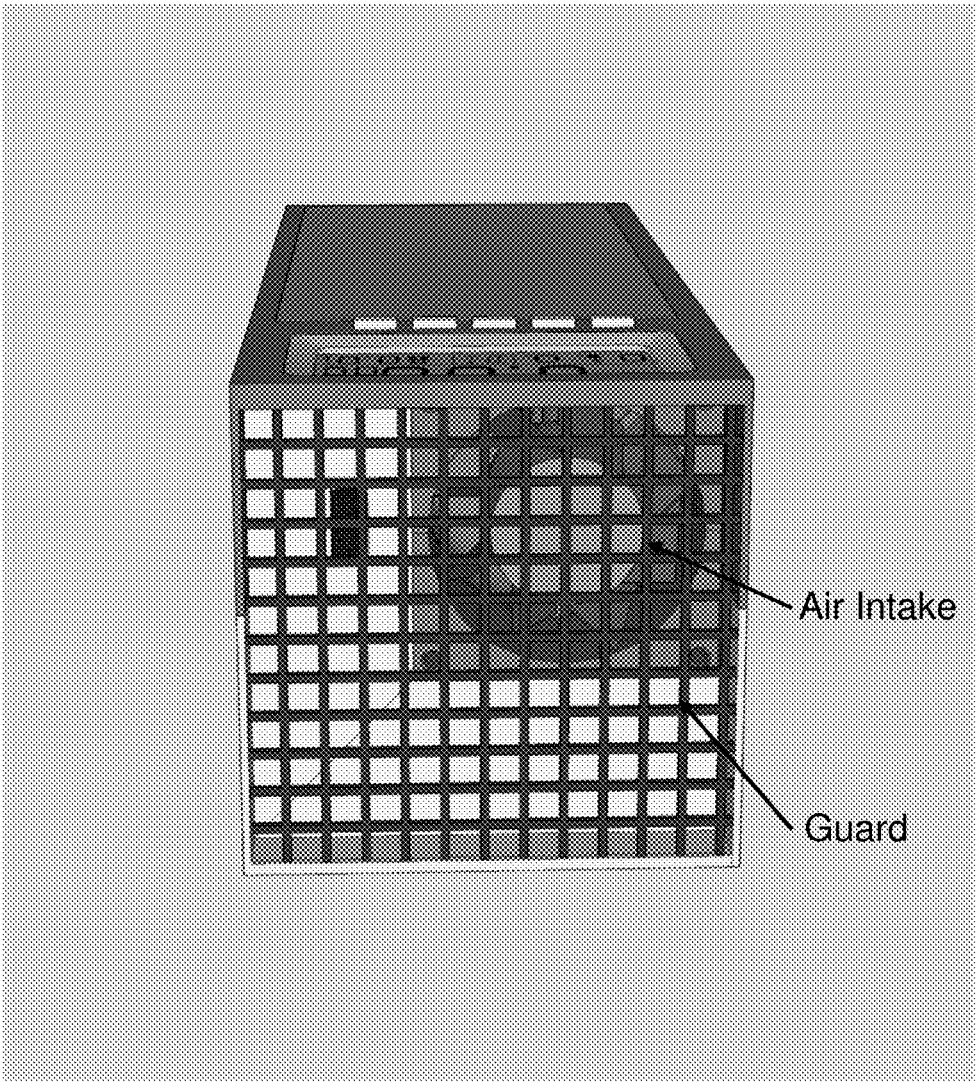
FIG. 16 is an exemplary diagram of the air grating/guard that may be used to implement aspects of certain embodiments of the present invention.

Mounted at the intake and exhaust sides of the exemplary implementation is an air grating or guard, FIG. 16, to prevent payload or payload particles from being drawn into the ECU, or getting lodged in the ECU if the unit falls on its side. It protects the fan, electronics and mechanical parts in the ECU from becoming fouled by any of the payloads. It may be a user-removable, vented guard on the sides of the assembly that may also prevent dirt and grime, such as sticky residue from cannabis buds, etc. from fouling the main assembly. The guard may be quickly removed for easy cleaning and reattached. The grating mesh may be spaced closely enough together to not allow payload entry yet far enough apart to prevent impacting the airflow.

In some applications there may be a removeable filter inserted between the guard and the ECU to protect the electronics from finer grain particles.

The guard may be made from any material that meets the requirements of the application.

The grating design used in the guard may be slanted, concave, vertical, or any other configuration desired. Many different designs are possible and would be obvious to those skilled in the art.

2.2 Alarms and Alerts

The ECU, and also Cloud, are capable of generating (e.g. screen indicator, alerts to remote devices, etc.) alarms and alerts based on detected conditions as well as predictions of future conditions. The alarm and alert mechanisms will inform the user about various scenarios including but not limited to the following examples:

a) The water tank is getting too full
b) The water tank is beginning to run dry
c) The water tank is full
d) The water tank is empty
e) The battery level is running low
f) The payload chamber has been tampered with
g) The payload chamber has been left open or is unsealed
h) The payload chamber has fallen over
i) Shock/vibration alarm
j) Upper or lower humidity limit alarms
k) Upper or lower temperature limit alarms
l) Current conditions are prime for mold formation and spread
m) Predictive alerts, such as, days before mold likely to form, time before payload is too dry, etc.

Some of these alarms may be dependent on a motion sensor, such as a gravitational sensor, a MEMS sensor, an accelerometer, or a combination of these or similar type sensors.

A chemical sensor may also be implemented to determine the presence of and/or amount of mold in the environment or the number of bacteria in the environment. An alarm may be dependent on this sensor as well as other sensors.

There may be an odor sensor (detector) on the outside of the Controlled Environment System. This may detect an odor that exceeds a predetermined threshold. If this occurs, an alarm may be generated for the user.

There may also be an odor sensor (detector) on the inside of the Controlled Environment System. This may detect an odor that exceeds a predetermined threshold. If this occurs an alarm may be generated for the user.

There may be a light sensor that measures the duration and/or intensity level of light that the payload is subject too.

At least one camera may be coupled to the Controlled Environment System. The camera may be remotely accessible for control and data download. Pictures or video may be taken of the inside of the payload chamber as well as the outside of the payload chamber. The video and pictures taken may be continually taken or may be performed when the user requests as well as when an alarm is generated or at a predetermined time period. This data may be fed into a database for analysis or may be routed to a user or a set of application users.

Spectral/chemical analysis of the payload and/or payload chamber environment may be performed. Spectroscopy is a powerful technique for recognizing and characterizing physical materials in various phases, including but not limited to, solid, liquid, gas, or plasma, and may be light emitting or light absorbing. Such analysis may be performed using Texas Instruments (TI) DLP Near-Infrared (NIR) technology. Near-Infrared (NIR) products may be optimized for 700 nm to 2500 nm wavelengths and may deliver high SNR. Spectral/chemical analysis may then enable the ECU to determine tetrahydrocannabinol (THC)/cannabichromene (CBC) levels within cannabis flowers and determine how best to control the environment to obtain the desired results.

3 Environmental Control Unit Functionality

In certain embodiments, the ECU may operate in many different modes, depending on the requirements of each particular implementation. Three of the possible modes may be Idle mode, Economy mode, and Turbo mode. Sub-modes of Economy and Turbo modes may be Humidify and Dehumidify.

In Idle mode, housekeeping functions may be performed by the ECU but the environment of the payload chamber may not be actively treated. In Economy mode, the environment of the payload chamber may be controlled but at a slower rate so as to conserve power. In Turbo mode, the environment of the payload chamber may be controlled in a manner so that the programmed environmental conditions may be attained more quickly.

3.1 Air Flow

In certain embodiments, in order for the ECU to be effective and efficient, as well as to have a low acoustic signature, the air flow through the ECU should be orderly, unidirectional and free of turbulence. Airflow through the condenser and the warmer fins may be laminar, experiencing few changes in direction and speed. Backflow, where airflows of differing speeds or differing temperatures may be unintentionally mixed, should be avoided. As can be seen in FIG. 8, the Inlet Duct captures air from the fan and smoothly redirects it into the condenser/warmer housing. The interior of the condenser housing smoothly directs the air through the fins of the condenser heat exchanger in a laminar manner. Thus, air flow through the condenser heat exchanger is preferably transversal and along the surface area of the fins with minimal air impedance (e.g., laminar), thereby experiencing few changes in direction and speed.

At the end of the condenser, the air may be smoothly directed into the warmer heat exchanger. The warmer then smoothly directs the air to the output and back into the payload chamber. In the case of humidification (with the shutter in the humidification position), air may be directed into the water tank, below the water tank cover, instead of into the condenser/warmer assembly. It then travels through the water tank and exits below the warmer ducting where it may be directed back to the payload chamber.

Preventing the mixing of air entering the ECU with air exiting the ECU is at least partially due to the physical relationship of the air inlet and air outlet on opposite sides of the ECU. As seen in FIG. 8, the ECU inlet and ECU outlet are extended to the edges of the product, maximizing the distance between the inlet and outlet.

3.1.1 Airflow Control

Figure 17:
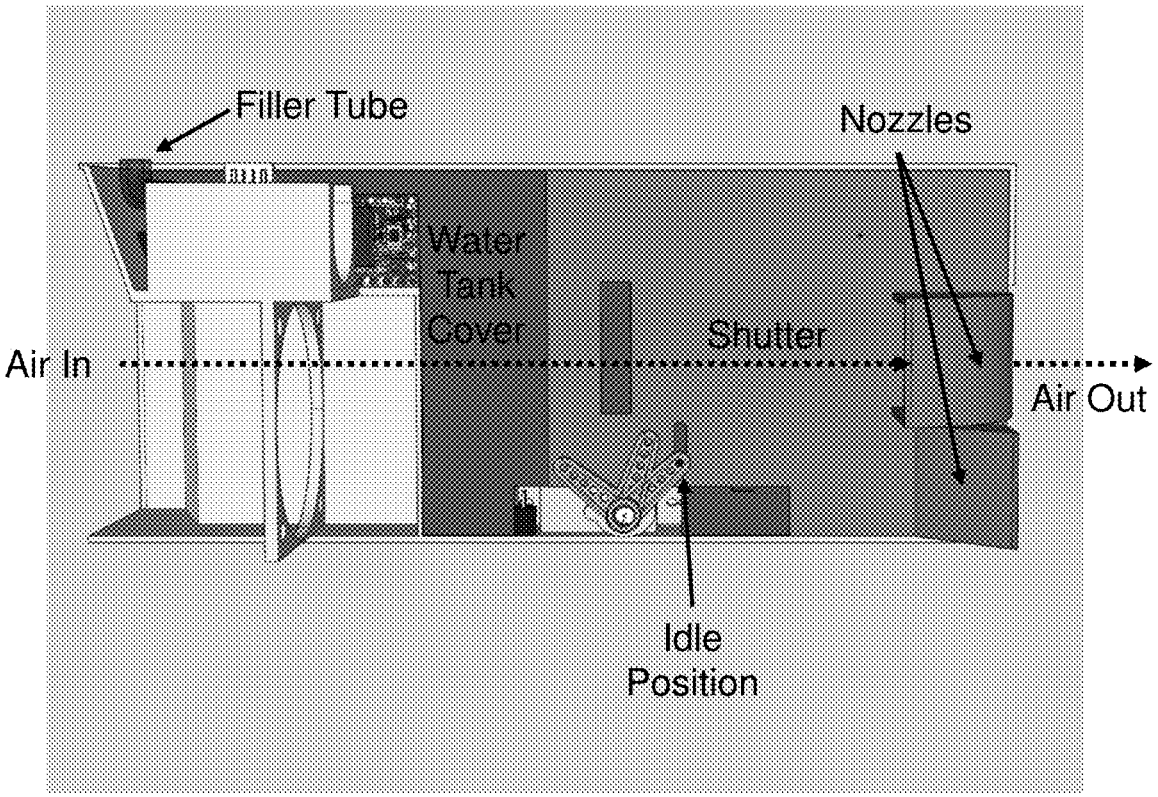
FIG. 17 is an exemplary diagram of a shutter in idle position that may be used to implement aspects of certain embodiments of the present invention.

In certain embodiments, the ECU contains a shutter (seen in FIG. 15 and elaborated further in FIG. 17), driven by a servo, that may ride on the water tank cover. Between the shutter and the water tank openings is a seal, such as, rubber, cork, or other type of gasket, that prevents water from leaking out if the ECU tips over, and moisture from expanding out. The shutter redirects airflow depending on the activity being performed. In Idle mode, as can be seen in FIG. 17, the shutter is in the far-right position (Idle position) and the water tank is sealed off. If the controlled environment system, according to aspects of the present invention, were to fall over, water may not escape the tank. The air nozzles in Idle mode may not be in alignment or only in partial alignment with the condenser air outlet. In Idle mode, air may be circulated, but neither humidification nor dehumidification may occur. The filler tube may be pinched off, capped, or have a check valve or other type of mechanism to prevent odors, water, or humidified air from escaping. In the case of the batteries nearing depletion, the ECU may automatically go to Idle mode, or be programmed to place the Controlled Environment System in another state and generate a battery depleted and/or nearing depletion warning (alarm).

Figure 18:
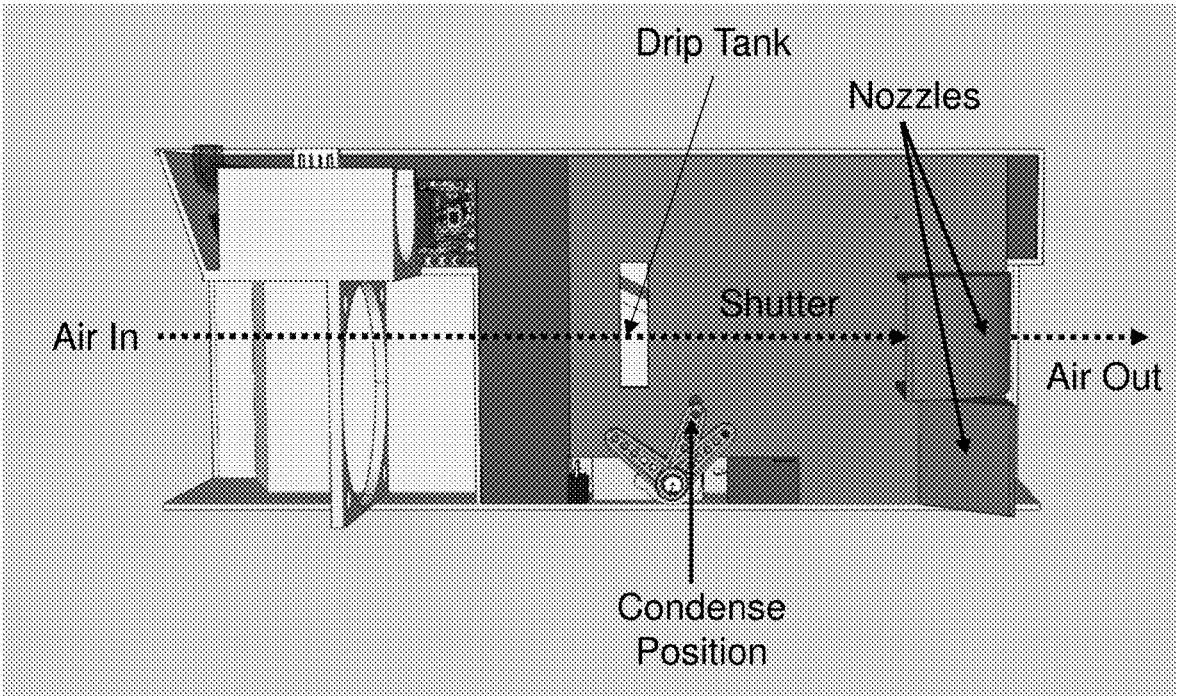
FIG. 18 is an exemplary diagram of a shutter in a dehumidify/condensation position that may be used to implement aspects of certain embodiments of the present invention.

FIG. 18 shows the shutter when the ECU is in the dehumidification mode. The shutter may be in its middle position (condense position) where the Drip Tank is exposed (the drip tank may be a small section of the main water tank or just a small opening into the water tank), the center nozzle may also be lined up to transfer the dehumidified air from the warmer to the payload chamber.

Figure 19:
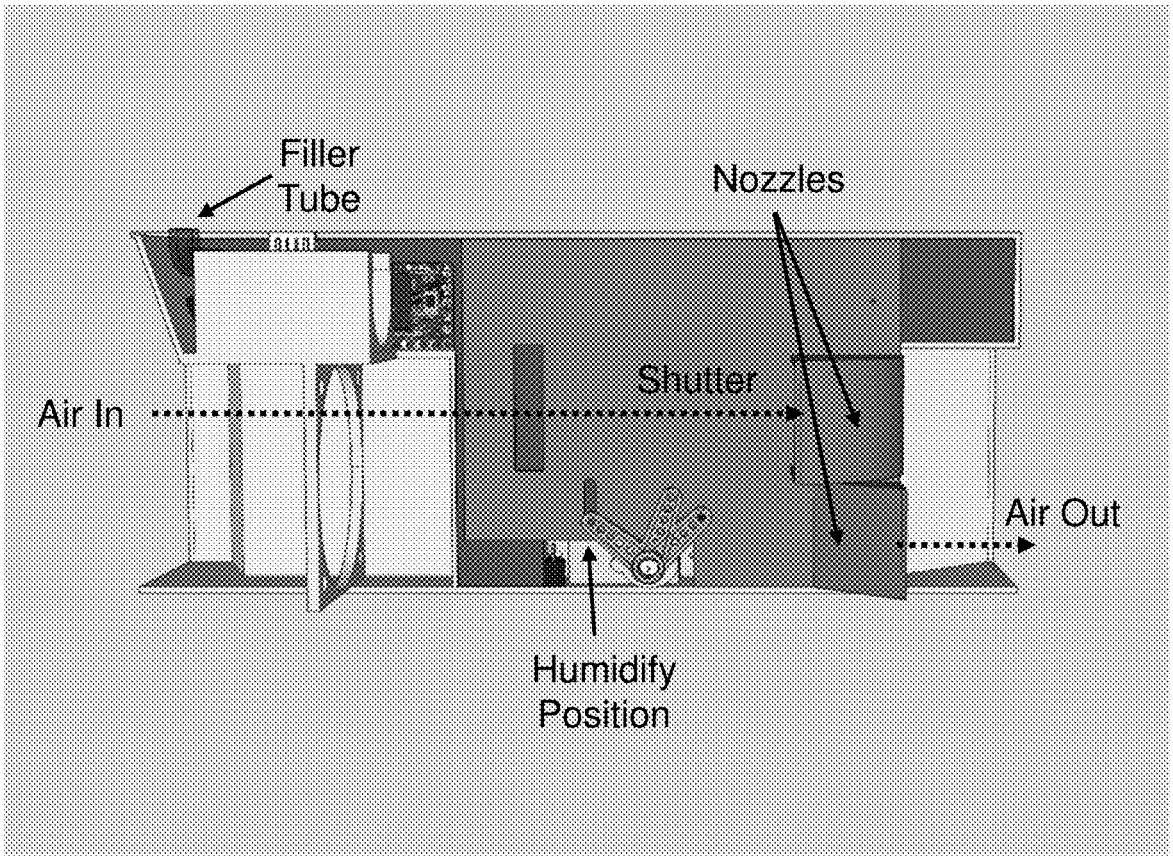
FIG. 19 is an exemplary diagram of a shutter in a humidification position that may be used to implement aspects of certain embodiments of the present invention.

FIG. 19 shows the shutter in the humidification position. The shutter is in the far-left position (humidify position). In this position, the center nozzle directs air into one end of the tank where it circulates through the tank to the other end where the corner nozzle then sends the humidified air to the payload chamber. The air takes a maze-like route through the water tank so as to collect as much water vapor as possible, FIG. 15 and FIG. 20.

Table 1 shows the settings for each of the ECU modes:

TABLE 1

ECU Operating Mode Table

| Unit Mode | Drip Tank | Main Tank | Left Nozzle | Right Nozzle | Fan | condenser | warmer |
|---|---|---|---|---|---|---|---|
| IDLE | Closed | Closed | Discon. | Discon. | Off | Off | Off |
| Dehumidify | Open | Closed | Discon. | Conn. | On | On | On |
| Humidify | Closed | Open | Conn. | Discon. | On or Off | Off | Off |

3.1.2 Fan Design

Figure 21:
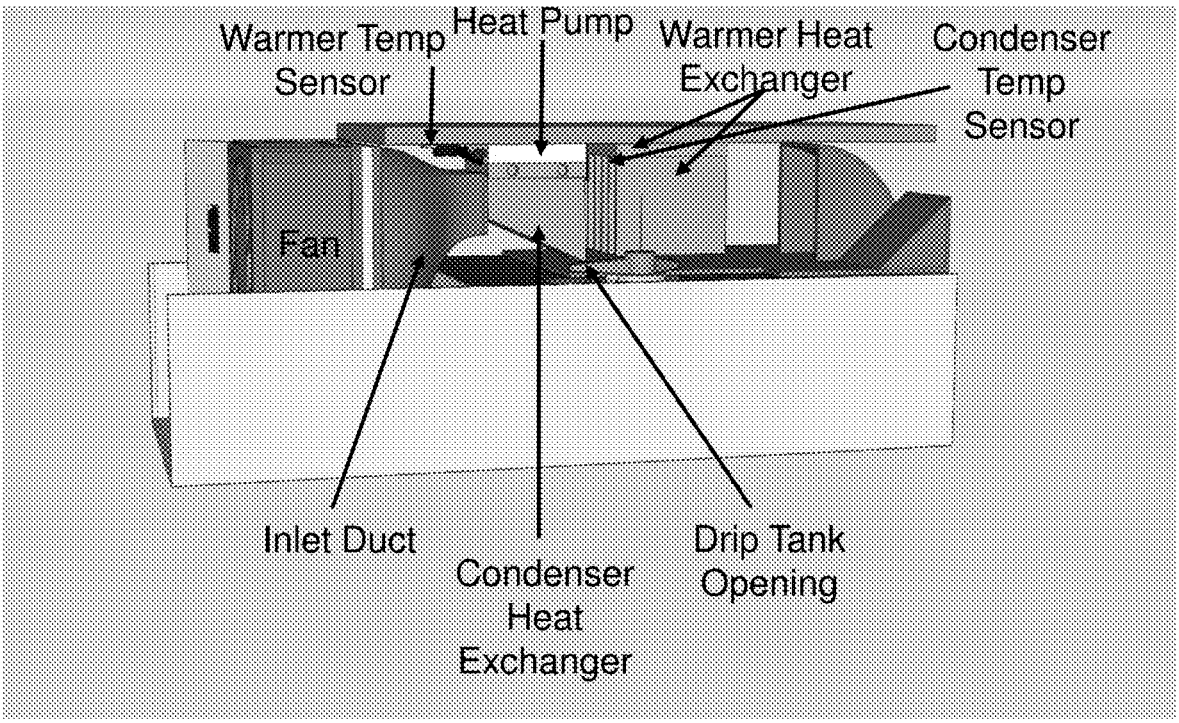
FIG. 21 is an exemplary diagram of condenser/warmer details that may be used to implement aspects of certain embodiments of the present invention.

Establishing laminar airflow begins with the use of a transversally mounted fan located at the entrance of the Inlet Duct, FIG. 21. With this relationship, the axis of rotation of the fan's propeller is situated to push air through the inlet duct which smoothly directs the air across the condenser fins, rather than into the base of the heat exchanger. The transversally mounted fan produces airflows substantially along the fins of the heat exchanger. The fins in combination with a covering over any unneeded openings of the fins act as ducts, ensuring air flow through the condenser fins to be at least partially laminar. Ducting extends from the condenser to the warmer and maintains the laminar airflow across the warmer heat exchanger ensuring laminar airflow throughout the ECU.

Another relevant factor is that the acoustic signature of a fan increases dis-proportionally with the rotational rate of the propeller. To reduce the acoustic signature of the fan, the rotational rate of the propeller within the fan, may be substantially reduced. To maintain the fan's airflow, the angle-of-attack of the propeller blade's airfoil is normally increased. But as angle-of-attack increases, the airfoil becomes inefficient. A low noise design maintains airflow, airfoil efficiency, and utilizes low rates of propeller rotation.

As the fan's thickness may not be constraining, maintaining airflow and airfoil efficiency may be accomplished by substituting increasing the airfoil's angle-of-attack with increasing the airfoil's chord-length.

3.1.3 Fan Control

The fan is controlled by the control board firmware and may be run at one speed, different speeds, or as a variable speed fan. The ECU Control Algorithm determines the velocity of airflow required through the ECU based on several factors, such as mode (Economy or Turbo), whether humidity needs to be added to or removed from the payload chamber, the amount of humidity to be added or removed, whether the temperature needs to be changed, whether air is being circulated just for monitoring, and to minimize the DC power consumption.

The rotational rate of the propeller within the fan, is set to produce only as much air flow as necessary to accomplish the required tasks. Determining the optimal amount of air flow may be accomplished by measuring the temperature differential between the condenser temperature and the warmer temperature. The measurements are provided to the control board which may be running a feed-back control loop that optimally sets the rotational rate of the fan by adjusting its supply voltage.

3.2 Temperature Control

Not all scenarios require the use of payload chamber temperature control. In the case of needing to modify temperature, the heat pump may be used to increase or decrease temperature. The temperature between the ambient air and the condenser fins can be kept above the dew point to cool the air without decreasing humidity. In the same manner, the control of the heat pump may be reversed so as to warm the air on the condenser side instead of cooling it. In addition to the previously mentioned approach, additional heat pumps may be added to regulate temperature.

3.3 Idle State

If the environment is at the desired state, no adjustments necessary, then the unit may enter the Idle state. The Idle state may be when the water tank is sealed and the heat pump is off. This will cause the environment's humidity level to stay relatively the same unless conditions change, such as outside influencers of the environment or the payload absorbed or released moisture.

If an event that may impact functionality occurs, then the unit may enter the Idle state; for example, if the unit tips over, the unit is tampered with, the tank is about to overflow or run dry, etc.

3.4 Humidity Control

The Controlled Environment System's main tasks are to monitor as well as control the level of the humidity within the payload chamber. The tasks are performed as efficiently as possible to meet the conditions set by the user. The user may select to operate in one of at least two different modes: Turbo and Economy.

a. In Turbo Mode:
   a) Humidify State: The fan may be used create airflow over the water. This may speed up the humidification process but may also consume more power.
   b) Dehumidify State: The cold side heat exchanger (condenser) may be held well below the dew point to maximize the condensing of water. This may speed up the dehumidification process but will also consume more power.

b. In Economy Mode:
   a) Humidify State: The fan may be off, and humidification occurs through passive evaporation. This may slow the humidification process but may consume less power.
   b) Dehumidify State: The cold side heat exchanger (condenser) may be held just below the dew point to maximize the Peltier coefficient of performance. This may slow down the dehumidification process (evaporation) but may also consume less power.

3.4.1 Humidification

The water tank, as shown in previous figures (e.g. FIG. 19) may have a fill hole and tube which is used to add water to the water tank. The tube may be exposed when the ECU is outside of the payload chamber or may be exposed through the top lid or may be exposed through any surface of the ECU and controlled environment system. The tube allows for water to be added but may not allow for water, moisture, and odors to escape. At times, it may be necessary to add liquid (e.g. water) to the ECU dependent on the type of payload being stored and its rate of absorption. The amount of liquid needed to control the humidity for a given volume of atmosphere while maintaining low growth of microorganisms may be small. For example, where the liquid is water and the environment comprises approximately 800 liters of air at 15° C., increasing the relative humidity from 85% to 95% may require evaporating approximately 1 mL of water.

However, conventional humidity control systems implement a coarse methodology to change humidity levels by boiling all liquid contained in a reservoir to make any change in humidity level (large or small). These systems fail to modify the amount of liquid boiled based on the desired change in humidity, thus are inefficient and wasteful.

Water in an enclosed chamber (whether it be the water tank when the shutter is closed or the payload chamber when the shutter is in the humidification position) tends to evaporate and saturate its environment. The process of evaporation in a substantially closed container will proceed until there are as many molecules returning to the liquid as there are escaping. At this point the vapor is said to be saturated, and the pressure of that vapor (usually expressed in mmHg) is called the saturated vapor pressure. Since the molecular kinetic energy is greater at higher temperature, more molecules can escape the surface and the saturated vapor pressure is correspondingly higher. If the liquid is open to the air, then the vapor pressure is seen as a partial pressure along with the other constituents of the air. The temperature at which the vapor pressure is equal to the atmospheric pressure is called the boiling point.

Figure 20:
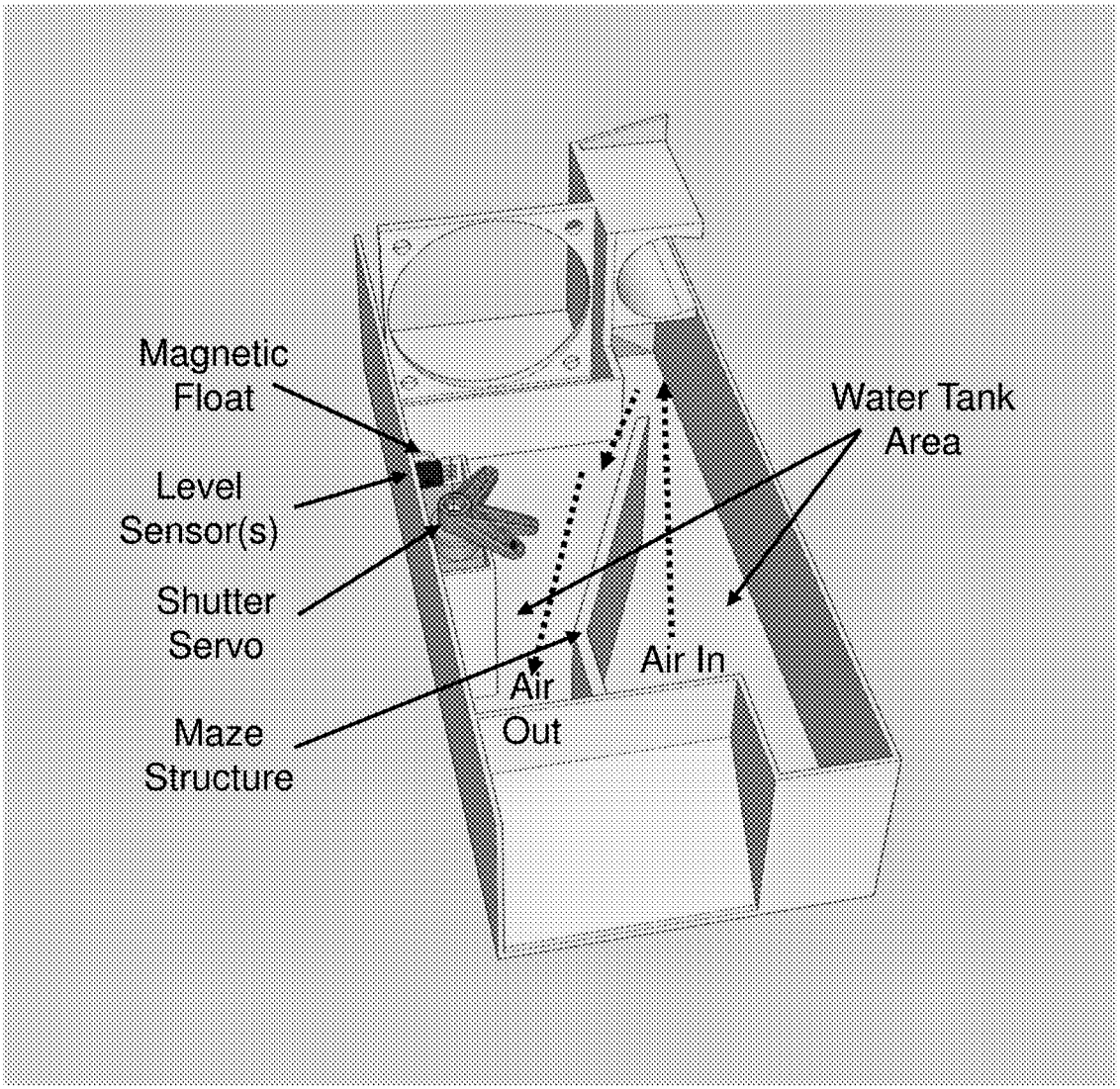
FIG. 20 is an exemplary diagram of a water tank maze structure that may be used to implement aspects of certain embodiments of the present invention.

The water tank, shown in FIG. 20, has an air "maze" guide that forces airflow across a maximal surface area in a compact form factor. The configuration of this maze may have different variations. In one example there may be no maze, just a large pool of water. On the other extreme, there may be many more mini-cavities creating more complex mazes.

In certain embodiments, the controlled environment system may use various liquids for humidity control, such as water or another aqueous solution. The water tank therefore can hold any aqueous solution that may be used for the particular application.

The maze area within the water tank in certain embodiments is meant to maximize the water surface area that air is blown over before exiting the tank and returning to the payload chamber. By maximizing the surface area the air is exposed to, the amount of moisture the air can collect and take back into the payload chamber is increased. To increase the humidity levels in the environment, airflow and no airflow can both raise humidity. When in Economy mode, the fan may be off or may cycle on or off for short time periods to attain the setpoint humidity. The duration between 'on' time periods may be based on the payload chamber temperature and humidity and the amount of time it takes for evaporation to occur in the water tank. In Turbo mode, the fan may run continuously, in bursts, at low speed, high speed or in between.

The control algorithm determines how to use the fan and how to use the shutter door based on the environmental conditions. If the humidity level within the environment is too low, then humidity may be added by moving the shutter into the humidify position (FIG. 19) and allowing the air to circulate over the body of water in the water tank, causing water vapor to begin to saturate the air. The fan may be turned on to create more airflow. By doing this the humidity may rise faster than if the fan were off. The fan may also run at different speeds causing less or more airflow. Less airflow will cause less humidity rise or cause a slower rise than may be the case with more airflow. Since running the fan takes more power, there is a tradeoff between the amount of time it takes to evaporate liquid and the amount of energy needed to perform this process.

3.4.2 Dehumidification

If the humidity level within the environment is too high, then humidity needs to be removed. This is accomplished by removing liquid vapor from the air by using the process of condensation. This is accomplished by moving the water tank shutter to the condense position (see FIG. 18). No air may flow through the water tank and the drip tank opening is exposed. Air flow will be from the air inlet to the condenser and then to the warmer and back into the payload chamber. Humidity will be removed from the air in the form of condensation. This is accomplished by holding the cold side heat exchanger (condenser) just below the dew point to maximize the Peltier coefficient of performance and save power. The cold side heat exchanger will take water vapor from the air and generate liquid by the process of condensation and channel it to the drip tank. To speed up the process of condensation (Turbo mode), the cold side of the heat exchanger (condenser) may be held well below the dew point to maximize water condensation. This will consume more power than if the condenser heat exchanger were set just at or below the dew point. Therefore, there is a tradeoff between the amount of time it takes to condense liquid and the amount of energy needed to perform the process.

3.4.2.1 Condenser

The condenser, FIG. 21, may consist of a Peltier heat pump, and cold side and hot side temperature sensors may be mounted to the cold and hot side heat exchangers respectively.

Water vapor in the atmosphere will condense from gas to liquid when the temperature of the atmosphere cools to the dew point temperature. Condensation and the onset of advection fog occurs in a distributed case when the temperature of the whole atmosphere lowers to the dew point temperature due to uniform cooling by a large heat exchanger. Condensation also occurs in a local case when the temperature of a portion of the atmosphere reaches the dew point temperature due to local cooling by a small heat exchanger. The temperature differential at which water vapor condenses from the atmosphere is dependent upon the existing conditions. In certain useful combinations of temperature and humidity, the temperature differential is small.

The temperature of the atmosphere increases or decreases when heat energy is transferred between the gaseous atmosphere and the solid heat-exchanger. Energy transfer is described by transfer direction and transfer rate. Cooling the atmosphere, necessitates establishing the direction of flow of energy from the atmosphere to the heat exchanger. The rate of cooling can be optionally established with temperature differential or established with contact surface area. The condenser hardware design manages the temperature of the atmosphere while maintaining a small temperature differential by use of a high contact surface-area heat exchanger.

Managing the location of condensation avoids undesirable effects including, but not limited to, damaging sensitive electronic components, pools of liquid where bacteria flourishes, obscuration of transparent surfaces, and the loss of the liquid water which could be reused to add humidity to the atmosphere. As shown in FIG. 21, by locating a drip tank opening under the cold side heat exchanger, angling the bottom of the heat exchanger, and angling the condenser duct drip catch (FIG. 7) to direct dripped water to the drip tank, substantially no water becomes trapped and surfaces may remain dry and free of mold, bacteria, etc.

The size of the drip tank opening into the water tank may be small enough to minimize moisture escaping from the tank. The opening may be large enough so as to not trap water droplets in the opening due to water surface tension.

An effective condenser design ensures that the temperature differential between the gaseous atmosphere and the solid heat exchanger is precisely held small (at or just below the dew point), allowing the removal of humidity from the atmosphere. Energy expended on condensing too much gaseous water and freezing liquid water to solid ice is an extraneous task and unnecessarily consumes energy. An efficient design ensures that the temperature differential between the gaseous atmosphere and the solid heat exchanger may be precisely controlled and kept small, allowing for condensation but not freezing of the water vapor.

Peltier heat pumps have a coefficient of performance trend. The trend is that heat pumping ability is significantly better with low control voltages than with high control voltages. This trend can be loosely summarized as stating that Peltiers have better low-end torque. Control methods where a Peltier heat pump is subjected to voltage modulation between high voltage and no voltage may be inconsistent with optimal performance. A power efficient design ensures that Peltier based heat pumps are controlled with stable and low control voltages.

3.4.2.2 Warmer

In certain embodiments, since the controlled environment system according to aspects of the present invention is a substantially enclosed design, energy that is consumed is distributed into the payload chamber. The payload chamber, depending on the material, may or may not absorb or dispel energy from/to the external environment. Since Peltier heat pumps function more efficiently when delta T, the temperature differential, between the cold side and hot side of the heat pump, is kept minimized. After the air passes through the condenser for dehumidification, it passes to the warmer. The relationship of the elements, condenser and warmer, are in-line with each other where the warmer follows the condenser. The condenser removes humidity from the air stream while the warmer increases the temperature of the air stream. This relationship causes the returned airflow to have a lower relative humidity than just with the condenser alone, resulting in improved dehumidification of the payload.

The warmer may be a heat exchanger and heat spreader based on the hot side of the Peltier. The cooler air coming from the condenser passes through the warmer in a laminar flow and absorbs heat from the heat exchanger. By passing the same air that was cooled to the warmer, the delta T is kept at a minimum and the heat pump can operate at a better coefficient of performance possible for the given conditions. Other factors that impact the delta T include the fan speed and desired rate of condensation.

4 Humidity Control Algorithm

A control algorithm is presented for a closed-cycle humidity controller (CCHC), such as the ECU, that may, in certain embodiments, ensure effective and efficient humidification and dehumidification of a substantially enclosed area while minimizing the growth of microorganisms. When developing humidity controller designs for low microorganism applications, three goals may be identified.

The first goal is that the design should be effective at adding water vapor to the atmosphere for humidification and removing water vapor from the atmosphere for dehumidification in a sanitary fashion.

The second goal is that the design should be efficient. The desire is for the design to consume only as much energy as may be necessary to complete the task while requiring minimal user maintenance.

The third goal is that the design should be simple. A simple closed-cycle regenerative design minimizes rates of failure and eases maintenance. The algorithm enables the use of low-cost sensors with methods of calibration and the use of low-cost fans with methods of failure detection.

Figure 22:
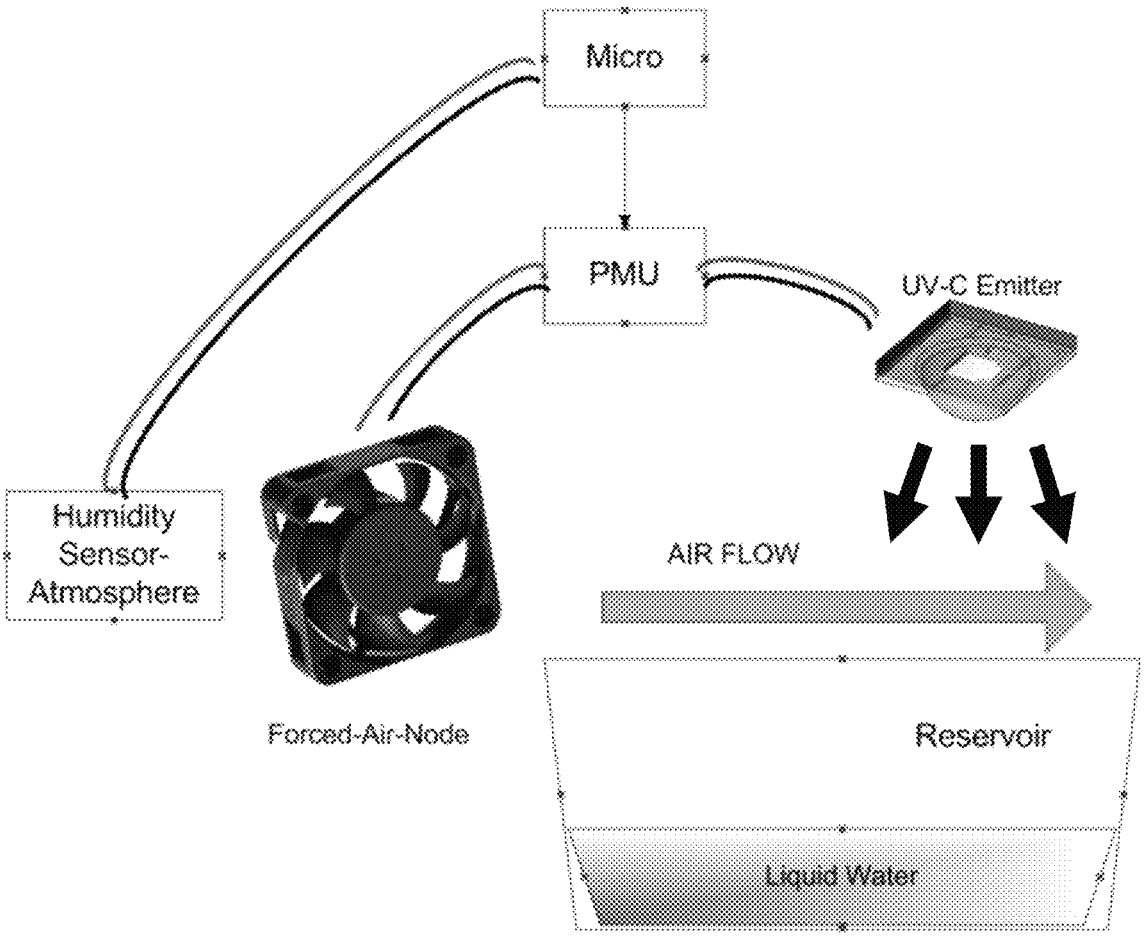
FIG. 22 is an exemplary diagram of humidifier sub-assembly control loop components that may be used to implement aspects of certain embodiments of the present invention.

FIG. 22 shows the hardware elements involved in the humidification process in certain embodiments. These elements are listed in Table 2. In general, the microcontroller reads from the air inlet humidity sensor and then sets, through the Power Management Unit (PMU), the speed of the fan, the state of the UV-C emitter for sterilizing the water and water vapor, and the state of the water tank shutter. These items may be controlled, together or individually, to achieve the desired humidity level as efficiently as possible.

TABLE 2

Humidifier Sub-Assembly Elements

| Element | Abbreviation |
|---|---|
| Humidifier Sub-Assembly | |
| Humidity Sensor- Atmosphere | "HS_atm" |
| Light Emitting Diode- UV-C | "LED_uvc" |
| Microcontroller | Micro |
| Forced-Air-Node | "FAN" |
| Reservoir | "Resvr" |

Figure 23:
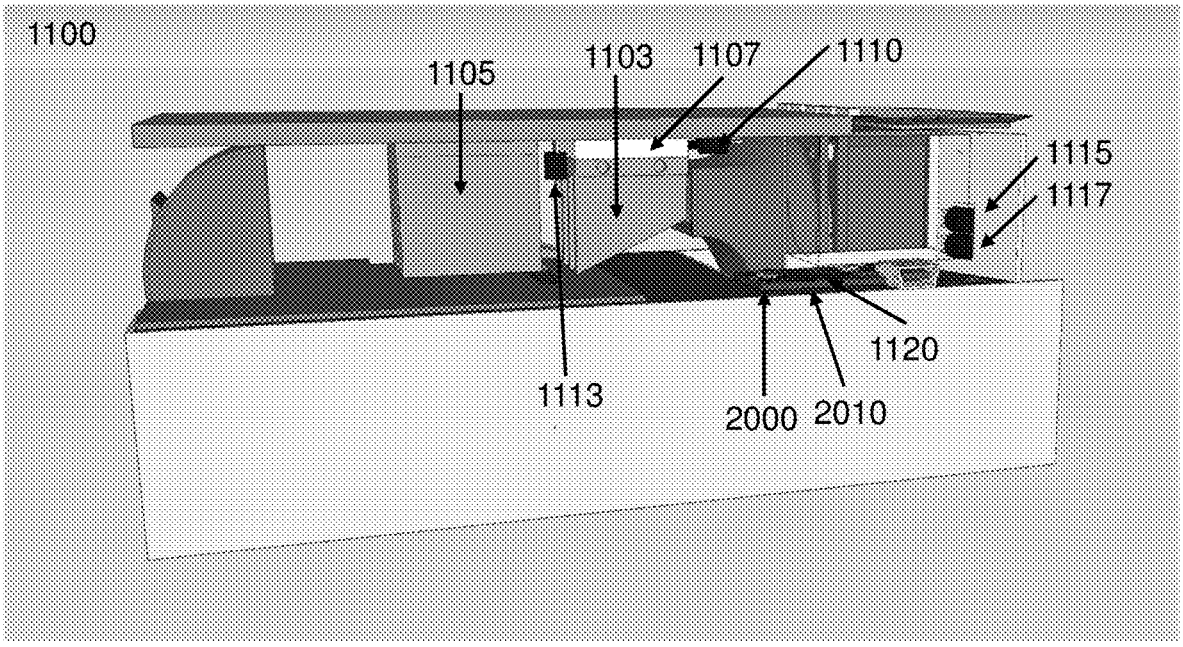
FIG. 23 is an exemplary diagram of a dehumidification sub-assembly that may be used to implement aspects of certain embodiments of the present invention.
Figure 24A:
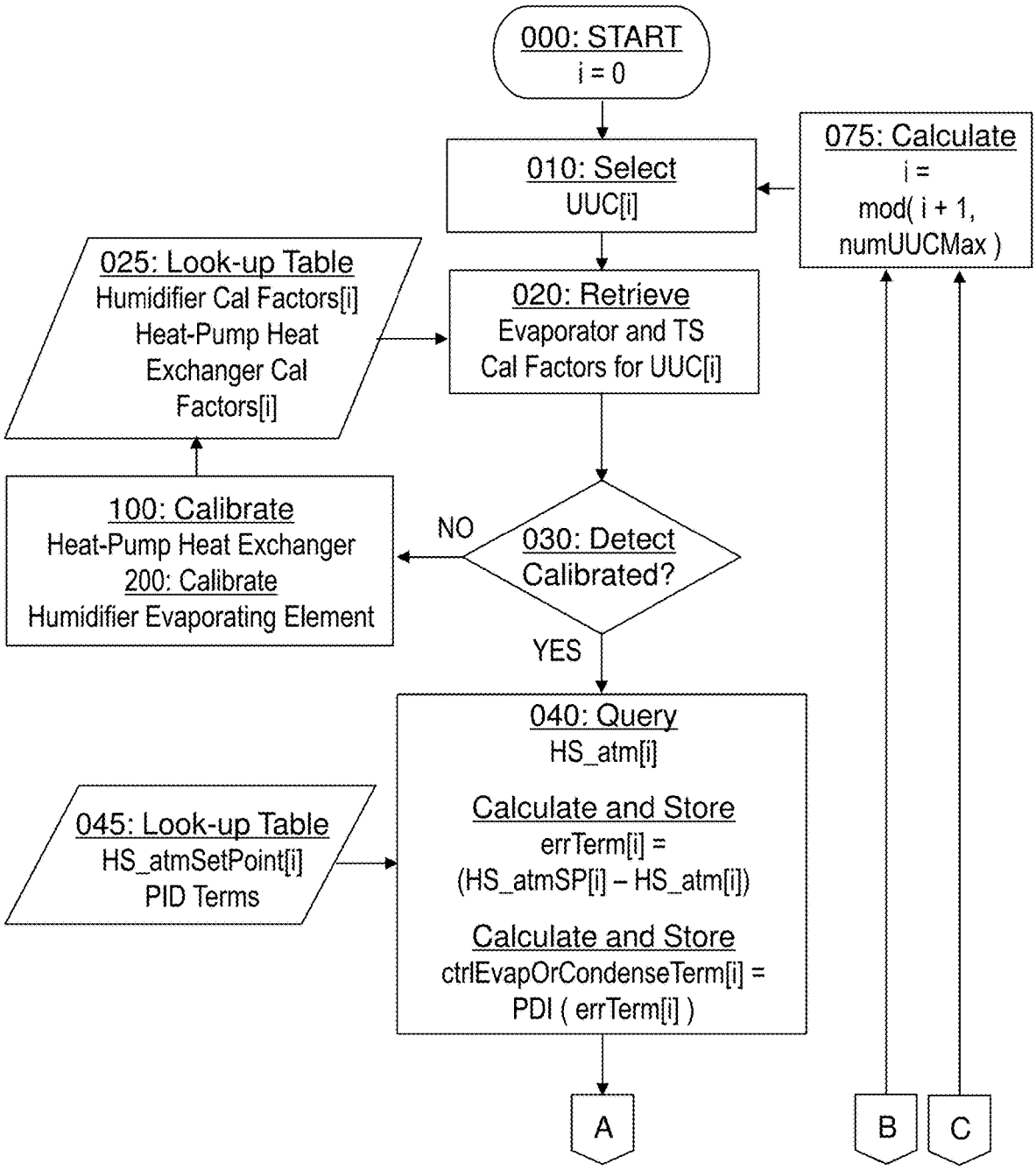
FIG. 24A and FIG. 24B are exemplary diagrams of a closed-cycle humidity controller—control algorithm that may be used to implement aspects of certain embodiments of the present invention.
Figure 24B:
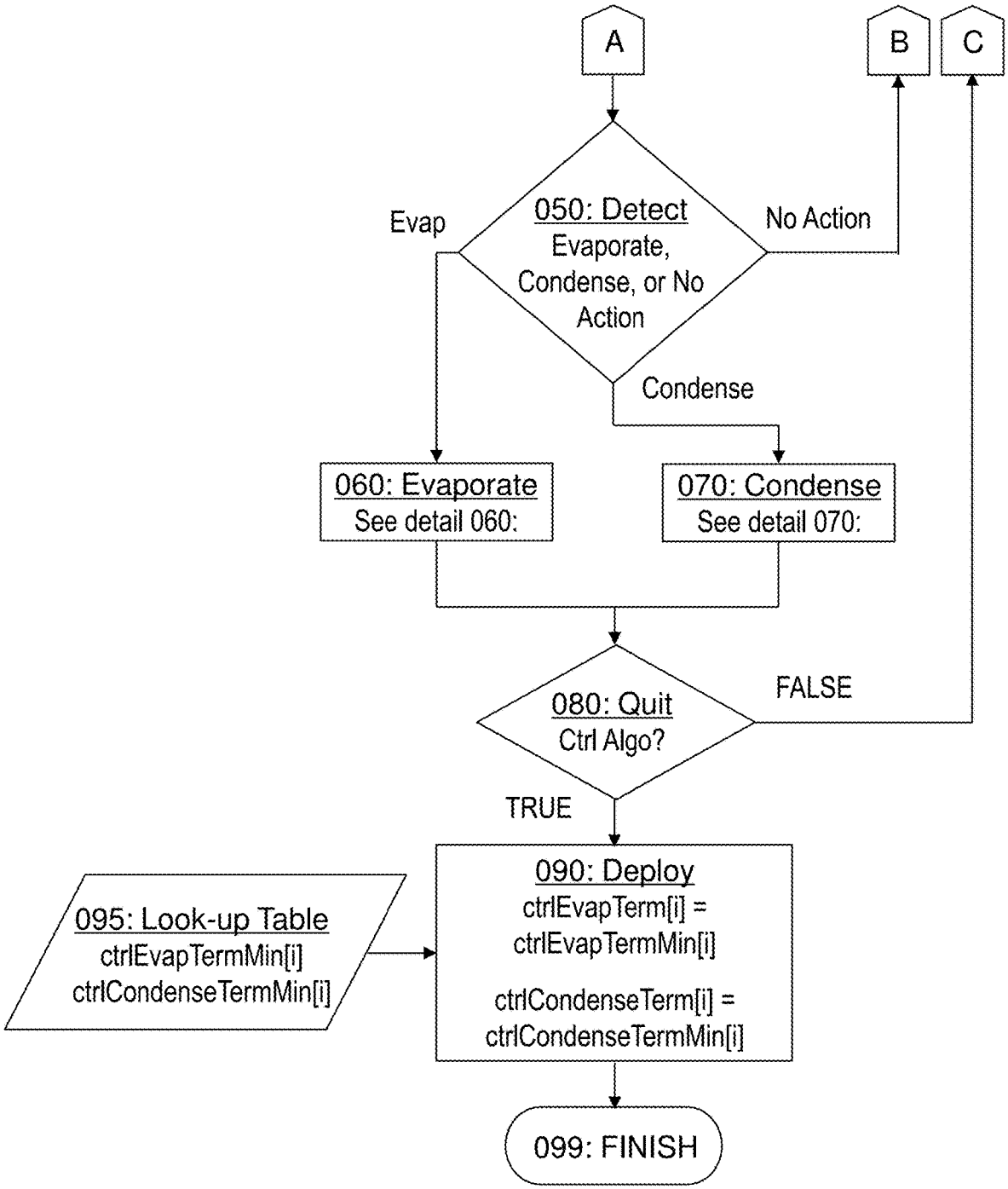
Figure 25:
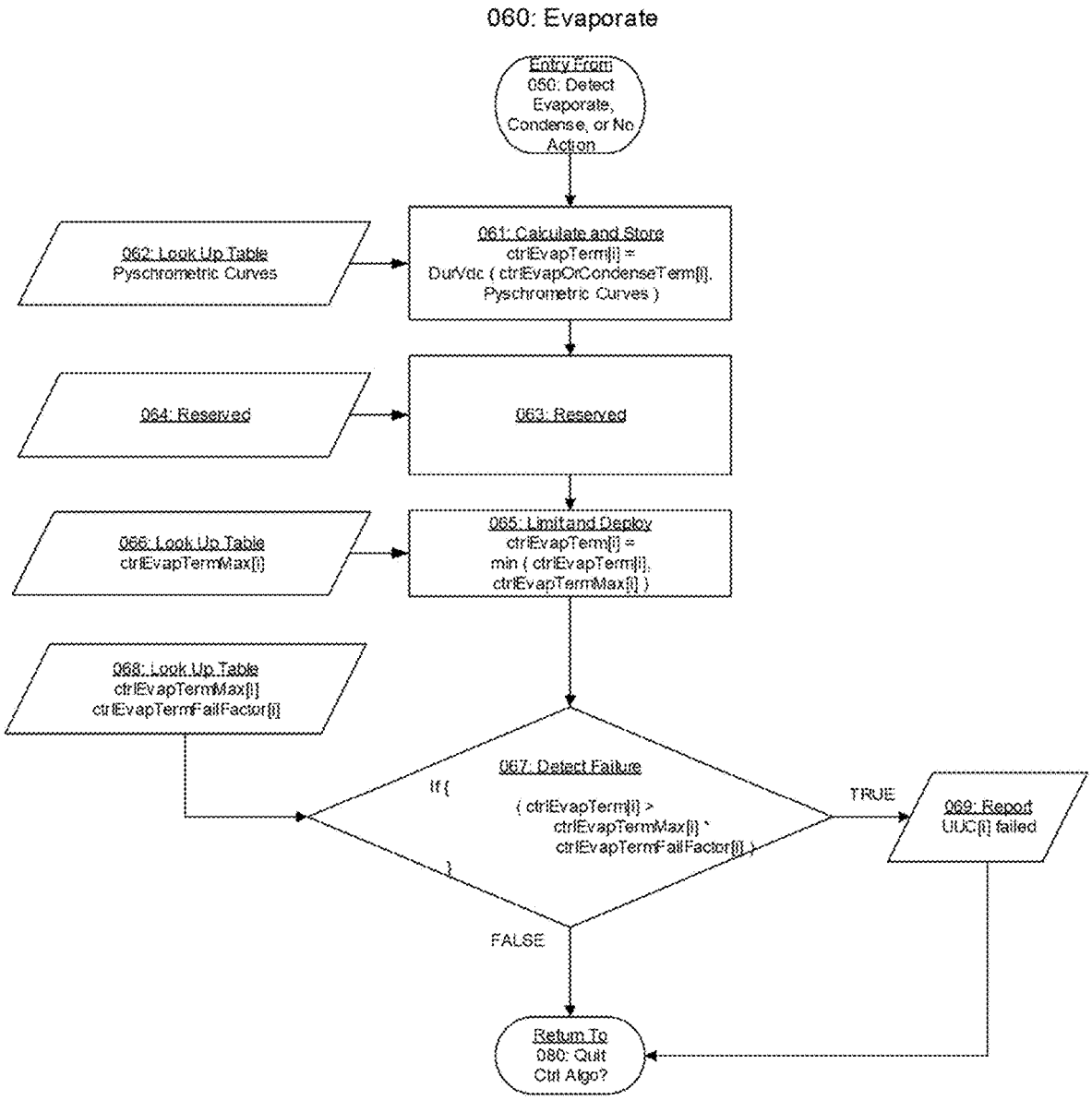
FIG. 25 is an exemplary diagram of humidification (evaporation) details that may be used to implement aspects of certain embodiments of the present invention.
Figure 26:
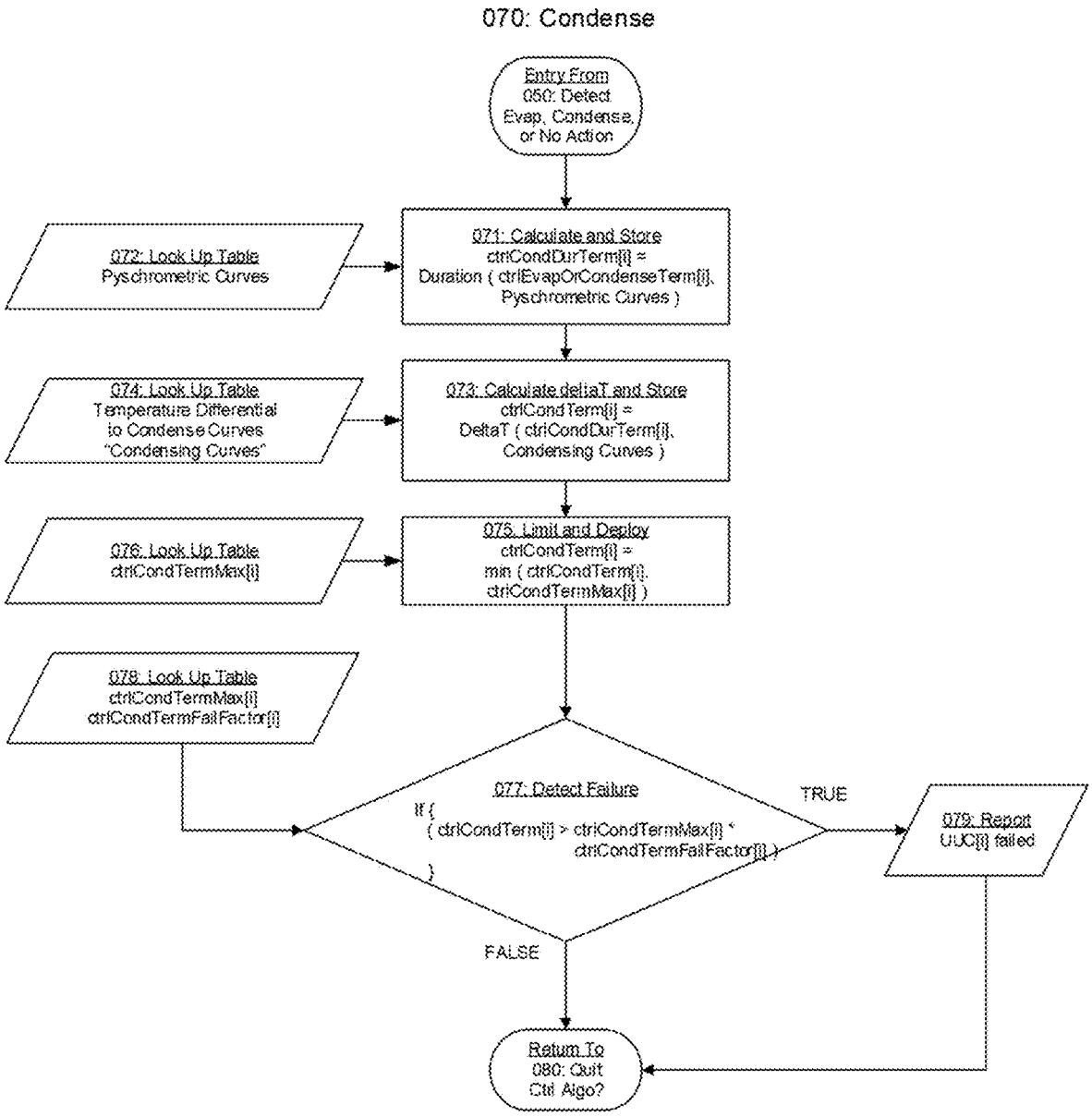
FIG. 26 is an exemplary diagram of condenser details that may be used to implement aspects of certain embodiments of the present invention.
Figure 27A:
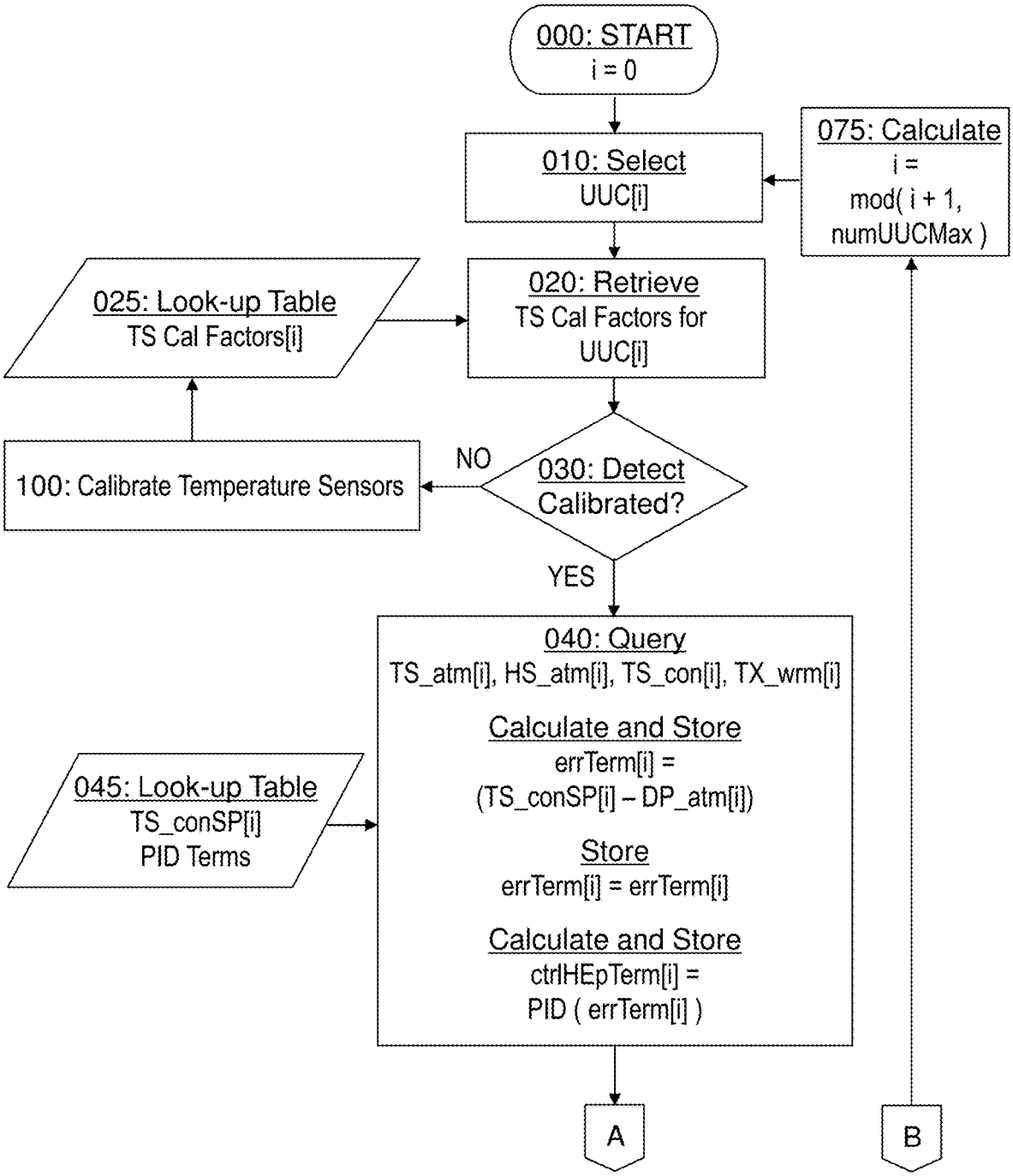
FIG. 27A and FIG. 27B are exemplary diagrams of a heat pump control algorithm that may be used to implement aspects of certain embodiments of the present invention.
Figure 27B:
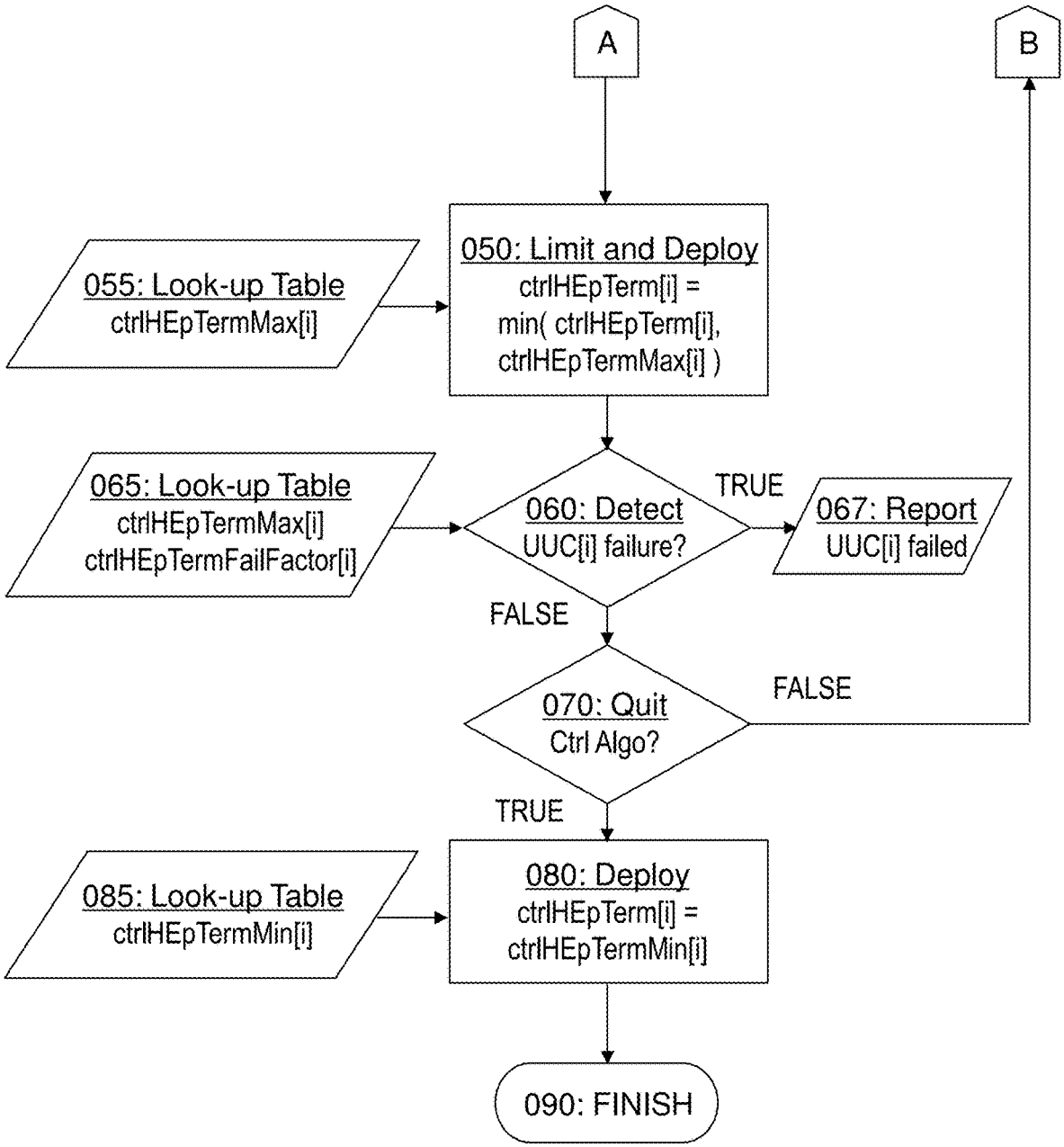
Figure 28:
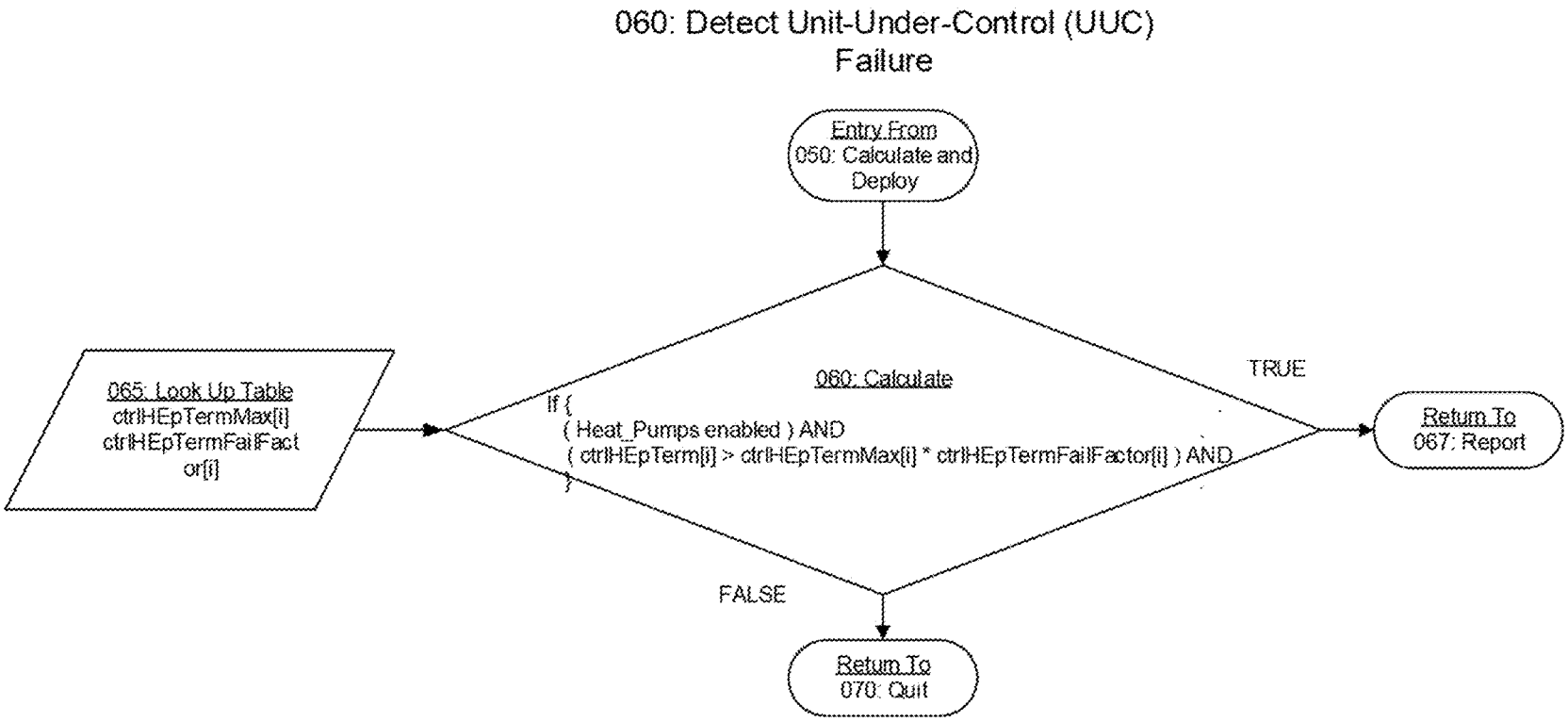
FIG. 28 is an exemplary diagram of heat pump failure detection that may be used to implement aspects of certain embodiments of the present invention.

FIG. 23 shows the hardware elements involved in the dehumidification process. These elements are listed in Table 3. In general, the microcontroller reads from the air inlet humidity and temperature sensors and then sets, through the power management unit (PMU), the speed of the fan, the condenser heat exchanger temperature, the warmer heat exchanger temperature, and the state of the water tank shutter. These items may be controlled to achieve the desired humidity level as efficiently as possible.

TABLE 3

Dehumidifier Sub-Assembly Elements

| Reference Designator | Element | Abbreviation |
|---|---|---|
| 1100 | Heat-Pump Heat Exchanger Sub-Assembly | |
| 1103 | condenser | "HEx" |
| 1105 | warmer | |
| 1107 | Heat Pump | "HEp" |
| 1110 | Temperature Sensor-warmer | "TS_wrm" |
| 1113 | Temperature Sensor-condenser | "TS_con" |
| 1115 | Humidity Sensor-Payload | "HS_atm" |
| 1117 | Temperature Sensor-Payload | "TS_atm" |
| 2000 | Microprocessor | "Micro" |
| 2010 | Power Management Unit | "PMU" |
| 1120 | Control Software- Heat-Pumped Heat Exchanger | "Code" |

The Closed-Cycle Humidity Controller Control algorithm determines the amount of gaseous water to add or remove from the atmosphere to maintain a set relative humidity level. The addition of gaseous water may be by causing a state change of liquid water to gas by evaporation (or other approach) within the humidifier sub-assembly. The removal of gaseous water may be by causing a state change from gaseous water to liquid by condensing with the condenser subassembly.

The Closed-Cycle Humidifier and Dehumidifier (Humidification and Dehumidification subassemblies), CCHD, when combined with the control software comprises a Closed-Cycle Humidity Controller (CCHC), or more generally, an exemplary implementation (ECU). The Microprocessor queries the humidity of the payload chamber from the ambient humidity sensor located in the inlet duct. Using a closed-loop control algorithm implemented in the Control Software, the humidity of the payload chamber may be driven to the set-point by controlling the amount of liquid water converted to gaseous water for increasing the humidity and the amount of gaseous water converted to liquid water for decreasing the humidity.

In certain embodiments, the Control Software operates in at least two modes, the Control Mode and the Calibration mode.

4.1 Control Mode

In Control Mode, the Control Software addresses the three goals for producing a closed-cycle humidity controller with low microorganism design. These goals are efficacy, efficiency, and simplicity. During implementation, the design recognizes two key relevant factors.

First key relevant factor for effective and efficient closed-cycle humidity controllers (CCHC) for low microorganism applications is that the amount of liquid water needed to control the humidity for a given volume of atmosphere is very small; for example, with 816.3 liters of air at 15 C, increasing the relative humidity from 85% to 95%, requires evaporating approximately 1 gram (1 mL) of water. Decreasing the relative humidity by the same percentage requires condensing the same 1 gram of water from the payload chamber. An effective and efficient design ensures that energy is conserved by evaporating or condensing the optimal amount of liquid water.

The second key relevant factor for effective and efficient closed-cycle humidity controllers (CCHC) for low microorganism applications is that microorganisms can be spread throughout the payload area during the humidification process. Microorganisms can be disinfected with the application of ultra-violet light with a wavelength of approximately 265 nm to 285 nm.

Managing the payload chamber's humidity is by use of a feedback control loop. The process variable is the measured humidity at the air inlet. The process set-point is the user-selected humidity which may be dependent upon the item being stored. The process controller-output is either the supply voltage to the fan when the task is to increase the humidity or the supply voltage to the heat pump when the task is to decrease the relative humidity.

While driving the process variable to the process set point, the process control output may engage the humidifier and dehumidifier. The humidifier converts liquid water to gaseous water with evaporation while illuminating the liquid and gaseous water with ultra-violet light to kill any organisms. The dehumidifier converts gaseous water to liquid water by locally cooling the atmosphere low enough to cause condensation. When the control loop has converged, the three goals for low microorganism designs; efficacy, efficiency, and simplicity; have been accomplished.

Flowcharts for the control algorithm are shown in FIG. 24A through FIG. 28. Descriptions are in the corresponding tables, Table 4 through Table 11.

4.1.1 Closed-Cycle Humidity Controller—Control Algorithm

TABLE 4

Control Mode Block Descriptions

| Reference Designator | Component Type | Description |
|---|---|---|
| 000: Start | Terminal | Start point for control algorithm is entered after User initiates the control. This is assumed to occur once User selects the food item to be stored and the atmospheric conditions are determined. |
| 010: Select | Process | The product design may include zero, one or more than one humidity controller. This process selects one of the humidity controllers to be the current unit-under-control (UUC). The UUC is indicated by iteration variable "i". |
| 020: Retrieve | Process | Retrieve the contents of the calibration lookup table for the UUC. |
| 025: Look Up Table | Input/Output | Lookup table contains calibration coefficients for the UUC. |
| 030: Detect | Decision | Detect if calibration coefficients exist for the UUC. If no coefficients exist, enter the Calibration Algorithm. If coefficients exist, then continue. |
| 100: Calibrate | Process | Calibration process for condenser. |
| 200: Calibrate | Process | Calibration process for Humidifier. |
| 040: Query | Process | Query from the humidity sensor (HS_atm). Apply calibrations.<br>Calculate and store the error term (errTerm) as being the difference between the target set point (HS_atmSP) and the atmospheric relative humidity (HS_atm).<br>errTerm[i] = (HS_atmSP[i] − HS_atm[i])<br>Calculate and store the control term (ctrlEvapOrCondenseTerm) using control-loop and PID coefficients along with the error term. |
| 045: Look Up Table | Input/Output | Lookup table contains temperature differential temperature target and feedback control-loop coefficients (PID). |
| 050: Detect | Decision | Detect if the control term indicates the need to increase relative humidity (evaporate), remove relative humidity (condense), or if no action is required. Deploy control term to Evaporate process or Condense process. |
| 060: Evaporate | Process | See detail 060: Evaporate. |
| 070: Condense | Process | See detail 070: Condense. |
| 080: Quit | Decision | If this control algorithm is not issued a Quit from a higher process, then continue control algorithm, with next UUC.<br>If control algorithm is issued a Quit, then discontinue control algorithm. |
| 075: Calculate | Process | The product design may include zero, one or more than one heat-pump-channels (HPC). This process calculates new value for iteration variable "i". |
| 090: Deploy | Process | When discontinuing the control algorithm, deploy ctrlEvapTermMin and ctrlCondTermMin to Power Management Unit, disabling all fan elements and heat pumps. |
| 095: Look Up Table | Input/Output | Lookup table contains the minimum setting allowed for the humidifier sub-assembly, ctrlEvapTermMin and condenser subassembly, ctrlCondTermMin. |
| 099: Finish | Terminal | Finish point for control algorithm is entered after User terminates the control. This is assumed to occur when User sets the product to Stand-by mode. |

TABLE 5

Control Mode Parameter List

| Name | Symbol | Description | Units |
|---|---|---|---|
| condenser Temperature Sensor Calibration Factors | TS Cal Factors[i] | Calibration factor for temperature sensor located at condenser heat exchanger, TS_out[i]. This calibration factor is relative to TS_in[i]. | Celsius |
| Target set point relative humidity for atmosphere | HS_atmSP[i] | Target relative humidity for the payload chamber. Relative humidity is selected depending upon the payload item being stored. This humidity is the control-loop set point. | Celsius |
| Proportional, Integral, Derivative Coefficients | PID Terms[i] | Control-loop coefficients for configuration loop stability and settling characteristics. | Unitless |
| Humidifier Control Term - Min | ctrlEvapTermMin[i] | The minimum operational control setting allowed for the humidifier sub-assembly. | Volts |
| Dehumidifier Control Term - Min | ctrlCondTermMin[i] | The minimum operational control setting allowed for the dehumidifier sub-assembly. | Volts |

TABLE 6

Control Mode Detail 060: Evaporate - Block Descriptions

| Reference Designator | Component Type | Description |
|---|---|---|
| 050: Entry | Terminal | Entered from 050: Detect Evaporate, Condense, or No Action |
| 061: Calculate and Store | Process | Utilizing psychrometric curves, determine the amount of liquid water needed to be converted to gaseous water. From the rate of evaporation, calculate the duration of evaporation needed to convert the determined amount of liquid water to gaseous water. |
| 062: Look Up Table | Input/Output | Lookup table contains psychrometric curves. |
| 063: Reserved | Reserved | Reserved |
| 064: Look Up Table | Input/Output | Lookup table contains duty cycle and voltage to use. Duty cycle is dependent upon the hardware design of the evaporative element. |
| 065: Limit and Deploy | Process | Limit the control term to not exceed functional limits, ctrlEvapTermMax. Deploy limited ctrlEvapTerm to Power Management Unit. |
| 066: Look Up Table | Input/Output | Lookup table contains the maximum setting allowed for the fan element, ctrlEvapTermMax. |
| 067: Detect | Decision | Test calculated ctrlEvapTerm and limited ctrlEvapTerm to determine if the control loop is failing to converge, suggesting that something in the humidification process is failing<br>If {<br>( ctrlEvapTerm[i] > ctrlEvapTermMax[i] * ctrlEvapTermFailFactor[i] )<br>} |
| 068: Look Up Table | Input/Output | Lookup table contains the maximum setting allowed for the humidifier fan element, ctrlEvapTermMax and factor for considering when failure has occurred, ctrlEvapTermFailFactor. |
| 080: Return | Terminal | Return to 080: Quit Ctrl Algo? |

TABLE 7

Control Mode Detail 060: Evaporate - Parameter List

| Name | Symbol | Description | Units |
|---|---|---|---|
| Pyschrometric Curves | None | Table relating the amount of water available from an amount of air at various temperatures. | Various |
| Humidifier Fan Element Control Term - Max | ctrlEvapTermMax[i] | The maximum operational control setting allowed for the humidifier fan element. | Seconds |
| Humidifier Fan Element Control Term Fail Factor | ctrlEvapTermFailFactor[i] | The multiplication factor used to determine when humidifier sub-system has failed. | Unitless |

4.1.1.2 Closed-Cycle Humidity Controller—Control Algorithm—Condense Detail

TABLE 8

Control Mode, Detail 070: Condense - Block Descriptions

| Reference Designator | Component Type | Description |
|---|---|---|
| 050: Entry | Terminal | Entered from 050: Detect Evaporate, Condense, or No Action |
| 071: Calculate and Store | Process | Utilizing psychrometric curves, determine the amount of gaseous water needed to be converted to liquid water. Calculate the duration of condensing needed to convert the determined amount of gaseous water to liquid water. |
| 072: Look Up Table | Input/Output | Lookup table contains psychrometric curves. |
| 073: PWM and Store | Process | Determine from "Temperature Differential to Condense" curves the delta temperature needed to cause condensation to occur. |
| 074: Look Up Table | Input/Output | Lookup table containing "Temperature Differential to Condense" table. |
| 075: Limit and Deploy | Process | Limit the control term to not exceed functional limits, ctrlCondTermMax. Deploy limited ctrlCondTerm to Power Management Unit. |
| 076: Look Up Table | Input/Output | Lookup table contains the maximum setting allowed for the humidifier fan element, ctrlCondTermMax. |
| 077: Detect | Decision | Test calculated ctrlCondTerm and limited ctrlCondTerm to determine if the control loop is failing to converge, suggesting that humidifier evap element is failing<br>If {<br>( ctrlCondTerm[i] > ctrlCondTermMax[i] * ctrlCondTermFailFactor[i] )<br>} |
| 078: Look Up Table | Input/Output | Lookup table contains the maximum setting allowed for the condenser, ctrlCondTermMax and factor for considering when failure has occurred, ctrlCondTermFailFactor. |
| 080: Return | Terminal | Return to 080: Quit Ctrl Algo? |

TABLE 9

Control Mode, Detail 070: Condense - Parameter List

| Name | Symbol | Description | Units |
|---|---|---|---|
| Psychrometric Curves | None | Table relating the amount of water available from an amount of air at various temperatures. | Various |
| Temperature Differentials to Condense Water from Air Curves | Condensing Curves | Table relating the temperature differential to set in the heat-pump heat exchanger to cause condensation to occur. | Celsius |
| condenser Control Term - Max | ctrlCondTermMax[i] | The maximum operational control setting allowed for the heat pump, HEp[i]. | Volts |
| condenser Control Term Fail Factor | ctrlCondTermFailFactor[i] | The multiplication factor used to determine when condenser subassembly has failed. | Unitless |

4.1.1.3 Heat Pump—Control Algorithm

TABLE 10

Heat Pump Control Mode - Block Descriptions

| Reference Designator | Component Type | Description |
|---|---|---|
| 000: Start | Terminal | Start point for control algorithm is entered after User initiates the control. This is assumed to occur once User selects the item to be stored and the atmospheric condition is determined. |
| 010: Select | Process | The product design may include zero, one or more than one heat-pump-channels (HPC). This process selects one of the HPCs to be the current unit-under-control (UUC). The UUC is indicated by iteration variable "i". |
| 020: Retrieve | Process | Retrieve the contents of the calibration look-up table for UUC. |
| 025: Look Up Table | Input/Output | Look-up table contains calibration coefficients for the UUC. |
| 030: Detect | Decision | Detect if calibration coefficients exist for UUC. If no coefficients exist, enter the Calibration Algorithm. If coefficients exist, then continue. |

TABLE 10-continued

| Heat Pump Control Mode - Block Descriptions | | |
|---|---|---|
| Reference Designator | Component Type | Description |
| 040: Query | Process | Query from the temperature and humidity sensors. Apply calibrations. Calculate and store the error term (errTerm) as being the difference between the target set point (TS_conSP) and the payload dew point temperature (DP_atm).<br>errTerm[i] = (TS_atmSP[i] − DP_atm[i])<br>Calculate and store the control term (ctrlTerm) using control-loop and PID coefficients along with the error term. |
| 045: Look Up Table | Input/Output | Look-up table contains condenser temperature target and feed-back control-loop coefficients (PID). |
| 050: Limit and Deploy | Process | Limit the control term to not exceed functional limits, ctrlHEpTermMax. Deploy limited ctrlTerm to Power Management Unit. |
| 055: Look Up Table | Input/Output | Look-up table contains the maximum setting allowed for the heat pump, ctrlHEpTermMax. |
| 060: Detect | Decision | Test calculated ctrlHEpTerm and limited ctrlHEpTerm to determine if the control loop is failing to converge, suggesting that heat pump is failing to provide sufficient heat flow through the heat exchanger.<br>If {<br>( Heat_Pumps enabled ) AND<br>( ctrlHEpTerm[i] > ctrlHEpTermMax[i] * ctrlHEpTermFailFactor[i] ) AND.<br>} |
| 065: Look Up Table | Input/Output | Look-up table contains the maximum setting allowed for the heat pump, ctrlHEpTermMax and factor for considering when failure has occurred, ctrlHEpTermFailFactor. |
| 070: Quit | Decision | If this control algorithm is not issued a Quit from a higher process, then continue control algorithm, with next UUC.<br>If control algorithm is issued a Quit, then discontinue control algorithm. |
| 075: Calculate | Process | The product design may include zero, one or more than one heat-pump-channels (HPC). This process calculates new value for iteration variable "i". |
| 080: Deploy | Process | When discontinuing the control algorithm, deploy ctrlHEpTermMin to Power Management Unit, disabling all heat pumps. |
| 085: Look Up Table | Input/Output | Look-up table contains the minimum setting allowed for the heat pump, ctrlHEpTermMin. |
| 090: Finish | Terminal | Finish point for control algorithm is entered after User terminates the control. This is assumed to occur when User sets the product to Stand-by mode. |

TABLE 11

| Heat Pump Control Mode - Parameter List | | | |
|---|---|---|---|
| Name | Symbol | Description | Units |
| Temperature Sensor Calibration Factor | TS Cal Factors[i] | Calibration factor for temperature and humidity sensors. | Celsius |
| Target set point temperature for condenser | TS_conSP[i] | Target temperature for the condenser. Temperature is selected depending upon the food item being stored. This temperature is the control-loop set point. | Celsius |
| Proportional, Integral, Derivative Coefficients | PID Terms[i] | Control-loop coefficients for configuration loop stability and settling characteristics. | Unitless |
| Heat Pump Control Term - Max | ctrlHEpTermMax[i] | The maximum operational control setting allowed for the heat pump, HEp[i]. | Volts |
| Heat Pump Control Term Fail Factor | ctrlHEpTermFailFactor[i] | The multiplication factor used to determine when UUC[i] has failed. | Unitless |
| Heat Pump Control Term - Min | ctrlHEpTermMin[i] | The minimum operational control setting allowed for the heat pump, HEp[i]. | Volts |

4.2 Control Loop Coefficients

Figure 29:
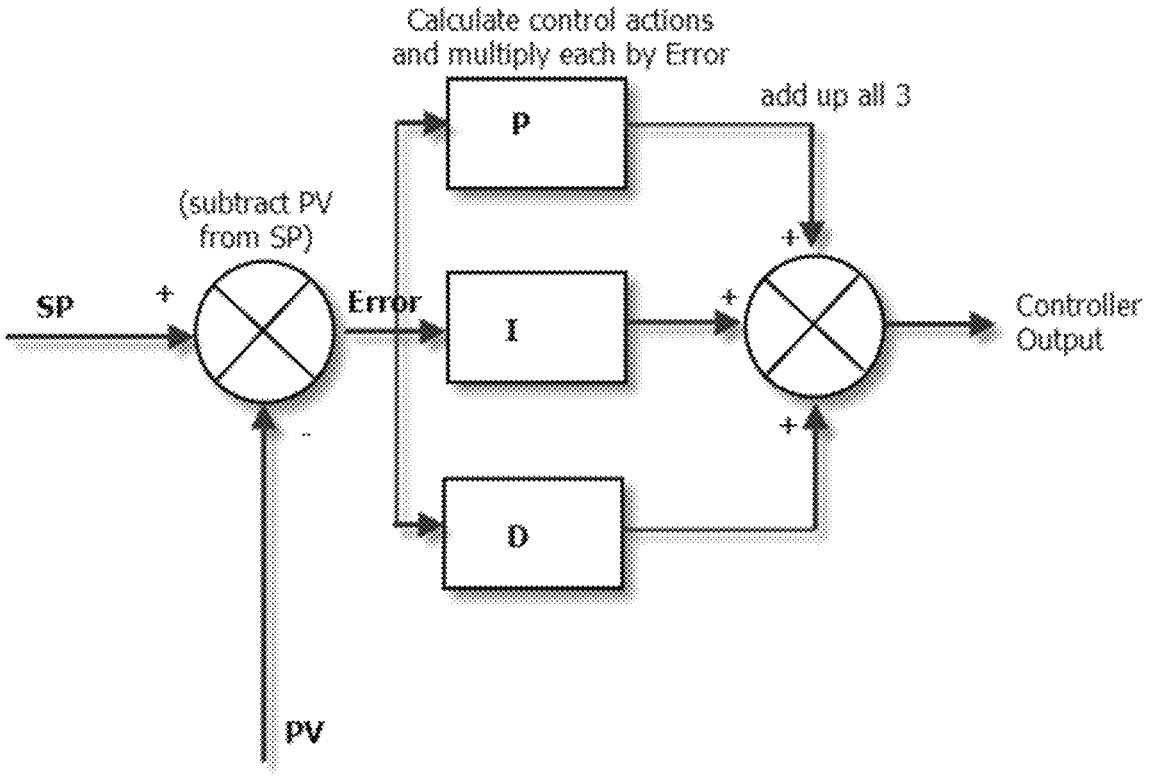
FIG. 29 is an exemplary diagram of a proportional, integral, derivative control loop that may be used to implement aspects of certain embodiments of the present invention.

In certain embodiments, precisely managing the temperature/humidity of the payload chamber and differential temperature may be accomplished by the use of a Proportional, Integral, and Derivative (PID) control loop, shown in FIG. 29.

Managing the payload chamber relative humidity may be by use of a feedback control loop. The process variable is the measured ambient humidity of the payload chamber. The process set point is a relative humidity which may be selected depending upon the payload item. The process controller output may either be the supply voltage to the heat pump when the task is to decrease the relative humidity or may be the supply voltage to the fan when the task is to increase the relative humidity. When the control loop has converged, the three goals for low microorganism designs, efficacy, efficiency, and simplicity may have been accomplished.

Table cross-references parameters used in the flow diagrams and the simplified diagram of the control loop, shown in FIG. 29.

TABLE 12

Control Loop Diagram to Flow Diagram Cross Reference

| Signal | Flow Diagram | Control Loop Diagram |
|---|---|---|
| Set Point | HS_atmSP[ ] | SP |
| Process Variable | HS_atm[ ] | PV |
| Error Term | errTerm[ ] | Error |
| Proportional Term | P | P |
| Integral Term | I | T |
| Derivative Term | D | D |
| Controller | ctrlEvapOrCondense[ ] | Controller Output |

4.3 Calibration Mode

In Calibration Mode, algorithms are exercised to measure temperature characteristics of various elements. With the measurements, calibration tables are produced which improve the accuracy of the elements which in turn improve the efficacy and efficiency of the design.

4.3.1 Calibration Mode—Dehumidifier

In Calibration Mode, the control software configures the hardware elements to a pre-determined state and measures differential imbalances of the temperature sensors.

With the use of calibration and differential measurements during Operational Mode, low cost temperature sensors with their expected variation in temperature reporting accuracy due to production process variation may be used.

Figure 30A:
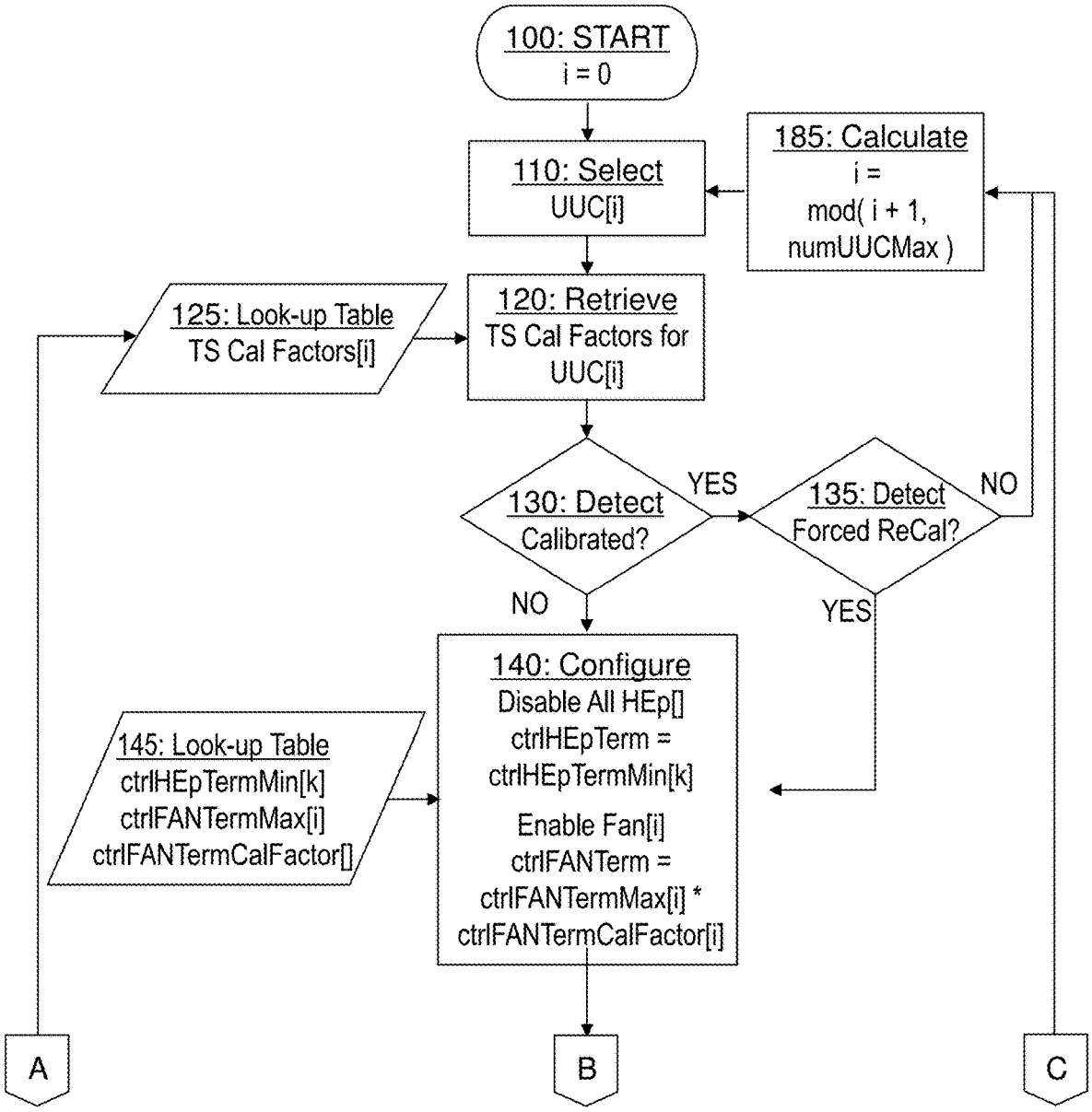
FIG. 30A and FIG. 30B are exemplary diagrams of a condenser—dehumidifier calibration algorithm that may be used to implement aspects of certain embodiments of the present invention.
Figure 30B:
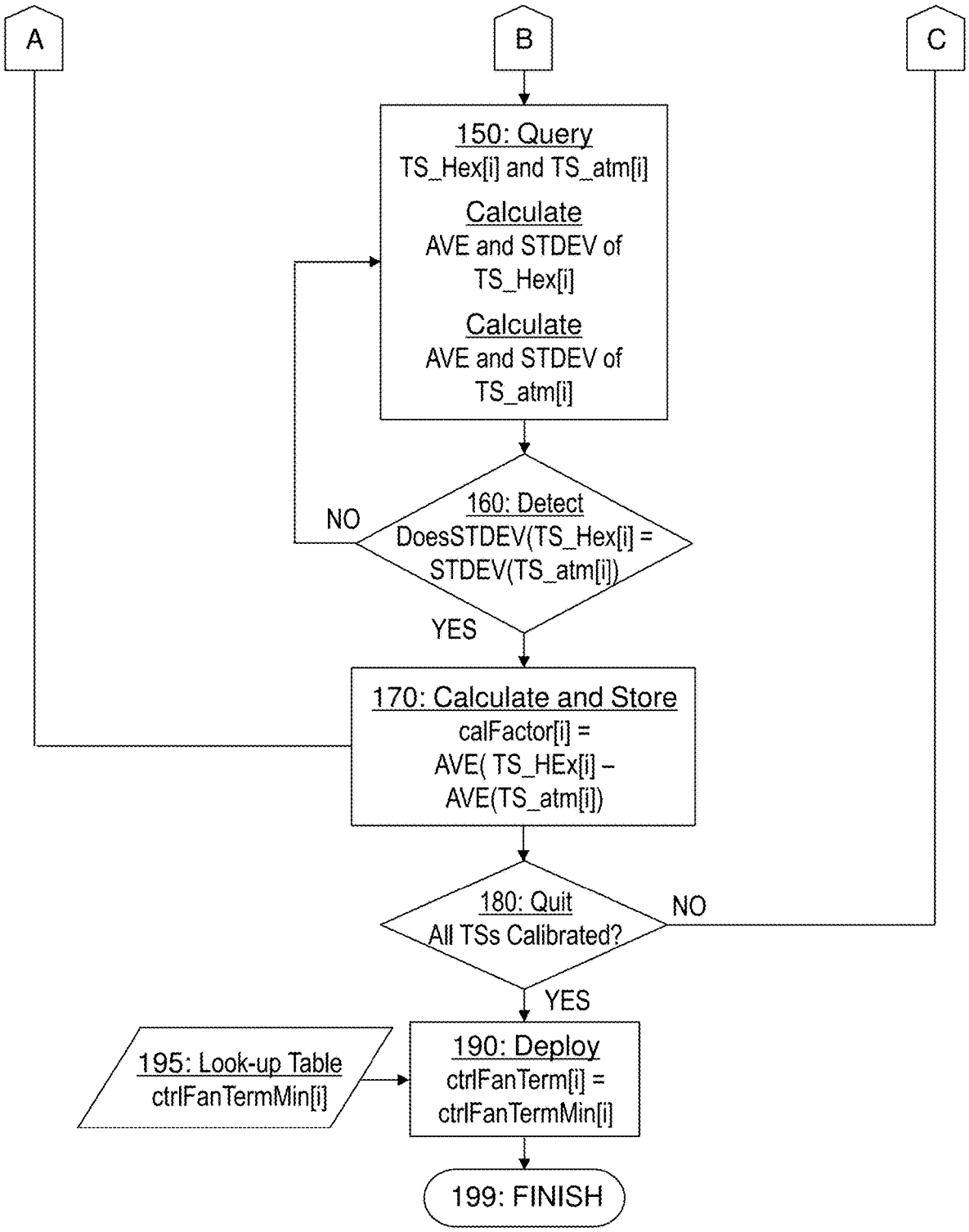

Calibration of the dehumidifier sub-assembly is accomplished by calibration of the condenser subassembly. The algorithm for calibration for dehumidification is shown in FIGS. 30A and 30B and explained in Table 13 and Table 14.

4.3.1.1 Calibration Mode: Flowchart—Dehumidifier

TABLE 13

Calibration Mode: Dehumidifier - Block Descriptions

| Reference Designator | Component Type | Description |
|---|---|---|
| 100: Start | Terminal | Start point for calibration algorithm is entered when control algorithm detects that there are no existing calibration coefficients. |
| 110: Select | Process | The product design may include zero, one or more than one heat-pumped-channels (HPCs). This process selects one of the HPCs to be the unit-under-control (UUC). The UUC is identified with iteration variable "i". |
| 120: Retrieve | Process | Retrieve the contents of the calibration lookup table for the UUC. |
| 145: Look Up Table | Input/Output | Lookup table contains calibration coefficients for the UUC. |
| 130: Detect | Decision | Detect if calibration coefficients exist for UUC. If no coefficients exist, enter the Calibration Algorithm. If coefficients exist, then continue. |
| 135: Detect | Decision | Detected that calibration coefficients exist, yet recalibration is desired. |
| 140: Configure | Process | Configure the hardware elements for calibration mode.<br>Ensure that all heat pumps are disabled as the calibration algorithm relies on the heat exchanger and the payload chamber to be at the same temperature.<br>Enable FAN[i] at flow rate determined by maximum flow rate and a scaling factor. |
| 145: Look Up Table | Input/Output | Lookup table contains the maximum setting allowed for the UUC. |
| 150: Calculate and Deploy | Process | Query from the heat exchanger temperature sensor (TS_HEx[ ]) and atmosphere air temperature sensor (TS_atm[ ]) the current temperatures.<br>Calculate and store the average and standard deviation statistics from heat exchanger and atmosphere temperature sensor queries. |
| 160: Detect | Decision | Compare the standard deviation of the sensor queries. When standard deviations are near equal, then can assume that heat exchanger and payload chamber temperatures have settled. |
| 170: Calculate and Store | Decision | Calculate calibration coefficients and store in Lookup Table.<br>calFactor[i] = AVE(TS_HEx[i]) − AVE(TS_atm[i]) |
| 180: Quit | Decision | Determine if all HPCs have been calibrated. |
| 190: Deploy | Process | When discontinuing the calibration algorithm, deploy ctrlTermMin[ ] to Power Management Unit, disabling all heat pumps. |
| 195: Look Up Table | Input/Output | Lookup table contains the minimum setting allowed for the heat pump. |
| 199: Finish | Terminal | Finish point for calibration algorithm is entered after all temperature sensors associated with HPCs have been calibrated and FANs have been disabled. |

TABLE 14

| Calibration Mode: Dehumidifier - Parameter List | | | |
|---|---|---|---|
| Name | Symbol | Description | Units |
| Temperature Sensor Calibration Factors | TS Cal Factors[i] | Calibration factor for temperature sensor located at outlet of forced-air heat exchanger, TS_out[i]. This calibration factor is relative to TS_in[i]. | Celsius |
| Heat Pump Control Term - Min | ctrlHEpTermMin[i] | The minimum operational control setting allowed for the heat pump[i]. | Volts |
| FAN Control Term - Max | ctrlFANTermMax[i] | The maximum operational control setting allowed for the FAN[i]. | Volts |
| FAN Control Term Calibration Factor | ctrlFANTermCalFactor[i] | The multiplication factor used to set FAN control during calibration. | Unitless |
| FAN Control Term - Min | ctrlFANTermMin[i] | The minimum operational control setting allowed for the FAN[i]. | Volts |

4.3.2 Calibration Mode: Humidifier—Flowchart

Figure 31A:
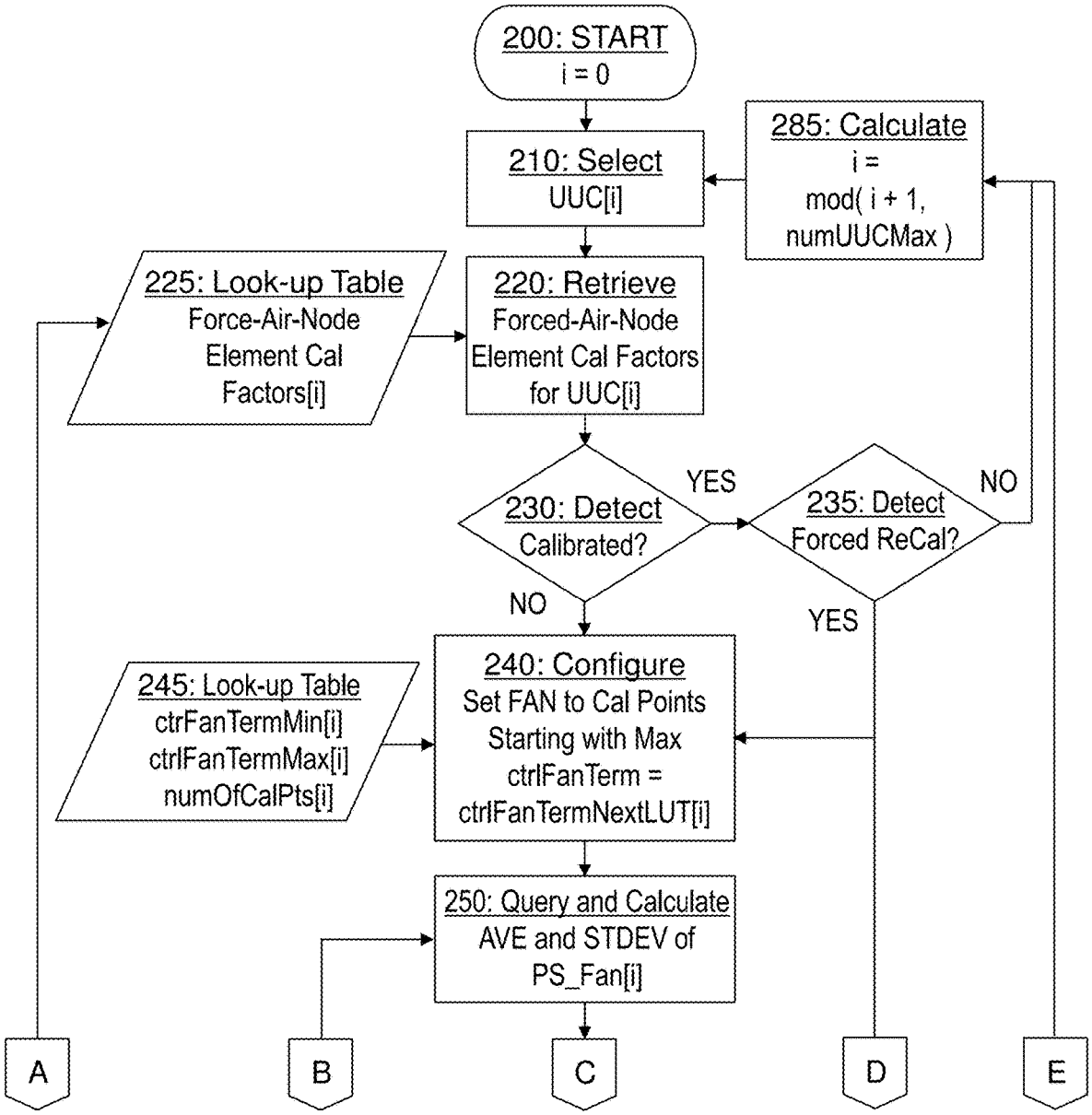
FIG. 31A and FIG. 31B are exemplary diagrams of humidification calibration mode details that may be used to implement aspects of certain embodiments of the present invention.
Figure 31B:
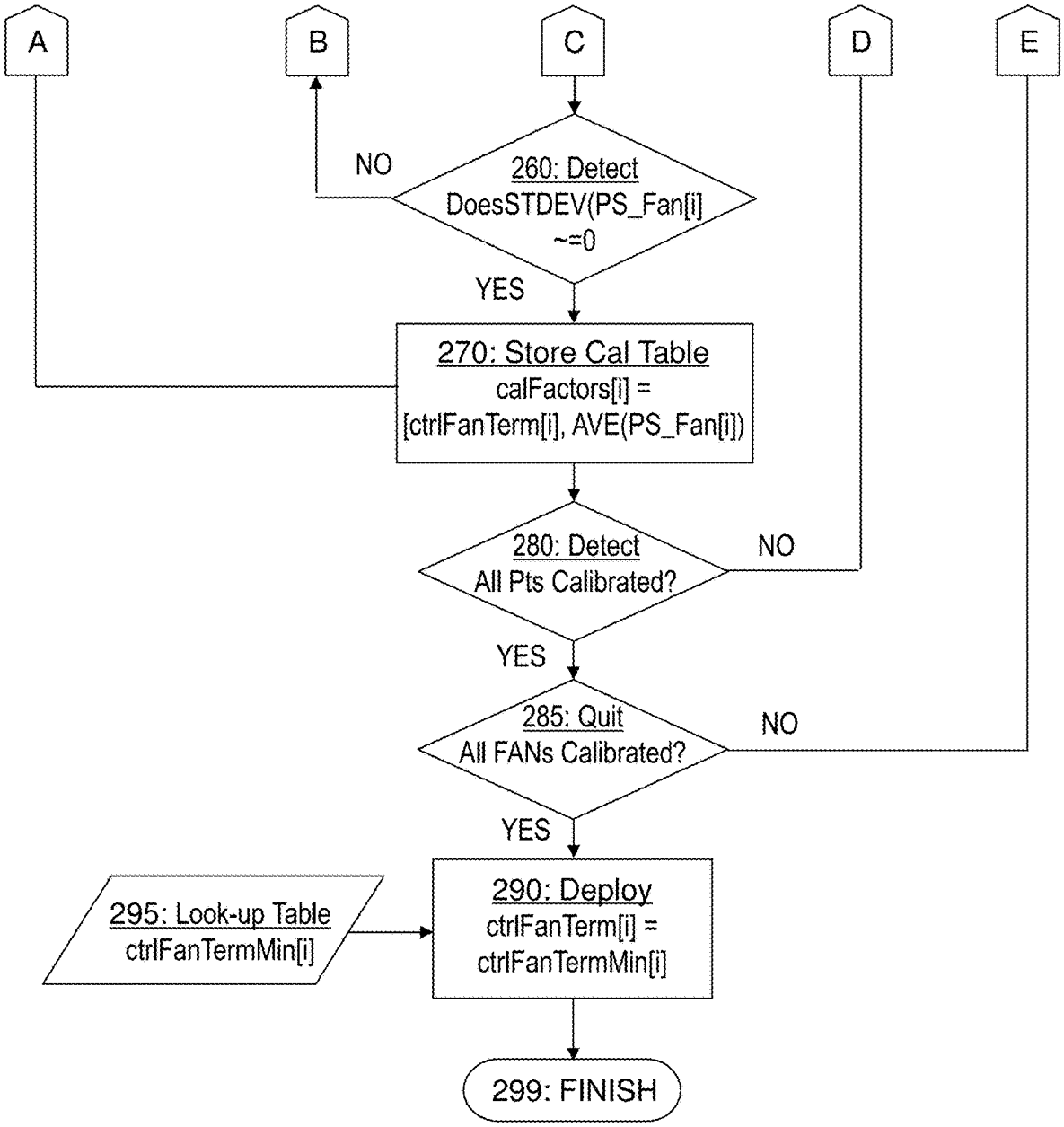

The flow chart for humidifier calibration is shown in FIG. 31A and FIG. 31B and discussed in Table 15 and Table 16.

TABLE 15

| Calibration Mode: Humidifier - Block Descriptions | | |
|---|---|---|
| Reference Designator | Component Type | Description |
| 200: Start | Terminal | Start point for calibration algorithm is entered when control algorithm detects that there are no existing calibration coefficients. |
| 210: Select | Process | The product design may include zero, one or more than one heat-pumped-channels (HPCs). This process selects one of the Humidifiers to be the unit-under-control (UUC). The UUC is identified with iteration variable "i". |
| 220: Retrieve | Process | Retrieve the contents of the calibration lookup table for the UUC. |
| 225: Look Up Table | Input/Output | Lookup table contains calibration coefficients for the UUC. |
| 230: Detect | Decision | Detect if calibration coefficients exist for the UUC. If no coefficients exist, enter the Calibration Algorithm. If coefficients exist, then continue. |
| 235: Detect | Decision | Detected that calibration coefficients exist, yet recalibration is desired. |
| 240: Configure | Process | Configure the hardware elements for calibration mode.<br>Set fan to the next point in the look up table that needs calibration. |
| 245: Look Up Table | Input/Output | Lookup table contains the maximum and minimum settings allowed for the UUC and the number of calibration points to collect. |
| 250: Query and Calculate | Process | Query multiple times from the power consumption sensor (PS_fan[ ]) the current power consumption.<br>Calculate and store the average and standard deviation statistics from power consumption sensor queries. |
| 260: Detect | Decision | Compare the standard deviation of the sensor queries. When standard deviations are near zero, then can assume that forced-air-nodes have settled. |
| 270: Store Cal Table | Decision | Store calibration coefficients and store in Lookup Table.<br>calFactors[i] = [ctrlFanTerm[i]), AVE(PS_fan[i]) |
| 280: Detect | Decision | Determine if all calibration points have been calibrated. |
| 285: Quit | Decision | Determine if all humidifiers have been calibrated. |
| 290: Deploy | Process | When discontinuing the calibration algorithm, deploy ctrlFanTermMin[ ] to Power Management Unit, disabling all elements. |
| 295: Look Up Table | Input/Output | Lookup table contains the minimum setting allowed for the fan element. |
| 299: Finish | Terminal | Finish point for calibration algorithm is entered after all elements have been calibrated and disabled. |

TABLE 16

| Calibration Mode: Humidifier - Parameter List | | | |
|---|---|---|---|
| Name | Symbol | Description | Units |
| Number of units-under-control - Max | numUUCMax | Number of humidifiers that can be calibrated. | Unitless |
| Forced-air-node Calibration Factors | none | Table relating the power consumption of the fan to the control voltage. | [Volts, Celsius] |
| Forced-air-node Control Term - Min | ctrlFanTermMin[i] | The minimum operational control setting allowed for the forced-air-node[i]. | Volts |

TABLE 16-continued

| Calibration Mode: Humidifier - Parameter List | | | |
|---|---|---|---|
| Name | Symbol | Description | Units |
| Forced-air-node Control Term - Max | ctrlFanTermMax[i] | The maximum operational control setting allowed for the forced-air-node [i]. | Volts |
| Num of cal points. | numOfCalPts[i] | Number of fan element calibration points including the extreme points; ctrlFanTermMin and ctrlFanTermMax. | Unitless |

5 Water Tank Level Sensing

The level of water present in the water tank may be an important aspect of evaluating the conditions within the payload chamber. It may also be important to maintaining the functionality of the system; for example, if the water level is getting low, a notification may be sent to the user to indicate that the water tank may need filling soon; if the water level is too high, a notification may also be sent to the user and the ECU may need to cease operations until the water level is reduced so as to avoid spillage into the payload chamber. Other examples are possible for the many different level states within the water tank.

One of the challenges faced by the water tank level-sensing system is how to detect the fill level within a possibly shallow reservoir while minimizing ambiguity caused by closely spaced sensors. Precise detection of the fill level in a shallow reservoir allows reporting actionable status more granular than the "Full Warning" and the "Empty Warning". With precise detection, fill level Warnings are supplemented with fill level Watches. While warnings indicate that the reservoir is full or empty, the watches indicate that the reservoir is almost full or almost empty. Following nomenclature of the National Weather Service, Warnings indicate "immediate action required" while Watches indicate "possible action required". Reporting a "no action required" is also available.

5.1 Design Elements

Figure 32:
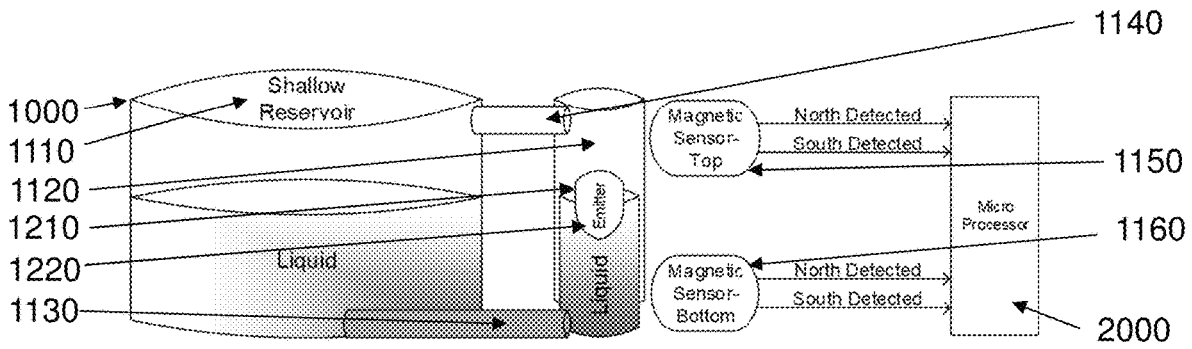
FIG. 32 is an exemplary diagram of elements of water level detection details that may be used to implement aspects of certain embodiments of the present invention.
Figure 33:
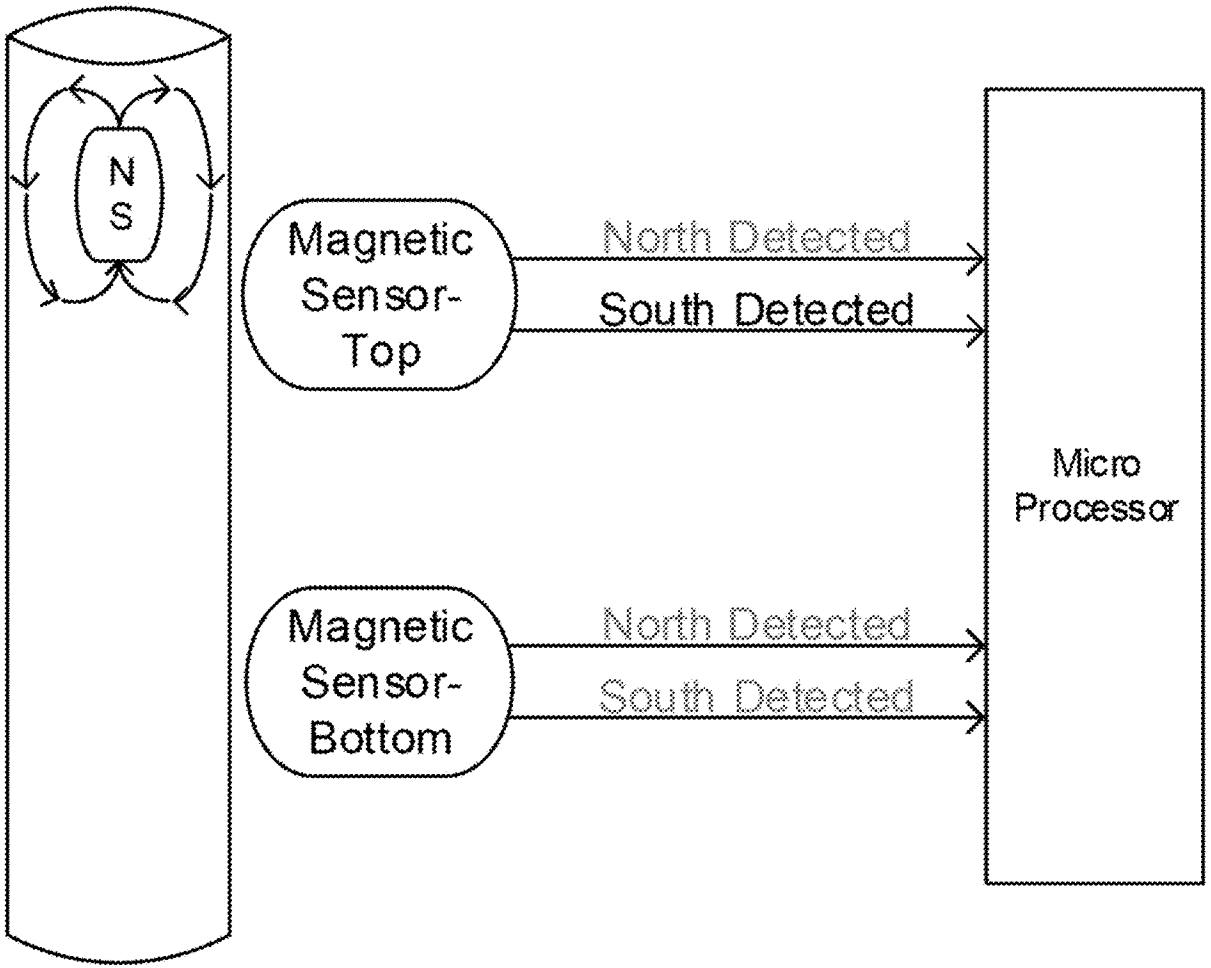
FIG. 33 is an exemplary diagram of details for when a magnetic emitter is detected at the top of a gauge tube that may be used to implement aspects of certain embodiments of the present invention.
Figure 34:
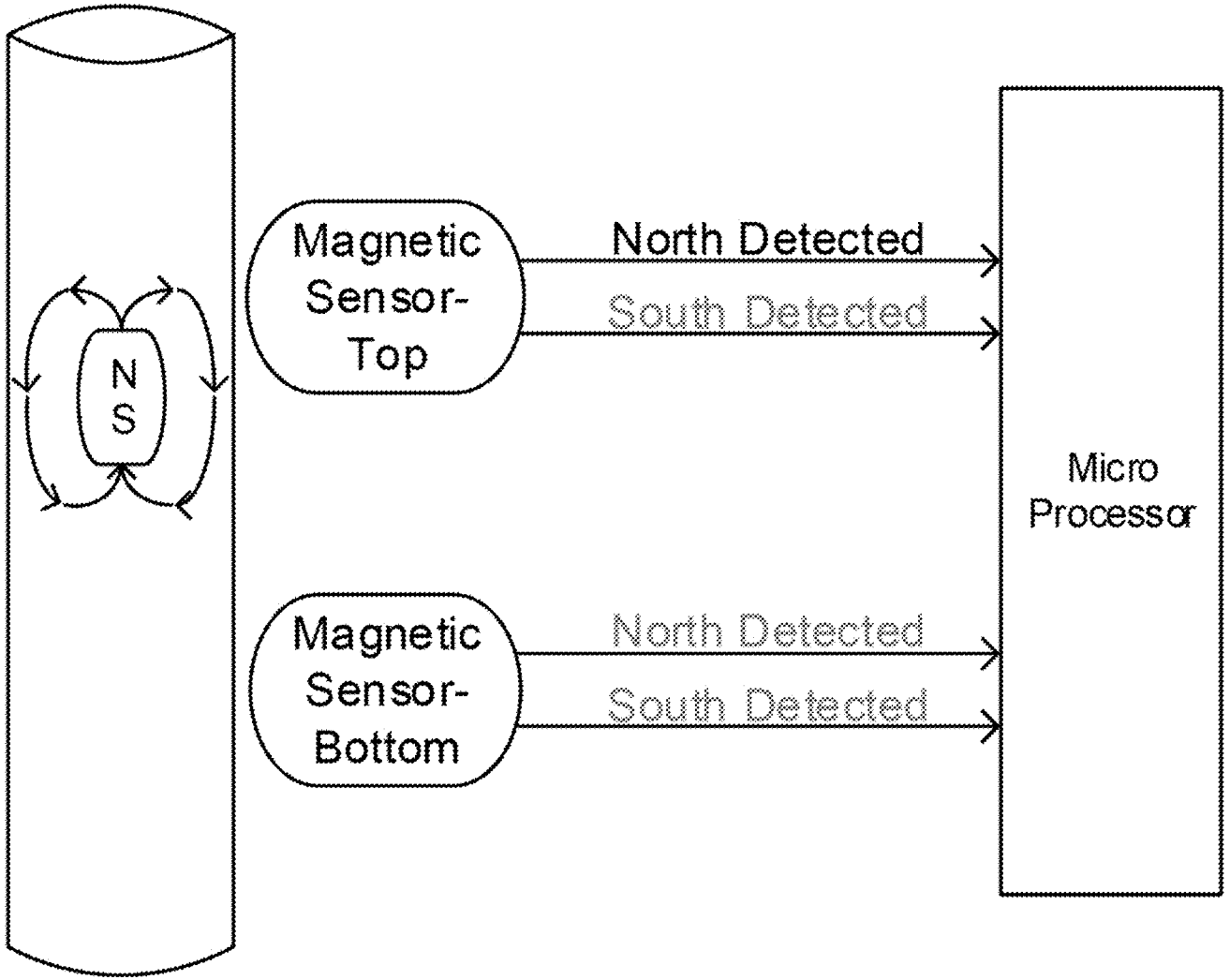
FIG. 34 is an exemplary diagram of details for when a magnetic emitter is detected near the top of a gauge tube that may be used to implement aspects of certain embodiments of the present invention.
Figure 35:
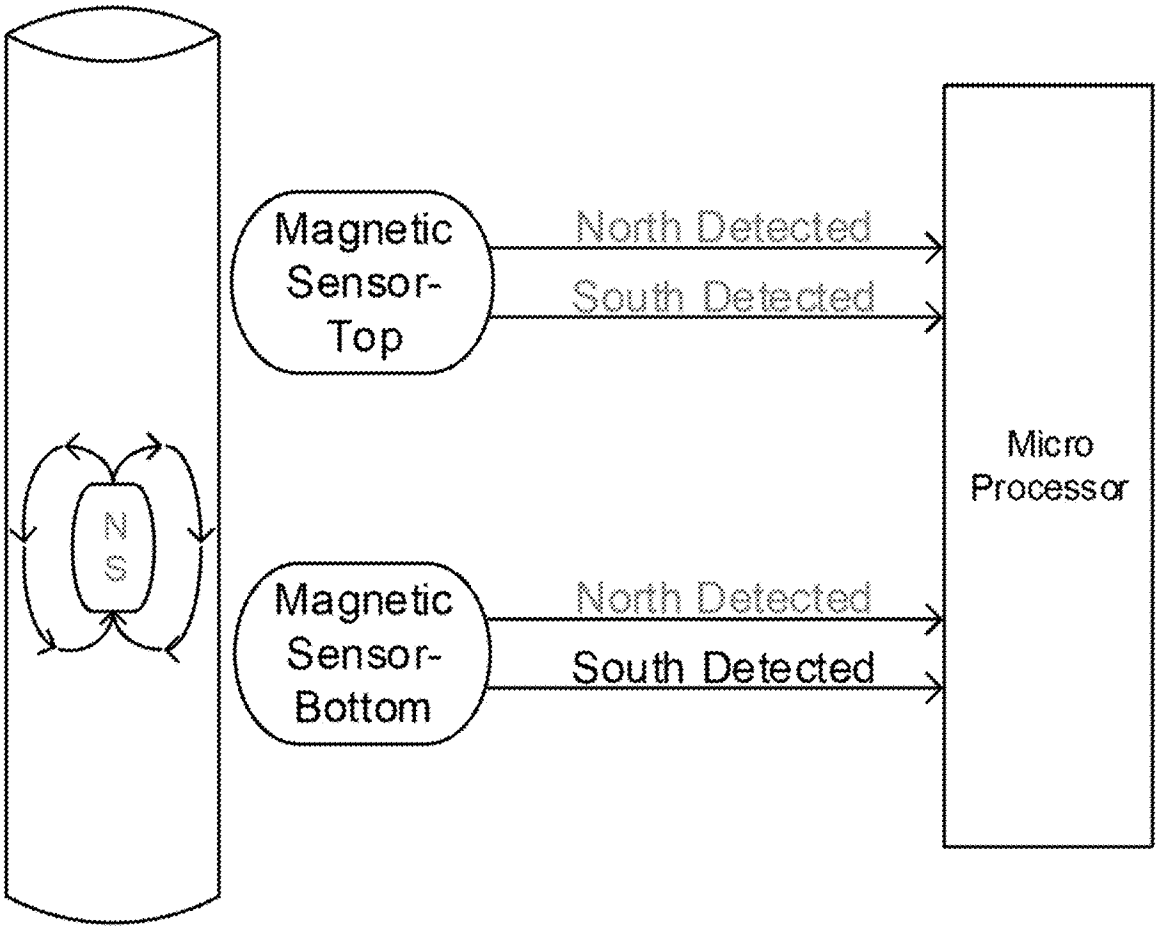
FIG. 35 is an exemplary diagram of details for when a magnetic emitter is detected near the bottom of a gauge tube that may be used to implement aspects of certain embodiments of the present invention.
Figure 36:
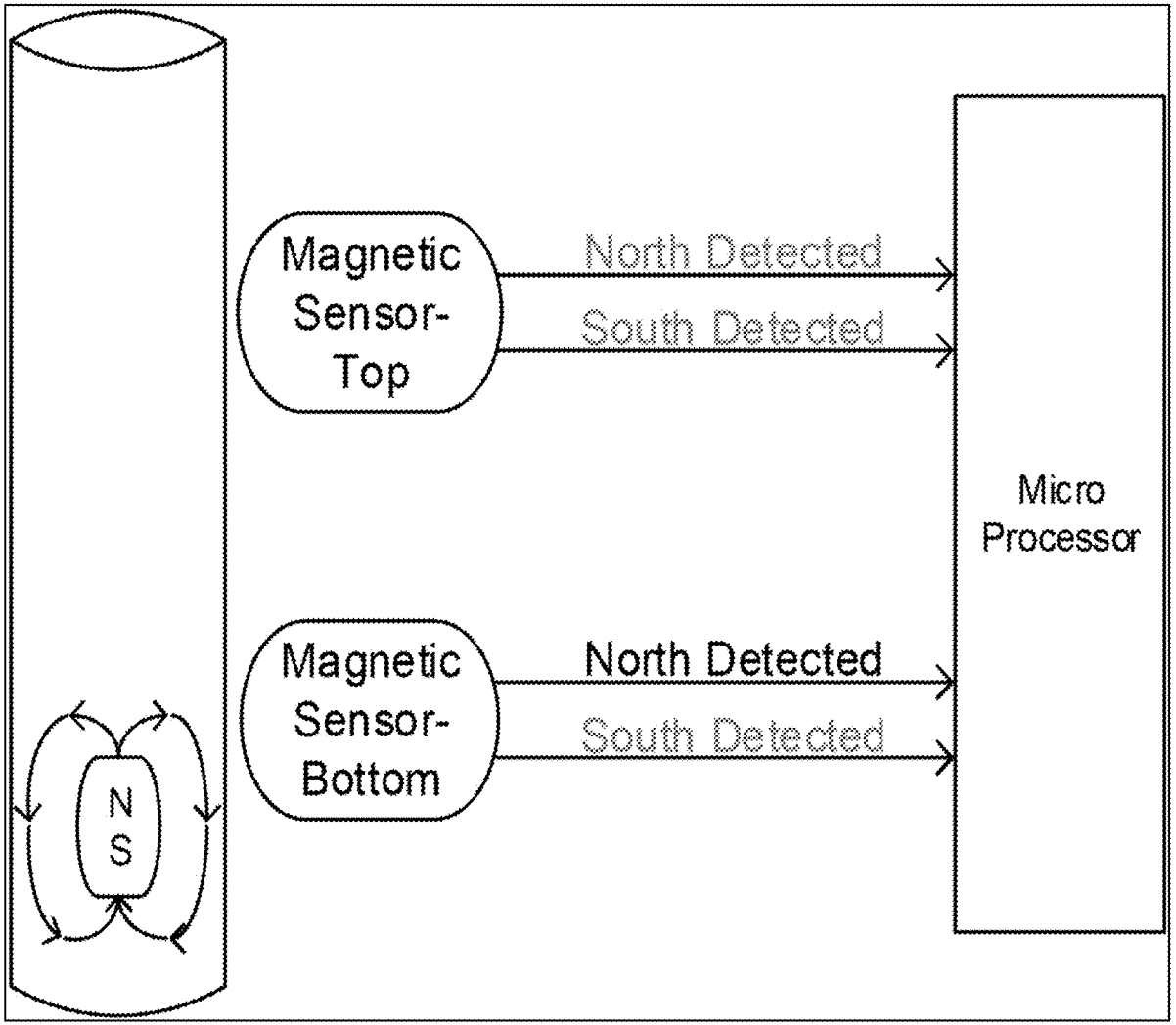
FIG. 36 is an exemplary diagram of details for when a magnetic emitter is detected at the bottom of a gauge tube that may be used to implement aspects of certain embodiments of the present invention.

The hardware and software designs consist of ten elements. The ten elements may be a shallow reservoir, gauge tube, fill port, vent port, magnetic sensor—top, magnetic sensor—bottom, buoyant vessel, magnetic emitter, microprocessor, and detection software as described in FIG. 32 and Table 17.

TABLE 17

| Elements of Water Level Detection | | |
|---|---|---|
| Reference Designator | Element | Abbreviation |
| 1000 | Shallow Reservoir with Fill Gauge Assembly | |
| 1110 | Shallow Reservoir | "Reservoir" |
| 1120 | Gauge Tube | "Gauge" |
| 1130 | Fill Port | "Port_Fill" |
| 1140 | Vent Port | "Port_Vent" |
| 1150 | Magnetic Sensor - Top | "MS_Top" |
| 1160 | Magnetic Sensor - Bottom | "MS_Bot" |
| 1210 | Buoyant Vessel | "Vessel" |
| 1220 | Magnetic Emitter | "Emitter" |
| 2000 | Microprocessor | "Micro" |
| 2010 | Detection Software-Electronic Fill Gauge | "Code" |

5.2 Relationships

Six primary elements, Shallow Reservoir 1110, Gauge Tube 1120, Fill Port 1130, Vent Port 1140, Magnetic Sensor—Top 1150, and Magnetic Sensor—Bottom 1160 may be in physical relationship with each other. Two secondary elements, Buoyant Vessel 1210 and Magnetic Emitter 1220 may be in physical relationship with each other as well as with the primary elements. Two additional elements, portions of the microprocessor 2000 and Detection Software 2010 may not be in significant physical relationship with the primary nor secondary elements.

The following sections describe the relationship of the primary elements and secondary elements.

5.2.1 Primary Elements

The relationship of the primary elements addresses the goal for producing a precise electronic fill gauge for shallow reservoir applications. During implementation, the design recognizes two key relevant factors. The first key relevant factor influences the relationship of the primary elements, while the second key relevant factor influences the relationship of the secondary elements.

First key relevant factor for precise fill level detection may be that a magnetic emitter enclosed within a buoyant vessel will remain at or near the surface of the liquid if it displaces more weight in liquid than the weight of the magnetic emitter and weight of the buoyant vessel combined. With the magnetic emitter remaining at or near the surface of the liquid, detection of the emitted magnetic field with a magnetic sensor located near the top of the shallow reservoir may indicate that the level of the liquid is near the top of the reservoir. Similarly, detecting the emitted magnetic field with a magnetic sensor located near the bottom of the reservoir may indicate that the level of the liquid is near the bottom of the reservoir.

Magnetic sensors, possibly of the Hall Effect type, require close proximity to the magnetic emitter for consistent detection. In small form-factor applications like with shallow reservoirs, the movement of the magnetic emitter must be constrained along the X-axis and the Y-axis to maintain close proximity between the magnetic emitter and the magnetic sensors, but unconstrained along the Z-axis. With these considerations, the primary elements have the following relationship:

The Gauge Tube 1120 may be located outside of the Shallow Reservoir 1110 oriented vertically where the top of the Gauge Tube 1120 is substantially level with the top of the Shallow Reservoir 1110. The bottom of the Gauge Tube 1120 is substantially level with the bottom of the Shallow Reservoir 1110. The Fill Port 1130 connects the bottoms of the Gauge Tube 1120 and Shallow Reservoir 1110 allowing the free-flowing of liquid between the two elements. The Vent Port 1140 connects the tops of the Gauge Tube 1120 and Shallow Reservoir 1110 allowing the free-flowing of gas between the two elements. The secondary elements Buoyant Vessel 1210 and Magnetic Emitter 1220 are located within the Gauge Tube 1120.

The Magnetic Sensor—Top 1150 may be located near the top of the Gauge Tube 1120 and oriented such that the sensor optimally detects the magnetic fields generated by the Magnetic Emitter 1220. For the DRV5032 Ultra-Low-Power Digital-Switch Hall Effect Sensor produced by Texas Instruments, optimal detection is by orienting the body of the integrated-circuit package substantially horizontal in the X-Y plane. The Magnetic Sensor—Bottom 1160 is located near the bottom of the Gauge Tube 1120 and similarly oriented for optimal detection of the magnetic field.

All primary elements may be constructed of non-ferrous materials like plastic, glass, wood, certain metals, etc.

In an alternate embodiment, the gauge tube is located within the reservoir, but still constrains the movement of the magnetic emitter along the X-axis and the Y-axis but does not constrain movement along the Z-axis.

5.2.2 Secondary Elements

The relationship of the secondary elements addresses the goal for producing a precise electronic fill gauge for shallow reservoir applications. The second key relevant factor influences the relationship of the secondary elements.

Second key relevant factor for precise fill level detection may be that emitted magnetic fields have polarities. The magnetic flux exits the emitter from the North Pole and re-enters the emitter in the South Pole. Certain magnetic sensors separately detect the Northern polarity from the Southern polarity. For the DRV5032 Ultra-Low-Power Digital-Switch Hall Effect Sensor produced by Texas Instruments, versions DU and FD when in the X2SON 4-pin package, separately indicate detection of Northern magnetic poles from Southern magnetic poles. The DU and FD version are referred to as having Unipolar Magnetic Response while the FA, FB, FC, AJ, and ZE versions are referred to as having Omnipolar Magnetic Response. Sensors with Omnipolar Magnetic Response cannot differentiate between Northern and Southern magnetic poles. With these considerations, the primary elements have the following relationship;

The Magnetic Emitter 1220 may be located within the Buoyant Vessel 1210 and adhered to the Buoyant Vessel 1210 such that the combined center of gravity is substantially apart from the combined center of pressure. The emitter is adhered to the vessel such that the North Pole rigidly points towards the center of pressure while the South Pole rigidly points away from the center of pressure. With this relationship, when the combined emitter and vessel are floating at or near the surface of the liquid, the center of gravity will be lower than the center of pressure. This results in the orientation of the emitter being consistent and that the North Pole is facing up while the South Pole is facing down.

In an alternate embodiment, the emitter could be adhered to the vessel such that the North Pole rigidly points away from the center of pressure while the South Pole rigidly points towards the center of pressure. In an alternate embodiment, the emitter could be adhered to the outer surface of the vessel. Either of these alternate embodiments still results in a consistent magnetic pole facing up when the vessel is floating in the liquid.

FIG. 33 through FIG. 36 demonstrate the ability to precisely detect four locations of the Magnetic Emitter 1220 within the Gauge Tube 1120.

Figure 37:
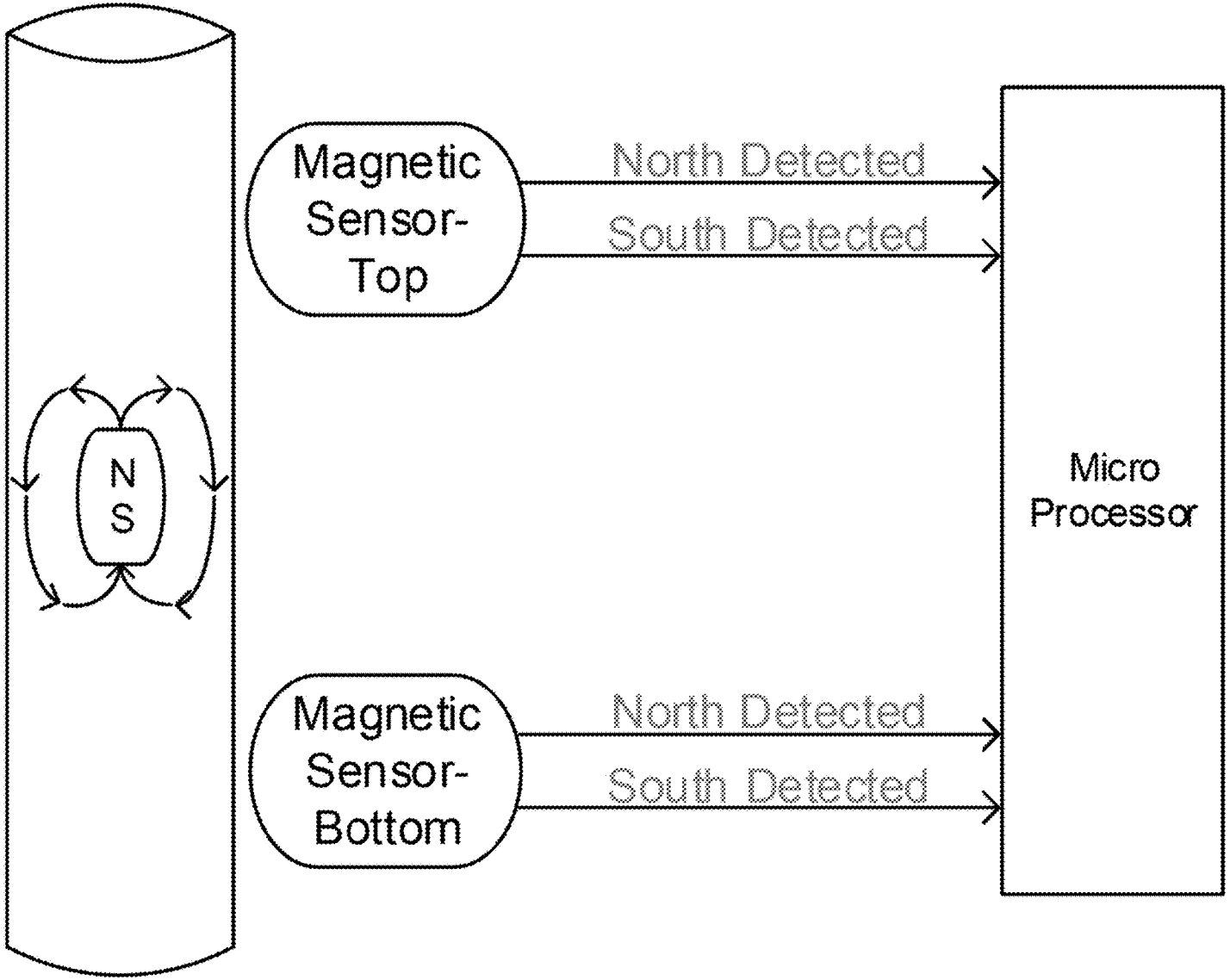
FIG. 37 is an exemplary diagram of details for when a magnetic emitter is not detected by either sensor that may be used to implement aspects of certain embodiments of the present invention.
Figure 38:
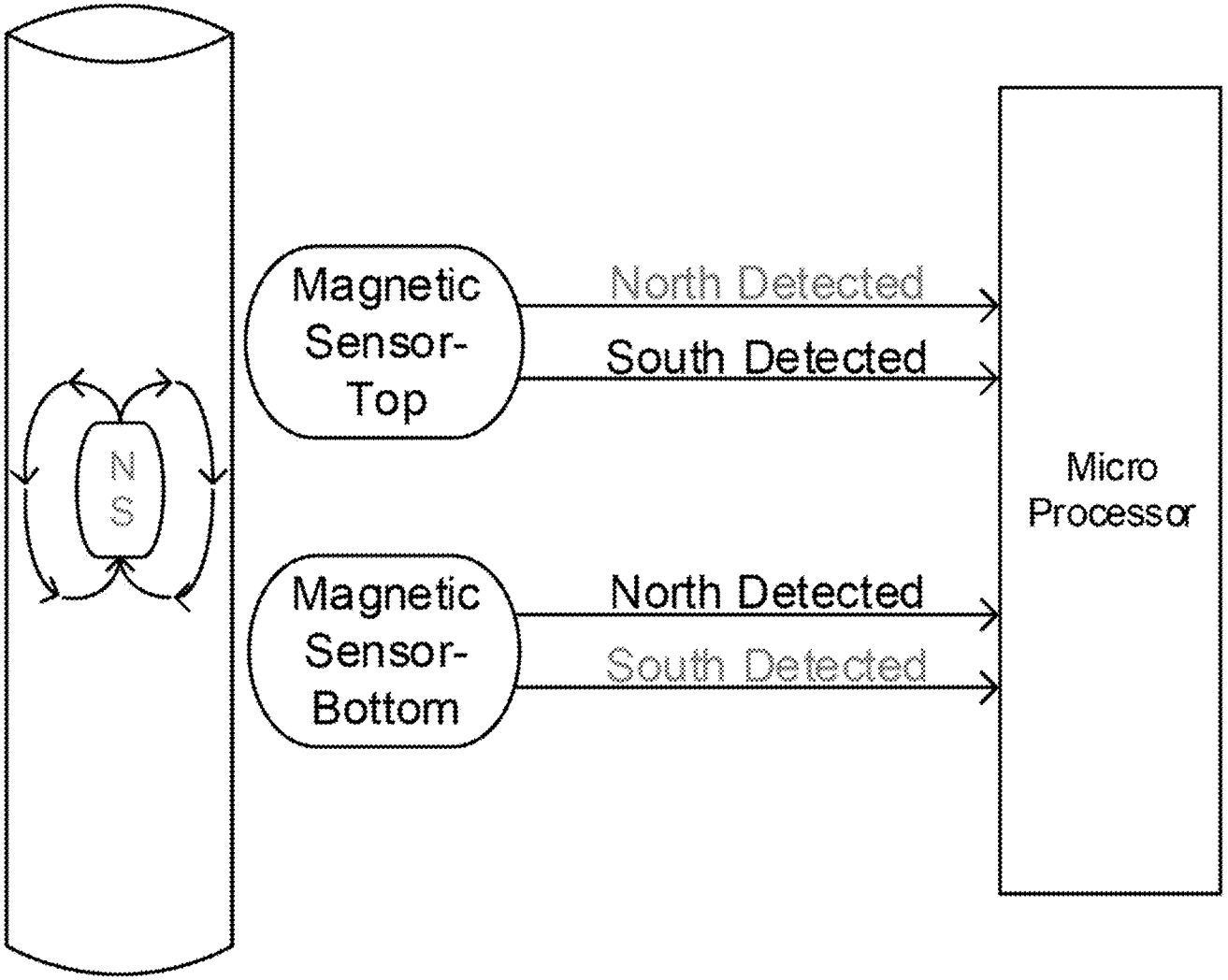
FIG. 38 is an exemplary diagram of details for when a magnetic emitter is detected by both sensors that may be used to implement aspects of certain embodiments of the present invention.

FIG. 37 and FIG. 38 demonstrate cases for when the spacing of the magnetic sensors is large and when the spacing is small.

In FIG. 37, the magnetic sensor spacing is large such that the Magnetic Emitter is not detected by either sensor.

In FIG. 38, the magnetic sensor spacing is small such that the Magnetic Emitter is detected by both sensors.

5.3 Detection Software

The detection software is responsible for receiving the status from the magnetic sensors and reporting actionable status to higher processes.

Table 18 relates status received from the magnetic sensors to actionable status for reporting to higher processes.

TABLE 18

Magnetic Sensor Status vs. Possible Actions

| Magnetic Sensor - Top 1150 Pole Detection | Magnetic Sensor - Bottom 1160 Pole Detection | Actionable Status |
|---|---|---|
| South | Neither | Reservoir Full Warning Action Required |
| North | Neither | Reservoir Almost Full Watch Possible Action Required |
| Neither | South | Reservoir Almost Empty Watch Possible Action Required |
| Neither | North | Reservoir Empty Warning Action Required |
| Neither | Neither | No Action Required |
| South | North | Due to close proximity of magnetic sensors, design is not able to detect status for generating Watches. Can only detect status for generating Warnings. |

6 Interface

Conditions within the payload chamber are not necessarily set as a single target goal. The user may enter a profile that dictates certain conditions for a certain amount of time after which a second set of conditions and duration are followed. This process may be repeated to allow for multiple sets of conditions and durations.

Another method which may be implemented with the assistance of a Cloud connection is the detection of the current state of the payload. As the payload progresses from one state to another (e.g., ripening to curing to drying to preservation), the environmental conditions may be modified to promote the process occurring in that state. This device may also be connected to a database that contains setup information, history of performance, data from other units as well as the ability for importing of the data or exporting the data to a database.

Users may set humidity and/or temperature (if controlled) targets for payload. They may also set a target over time or a cycle for harvest drying, curing and long-term storage. The user may be able to set and control a complex schedule of set points over a time period (create a control mask (envelope) of inputs over time) to allow the payload to rejuvenate old and/or over-dried cigars by adding moisture, as one example. Another example is that this system may take cannabis flowers through all stages of preparation for use: drying, curing and long-term storage, etc. There may be other types of payloads that have multistage environment requirements in order to generate a finished product such as curing for 10 days, drying for 2 days, etc. of a painted product, for example.

This interface system may allow for programming a set of multi-time period (e.g. hours, days, weeks, months, etc.) environmental conditions (e.g. temperature, humidity, light illumination, solar radiation, vibration, shock, etc.) for automated and/or semi-automated operation. For example, this may allow the user to program multi-month environmental conditions for a payload.

The user may also be able to remotely monitor the payload as well as the environmental conditions. The user may get status updates, alarms, or other user selectable information and may obtain them in many selectable formats (raw data, tabular, graphical, etc.).

The user may program the controlled environment system remotely as well as locally. Locally may be performed by using the LCD and/or the buttons. This may also be completed by connecting an electronic device to the unit either through a wired interface or through a wireless interface. Wireless control or monitoring may be accomplished by use of the Cloud. It may also be accomplished by using an application or by using a combination of these (cloud and application).

The control of this device may include informing the user that the battery is about to be depleted, or inform the user how much battery life is left, for example, in number of hours left, percentage left, etc.

The unit, Cloud, or a combination of both, may contain algorithms that can predict exactly, or with some margin of error, adverse conditions and/or when the payload will reach the optimum (or set point) of target environment, such as, humidity/moisture, temperature setting, etc. The unit and/or Cloud may perform this either alone, in conjunction with a Cloud application component, or the algorithms may be completely contained in the Cloud. In addition to adverse conditions, crowd-sourced or device-sourced data collected by the Cloud may be analyzed and used to perform payload model statistical updates to hone the prediction accuracy of how long, for example, it may take for a user's payload to finish curing, drying, etc. Graphs or curves, to be shown to a user, may be generated showing the predicted moisture content over time and how long it will take for the payload to reach the ideal moisture content. Overlaid on or in addition to these graphs, different scenarios may be drawn to show the impact of various settings the user may change to impact when the payload may be ready; for example, engaging or disengaging Turbo mode, increasing humidity in an earlier part of the cycle and decreasing it in a later part of the cycle. Prediction models may enable the user to make intelligent choices with respect to battery life and when the payload may be ready. For instance, it may be desired by the user to have the payload ready to use for an important social event or party.

7 Applications (ECU, Cloud, and User-Device Based)

An application may be used with an electronic device, belonging to the user, that is coupled to the unit. The electronic device may be a laptop, mobile phone, or any other computer-type device. This application can recommend settings to a user based on the type of payload that is being stored in the environment. For example, if cigars were being stored, the application may recommend a temperature setting and/or a humidity setting, as well as other settings for best storage results. The application may then even program the unit with these settings. The user may also take these recommendations and enter them into the unit using the LCD, the buttons, or a combination of these to program the setpoint for storing the payload.

The user, while using the application, may also receive various advertisements. The advertisements may be general in nature or they may have some commonality with the unit itself or the payload. For example, if the user is storing cigars, they may receive an ad to buy cigars, or they may receive a coupon to buy cigars at a discount. The application may generate revenue based on these advertisements.

The Cloud may feature additional resources including education; such as, cigar education, storage of food education, curing of products education, identification of stains, recipes, etc. The information may be provided to the application via a Cloud server which gathers crowd-sourced recipes, temperature/humidity profiles, and other payload specific information.

The application, as well as the ECU, may gather statistics and meta data as well as other types of data that are then provided to a Cloud server which may perform statistical analysis and data mining on how all the different controlled environment systems are performing and what they are storing. This information can be used to improve the product and/or provide general market insights; for example, how people are using the controlled environment system and what are their results, how people are using cigars, how people are curing painted products, what kind of cheese people are serving at a party, etc. and then used to improve the user experience.

For example, data may be collected from the payload chamber so that statistical analysis may be performed. This analysis may be used to enhance the storage process or assist later in a future process by the user or anyone that has access to this analysis.

Certain figures in this specification are flow charts illustrating methods and systems. It will be understood that each block of these flow charts, and combinations of blocks in these flow charts, may be implemented by computer program instructions. These computer program instructions may be loaded onto a computer or other programmable apparatus to produce a machine, such that the instructions that execute on the computer or other programmable apparatus create structures for implementing the functions specified in the flow chart block or blocks. These computer program instructions may also be stored in computer-readable memory that can direct a computer or other programmable apparatus to function in a particular manner, such that the instructions stored in computer-readable memory produce an article of manufacture including instruction structures that implement the function specified in the flow chart block or blocks. The computer program instructions may also be loaded onto a computer or other programmable apparatus to cause a series of operational steps to be performed on the computer or other programmable apparatus to produce a computer-implemented process such that the instructions that execute on the computer or other programmable apparatus provide steps for implementing the functions specified in the flow chart block or blocks.

Accordingly, blocks of the flow charts support combinations of structures for performing the specified functions and combinations of steps for performing the specified functions. It will also be understood that each block of the flow charts, and combinations of blocks in the flow charts, can be implemented by special purpose hardware-based computer systems that perform the specified functions or steps, or combinations of special purpose hardware and computer instructions.

For example, any number of computer programming languages, such as C, C++, C #(CSharp), Perl, Ada, Python, Pascal, SmallTalk, FORTRAN, assembly language, and the like, may be used to implement aspects of the present invention. Further, various programming approaches such as procedural, object-oriented or artificial intelligence techniques may be employed, depending on the requirements of each particular implementation. Compiler programs and/or virtual machine programs executed by computer systems generally translate higher level programming languages to generate sets of machine instructions that may be executed by one or more processors to perform a programmed function or set of functions.

In the foregoing descriptions, certain embodiments are described in terms of particular data structures, preferred and optional enforcements, preferred control flows, and examples. Other and further application of the described methods, as would be understood after review of this application by those with ordinary skill in the art, are within the scope of the invention.

The term "machine-readable medium" should be understood to include any structure that participates in providing data that may be read by an element of a computer system. Such a medium may take many forms, including but not limited to, non-volatile media, volatile media, and transmission media. Non-volatile media include, for example, optical or magnetic disks and other persistent memory such as devices based on flash memory (such as solid-state drives, or SSDs). Volatile media include dynamic random access memory (DRAM) and/or static random access memory (SRAM). Transmission media include cables, wires, and fibers, including the wires that comprise a system bus coupled to a processor. Common forms of machine-readable media include, for example and without limitation, a floppy disk, a flexible disk, a hard disk, a solid-state drive, a magnetic tape, any other magnetic medium, a CD-ROM, a DVD, or any other optical medium.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs) and DVDs (digital versatile discs or digital video discs), and computer instruction signals embodied in a transmission medium (with or without a carrier wave upon which the signals are modulated). For example, the transmission medium may include a communications network, such as the Internet.

Figure 39:
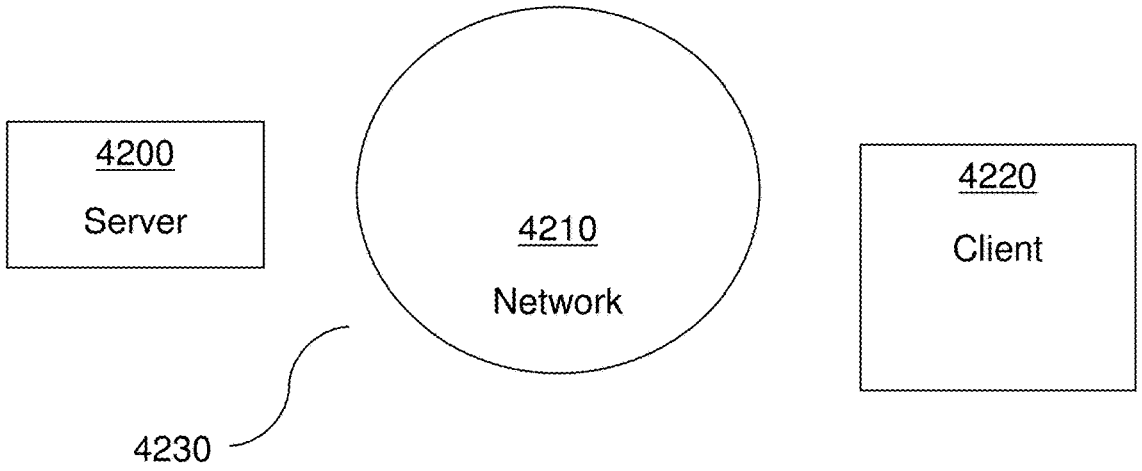
FIG. 39 illustrates an exemplary networked computing system environment and its relevant components according to certain embodiments of the present invention.

FIG. 39 depicts an exemplary networked environment 4230 in which systems and methods, consistent with exemplary embodiments, may be implemented. As illustrated, networked environment 4230 may include, without limitation, a server (4200), a client (4220), and a network (4210). The exemplary simplified number of servers (4200), clients (4220), and networks (4210) illustrated in FIG. 42 can be modified as appropriate in a particular implementation. In practice, there may be additional servers (4200), clients (4220), and/or networks (4210).

In certain embodiments, a client 4220 may connect to network 4210 via wired and/or wireless connections, and thereby communicate or become coupled with server 4200, either directly or indirectly. Alternatively, client 4220 may be associated with server 4200 through any suitable tangible computer-readable media or data storage device (such as a disk drive, CD-ROM, DVD, or the like), data stream, file, or communication channel.

Network 4210 may include, without limitation, one or more networks of any type, including a Public Land Mobile Network (PLMN), a telephone network (e.g., a Public Switched Telephone Network (PSTN) and/or a wireless network), a local area network (LAN), a metropolitan area network (MAN), a wide area network (WAN), an Internet Protocol Multimedia Subsystem (IMS) network, a private network, the Internet, an intranet, a cellular network, and/or another type of suitable network, depending on the requirements of each particular implementation.

One or more components of networked environment 4230 may perform one or more of the tasks described as being performed by one or more other components of networked environment 4230.

Figure 40:
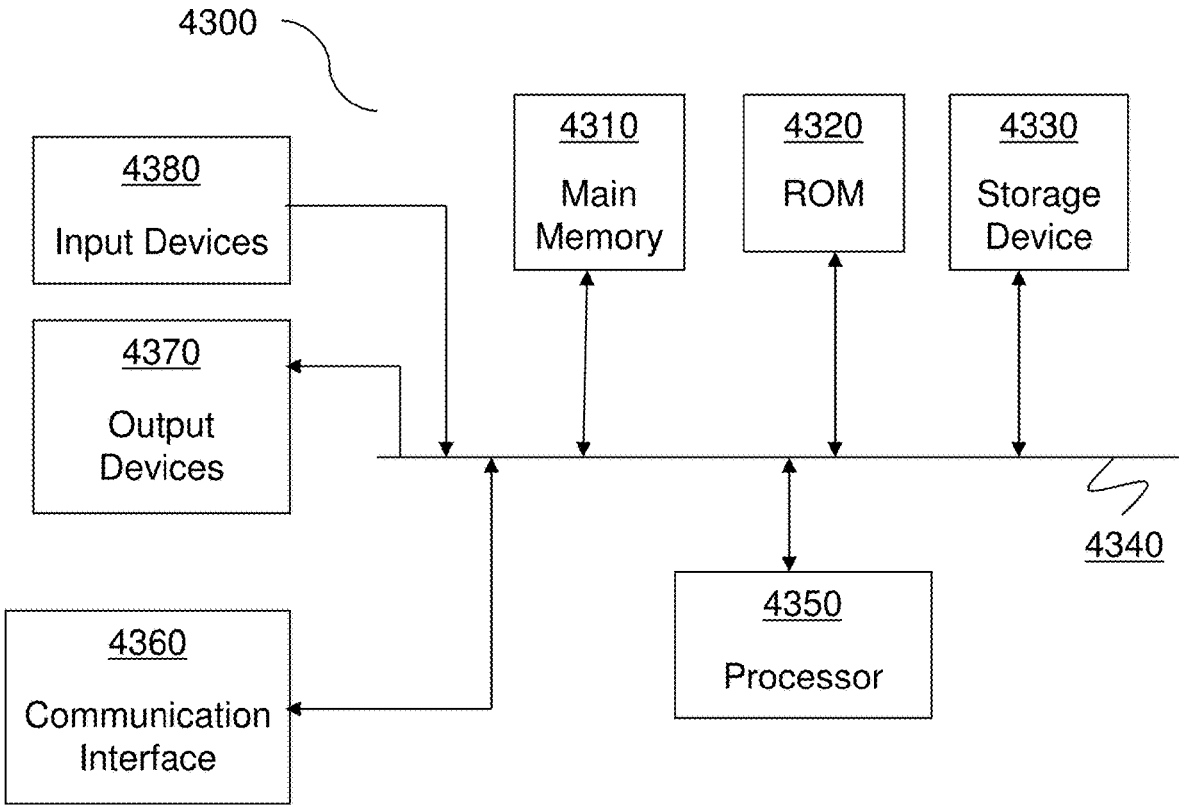
FIG. 40 is an exemplary block diagram of a computing device that may be used to implement aspects of certain embodiments of the present invention.

FIG. 40 is an exemplary diagram of a computing device 4300 that may be used to implement aspects of certain embodiments of the present invention, such as aspects of server 4300 or of client 4320, or of the environmental control unit embodiments described in this document. In certain embodiments, computing device 4300 may be, without limitation, a desktop or notebook computing device, or a mobile computing device that may include, without limitation, a smart phone or tablet device, or it may be integrated entirely or partially into an environmental control unit. Computing device 4300 may include, without limitation, a bus 4340, one or more processors 4350, a main memory 4310, a read-only memory (ROM) 4320, a storage device 4330, one or more input devices 4380, one or more output devices 4370, and a communication interface 4360. Bus 4340 may include, without limitation, one or more conductors that permit communication among the components of computing device 4300.

Processor 4350 may include, without limitation, any type of conventional processor, microprocessor, or processing logic that interprets and executes instructions. Main memory 4310 may include, without limitation, a random-access memory (RAM) or another type of dynamic storage device that stores information and instructions for execution by processor 4350. ROM 4320 may include, without limitation, a conventional ROM device or another type of static storage device that stores static information and instructions for use by processor 4350. Storage device 4330 may include, without limitation, a magnetic and/or optical recording medium and its corresponding drive.

Input device(s) 4380 may include, without limitation, one or more conventional mechanisms that permit a user to input information to computing device 4300, such as a keyboard, a mouse, a pen, a stylus, handwriting recognition, voice recognition, biometric mechanisms, touch screen, and the like. Output device(s) 4370 may include, without limitation, one or more conventional mechanisms that output information to the user, including a display, a projector, an A/V receiver, a printer, a speaker, and the like. Communication interface 4360 may include, without limitation, any transceiver-like mechanism that enables computing device 4300 to communicate with other devices and/or systems. For example, communication interface 4360 may include, without limitation, mechanisms for communicating with another device or system via a network, such as network 4310 shown in FIG. 43.

As described in detail herein, computing device 4300 may perform operations based on software instructions that may be read into memory 4310 from another computer-readable medium, such as data storage device 4330, or from another device via communication interface 4360. The software instructions contained in memory 4310 cause processor 4350 to perform processes that are described elsewhere. Alternatively, hardwired circuitry may be used in place of, or in combination with, software instructions to implement processes consistent with the present invention. Thus, various implementations are not limited to any specific combination of hardware circuitry and software.

Details regarding the foregoing components, which may be implemented in a single computing device or distributed among multiple computing devices, are described throughout this document.

Those skilled in the art will realize that embodiments of the present invention may use any suitable data communication network, including, without limitation, direct point-to-point data communication systems, dial-up networks, personal or corporate intranets, proprietary networks, or combinations of any of these with or without connections to the Internet.

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art, as mentioned above. The invention includes any combination or sub-combination of the elements from the different species and/or embodiments disclosed herein.

What is claimed is:

1. An apparatus for monitoring and controlling an environment inside a container defining a payload chamber, comprising:

a plurality of environmental control units disposed within said payload chamber, wherein each of said environmental control units comprises a humidity sensor, a humidifier, a dehumidifier, and an environmental control processor, wherein each of said environmental control processors is configured to receive one or more input signals from said respective humidity sensor, wherein each of said environmental control processors is configured to transmit control signals to said respective humidifier and to said respective dehumidifier, wherein each of said environmental control processors is configured to execute an algorithm for monitoring and controlling said environment within said payload chamber based on said respective input signals by generating said respective control signals so as to substantially maintain a first humidity level, wherein two or more of said environmental control units are configured to function in unison to substantially maintain said first humidity level, wherein each of said environmental control processors is configured to receive a mode select signal that determines whether said algorithm executes in a first mode comprising a first operating rate so as to conserve power or in a second mode comprising a second operating rate that is faster than said first operating rate, and wherein each of said environmental control processors is configured to receive a calibration mode select signal that determines whether, instead of executing said algorithm, each of said environmental control processors executes in a calibration mode to improve the efficiency of said algorithm.

2. The apparatus of claim 1, wherein each of said environmental control units further comprises a user interface, wherein each of said environmental control processors is further configured to receive said respective input signals from said respective user interface, and wherein each of said environmental control processors is further configured to transmit said respective control signals to said respective user interface.

3. The apparatus of claim 2 wherein said user interface comprises a display.

4. The apparatus of claim 2 wherein said user interface comprises one or more user controls.

5. The apparatus of claim 2, wherein each of said environmental control processors is configured to receive said first selected humidity level from said user interface.

6. The apparatus of claim 1, wherein said first selected humidity level is predetermined.

7. The apparatus of claim 1, wherein said first selected humidity level is dynamically determined by one or more of said environmental control processors.

8. The apparatus of claim 1, wherein said humidifier comprises a water tank comprising a water level sensor, and wherein each of said environmental control processors is further configured to receive said input signals from said water level sensor.

9. The apparatus of claim 8, wherein said dehumidifier comprises a thermoelectric heat pump, and wherein each of said environmental control processors is further configured to send said control signals to said thermoelectric heat pump.

10. The apparatus of claim 1, wherein said dehumidifier comprises a thermoelectric heat pump, and wherein each of said environmental control processors is further configured to send said control signals to said thermoelectric heat pump.

11. The apparatus of claim 1, wherein each of said environmental control units further comprises a fan for moving air from a portion of said payload chamber through said environmental control unit and back to said payload chamber.

12. An apparatus for maintaining a controlled environment within a substantially airtight container, comprising:

a payload chamber;

a plurality of environmental control units disposed within said payload chamber, wherein each of said environmental control units comprises a humidity sensor, a humidifier, a dehumidifier, and an environmental control processor, wherein each of said environmental control processors is configured to receive one or more input signals from said respective humidity sensor, wherein each of said environmental control processors is configured to transmit one or more control signals to said respective humidifier and to said respective dehumidifier, wherein each of said environmental control processors is configured to execute an algorithm for monitoring and controlling said environment within said payload chamber based on said respective input signals by generating said respective control signals so as to substantially maintain a first humidity level, wherein two or more of said environmental control units are configured to function in unison to substantially maintain said first humidity level, wherein each of said environmental control processors is configured to receive a mode select signal that determines whether said algorithm executes in a first mode comprising a first operating rate so as to conserve power or in a second mode comprising a second operating rate that is faster than said first operating rate, and wherein each of said environmental control processors is configured to receive a calibration mode select signal that determines whether, instead of executing said algorithm, each of said environmental control processors executes in a calibration mode to improve the efficiency of said algorithm.

13. The apparatus of claim 12, wherein each of said environmental control units further comprises a user interface, wherein each of said environmental control processors is further configured to receive said respective input signals from said respective user interface, and wherein each of said environmental control processors is further configured to transmit said respective control signals to said respective user interface.

14. The apparatus of claim 13 wherein said user interface comprises a display.

15. The apparatus of claim 13 wherein said user interface comprises one or more user controls.

16. The apparatus of claim 13, wherein each of said environmental control processors is configured to receive said first selected humidity level from said user interface.

17. The apparatus of claim 12, wherein said first selected humidity level is predetermined.

18. The apparatus of claim 12, wherein said first selected humidity level is dynamically determined by one or more of said environmental control processors.

19. The apparatus of claim 12, wherein said humidifier comprises a water tank comprising a water level sensor, and wherein each of said environmental control processors is further configured to receive said input signals from said water level sensor.

20. The apparatus of claim 19, wherein said dehumidifier comprises a thermoelectric heat pump, and wherein each of said environmental control processors is further configured to send said control signals to said thermoelectric heat pump.

21. The apparatus of claim 12, wherein said dehumidifier comprises a thermoelectric heat pump, and wherein each of said environmental control processors is further configured to send said control signals to said thermoelectric heat pump.

22. The apparatus of claim 12, wherein each of said environmental control units further comprises a fan for moving air from a portion of said payload chamber through said environmental control unit and back to said payload chamber.

23. An apparatus for monitoring and controlling an environment inside a container defining a payload chamber, comprising:

a plurality of environmental control units disposed within said payload chamber, wherein each of said environmental control units comprises a humidity sensor, a dehumidifier, and an environmental control processor, wherein each of said environmental control processors is configured to receive one or more input signals from said respective humidity sensor, wherein each of said environmental control processors is configured to transmit one or more control signals to said respective dehumidifier, wherein each of said environmental control processors is configured to execute an algorithm for monitoring and controlling said environment within said payload chamber based on said respective input signals by generating said respective control signals so as to substantially maintain a first humidity level, wherein two or more of said environmental control units are configured to function in unison to substantially maintain said first humidity level, wherein each of said environmental control processors is configured to receive a mode select signal that determines whether said algorithm executes in a first mode comprising a first operating rate so as to conserve power or in a second mode comprising a second operating rate that is faster than said first operating rate, and wherein each of said environmental control processors is configured to receive a calibration mode select signal that determines whether, instead of executing said algorithm, each of said environmental control processors executes in a calibration mode to improve the efficiency of said algorithm.

24. The apparatus of claim 23, wherein each of said environmental control units further comprises a fan for moving air from a portion of said payload chamber through said environmental control unit and back to said payload chamber.

* * * * *